US006746835B2

(12) United States Patent
Watanabe et al.

(10) Patent No.: US 6,746,835 B2
(45) Date of Patent: Jun. 8, 2004

(54) THERMALLY PROCESSED IMAGE RECORDING MATERIAL

(75) Inventors: Katsuyuki Watanabe, Minami-ashigara (JP); Masaru Takasaki, Minami-ashigara (JP); Toshihide Ezoe, Minami-ashigara (JP); Kohzaburoh Yamada, Minami-ashigara (JP); Yasuhiro Kawanishi, Minami-ashigara (JP); Masahiko Taniguchi, Minami-ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/080,019

(22) Filed: Feb. 22, 2002

(65) Prior Publication Data

US 2002/0164552 A1 Nov. 7, 2002

(30) Foreign Application Priority Data

Feb. 22, 2001 (JP) ..... 2001-046809
Feb. 22, 2001 (JP) ..... 2001-046810
Feb. 22, 2001 (JP) ..... 2001-046811

(51) Int. Cl.[7] ..... G03C 1/498; G03C 1/295

(52) U.S. Cl. ..... 430/619; 264/598; 264/611; 264/613; 264/614; 264/620

(58) Field of Search ..... 430/619, 617, 430/264, 598, 611, 620, 613, 614

(56) References Cited

U.S. PATENT DOCUMENTS 6,232,059 B1 * 5/2001 Yamada et al. ..... 430/619
6,277,553 B1 8/2001 Taniguchi et al.
6,277,554 B1 * 8/2001 Yamada et al. ..... 430/619
6,387,605 B1 * 5/2002 Lynch et al. ..... 430/350
6,423,486 B2 * 7/2002 Yamada et al. ..... 430/617

FOREIGN PATENT DOCUMENTS

EP 0921433 * 6/1999
JP 11133546 * 5/1999 ..... G03C/1/498
JP 11-231459 A 8/1999
JP 11-327077 A 11/1999

* cited by examiner

*Primary Examiner*—Thorl Chea
(74) *Attorney, Agent, or Firm*—Birch, Stewart, Kolasch & Birch, LLP

(57) ABSTRACT

Disclosed is a thermally processed image recording material containing, on one side of a support having an image-forming layer, a silver salt of an organic acid, a reducing agent and at least one kind of a compound represented by the following formula (1):

Formula (1)

wherein X and Y represent an electron-withdrawing group and M represents a counter cation, and the conjugate acid of the enolate anion in the formula (1) has a pKa value of 3.0–6.0. This thermally processed image recording material shows low fog, high Dmax, ultrahigh contrast and good storage stability.

20 Claims, 1 Drawing Sheet

THERMALLY PROCESSED IMAGE RECORDING MATERIAL

BACKGROUND OF THE INVENTION

1. Field of the Invention

The present invention relates to a thermally processed image recording material. More precisely, the present invention relates to a thermally processed image recording material suitable for use in photomechanical processes for ultrahigh contrast images.

2. Description of the Related Art

There are known many photosensitive materials having a photosensitive layer on a support, with which image formation is attained by imagewise light exposure. Those materials include those utilizing a technique of forming images by heat development as systems that can contribute to the environmental protection and simplify image-forming means.

In recent years, reduction of amount of waste processing solutions is strongly desired in the field of photomechanical processes from the standpoints of environmental protection and space savings. Therefore, development of techniques relating to thermally processed image recording materials for photomechanical processes is required, which materials enable efficient exposure by a laser scanner or laser image setter and formation of clear black images having high resolution and sharpness. Such thermally processed image recording materials can provide users with simpler and non-polluting heat development processing systems that eliminate the use of solution-type processing chemicals.

Methods for forming images by heat development are described in, for example, U.S. Pat. Nos. 3,152,904 and 3,457,075 and D. Klosterboer, "Thermally Processed Silver Systems A", Imaging Processes and Materials, Neblette, 8th ed., compiled by J. Sturge, V. Walworth and A. Shepp, Chapter 9, p.279, (1989). Such thermally processed image recording materials comprise a reducible non-photosensitive silver source (e.g., silver salt of an organic acid), a photocatalyst (e.g., silver halide) in a catalytically active amount and a reducing agent for silver, which are usually dispersed in an organic binder matrix. While the photosensitive materials are stable at an ordinary temperature, when they are heated to a high temperature (e.g., 80° C. or higher) after light exposure, silver is produced through an oxidation-reduction reaction between the reducible silver source (which functions as an oxidizing agent) and the reducing agent. The oxidation-reduction reaction is accelerated by catalytic action of a latent image generated upon exposure. The silver produced from the reaction of the reducible silver salt in the exposed areas shows black color and provides contrast with respect to the non-exposed areas, and thus images are formed.

Photosensitive materials for use in photomechanical processes are required to provide ultrahigh contrast images showing a γ value of 10 or more. In order to form images of ultrahigh contrast, an ultrahigh contrast agent, i.e., nucleating agent is required.

Various ultrahigh contrast agents are disclosed in U.S. Pat. Nos. 5,496,695, 5,545,515, 5,635,339, 5,654,130, 5,705,324, Japanese Patent Laid-open Publication (Kokai, hereinafter referred to as JP-A) No. 11-119372, JP-A-11-109546, JP-A-11-231459 and so forth. However, photosensitive materials using the aforementioned ultrahigh contrast agents suffer from a problem that satisfactory levels are not achieved in those materials for all of Dmin, Dmax, high contrast and storage stability as products under a high humidity condition, and their improvements have been desired. Further, there are no cases in which relationship between pKa value of an ultrahigh contrast agent and various performance items.

In view of these problems of the prior art, an object of the present invention is to provide a thermally processed image recording material suitable for photomechanical processes that shows low Dmin, high Dmax, ultrahigh contrast and γ value of 10 or more as well as superior storage stability.

SUMMARY OF THE INVENTION

As a result of the present inventors' assiduous investigations, they found that an excellent thermally processed image recording material that provides the desired effects could be obtained by adding a compound represented by the following formula (1), which had a pKa value within a particular range, to a thermally processed image recording material as an ultrahigh contrast agent, and thus accomplished the present invention.

The present invention provides a thermally processed image recording material having at least one image-forming layer on one side of a support, which contains, on the side of the support, a silver salt of an organic acid, a reducing agent and at least one kind of a compound represented by the following formula (1):

Formula (1)

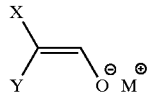

In the above formula, X and Y each independently represent an electron-withdrawing group and M represents a counter cation. The conjugate acid of the enolate anion in the formula (1) has a pKa value of 3.0–6.0.

In a preferred embodiment of the present invention, the material contains at least one kind of a compound represented by the following formula (A) having a molecular weight of 480 or more on the side of the support having the image-forming layer.

Formula (A)

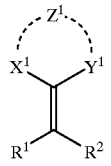

In the above formula, $R^1$ and $R^2$ each independently represent a hydrogen atom or a monovalent substituent, $X^1$ represents an oxygen atom, a sulfur atom or a nitrogen atom, $Y^1$ represents a group represented as —C(=O)—, —C(=S)—, —SO—, —$SO_2$—, —C(=$NR^3$)— or —($R^4$)C=N— where $R^3$ and $R^4$ each independently represent a hydrogen atom or a substituent, and $Z^1$ represents a non-metallic atomic group that can form a 5- to 7-membered ring together with $X^1$ and $Y^1$ However, $R^1$ and $R^2$ do not bind to each other to form a ring structure.

In another preferred embodiment of the present invention, the material contains a least one kind of a compound represented by the following formula (α) on the side of the support having the image-forming layer.

Formula (α)

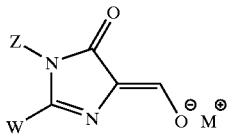

In the above formula, Z represents an alkyl group, an aryl group or a heterocyclic group, W represents an aryl group or an alkyl group substituted with an electron-withdrawing group, Z and W may bind to each other to form a ring structure, and M represents a counter cation.

DETAILED DESCRIPTION OF THE PREFERRED EMBODIMENTS

Figure 1:
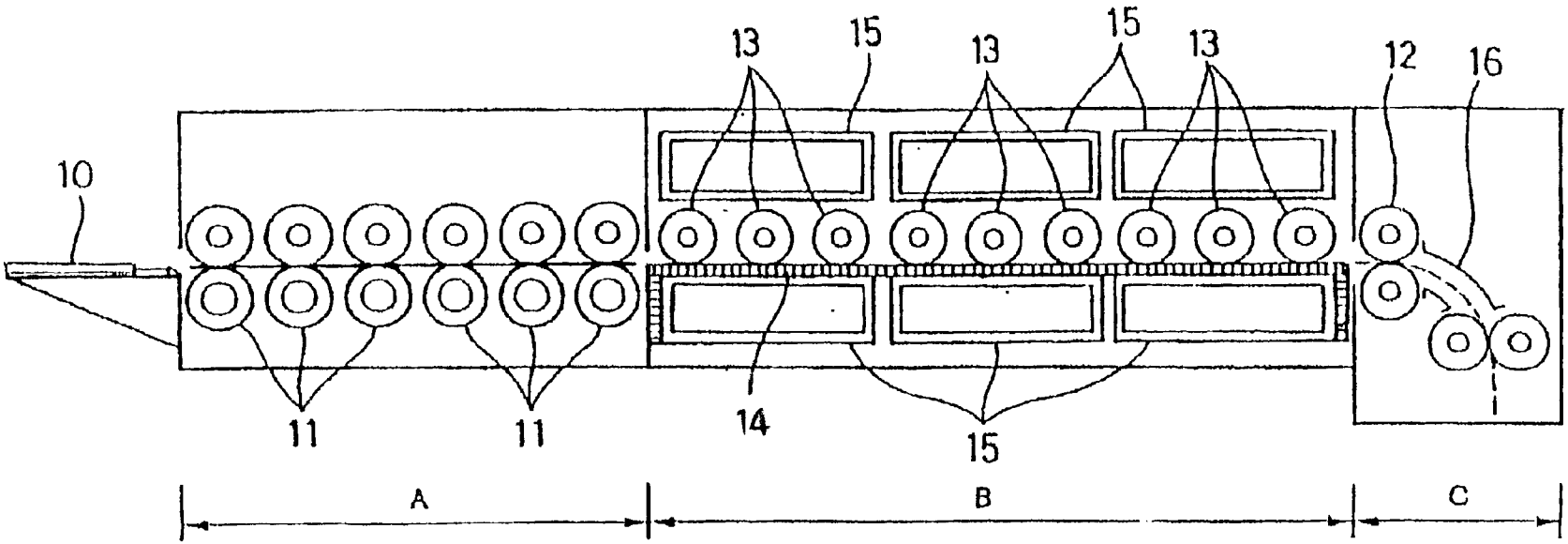
FIG. 1 is a side view of an exemplary heat developing apparatus suitably used for the thermally processed image recording material of the present invention. In the figure, there are shown a thermally processed image recording material 10, carrying-in roller pairs 11, carrying-out roller pairs 12, rollers 13, a flat surface 14, heaters 15, and guide panels 16. The apparatus consists of a preheating section A, a heat development section B, and a gradual cooling section C.

The present invention will be explained in detail hereafter with respect to its embodiments and methods for practicing it In the present specification, ranges indicated with "-" mean ranges including the numerical values before and after "-" as the minimum and maximum values.

The thermally processed image recording material of the present invention is characterized by containing at least one kind of a compound represented by the formula (1).

The compound represented by the formula (1) will be explained first.

In the formula (1), X and Y each independently represent an electron-withdrawing group. The electron-withdrawing group is a substituent that can have a Hammett's substituent constant σp of a positive value, and specific examples thereof include a cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, a nitro group, a halogen atom, a perfluoroalkyl group, a perfluoroalkanamido group, a sulfonamido group, an acyl group, a formyl group, a phosphoryl group, a carboxyl group, a sulfo group (or a salt thereof), a heterocyclic group, an alkenyl group, an alkynyl group, an acyloxy group, an acylthio group, a sulfonyloxy group, an aryl group substituted with any one of the above-described electron-withdrawing groups and so forth. The heterocyclic group mentioned herein is an aromatic or non-aromatic saturated or unsaturated heterocyclic group, and examples thereof include a pyridyl group, a quinolyl group, a pyrazinyl group, a benzotriazolyl group, an imidazolyl group, a benzimidazolyl group, a hydantoin-1-yl group, a urazol-1-yl group, a succinimido group, a phthalimido group and so forth.

The electron-withdrawing group represented by X or Y in the formula (1) may preferably be a group having a total carbon atom number of 0–30 such as a cyano group, an alkoxycarbonyl group, an aryloxycarbonyl group, a carbamoyl group, a thiocarbonyl group, an imino group, an imino group substituted at N atom, a sulfamoyl group, an alkylsulfonyl group, an arylsulfonyl group, a nitro group, a perfluoroalkyl group, an acyl group, a phosphoryl group, an acyloxy group, an acylthio group and a phenyl group substituted with one or more arbitrary electron-withdrawing groups, more preferably a cyano group, an alkoxycarbonyl group, a carbamoyl group, a thiocarbamoyl group, an imino group, an imino group substituted at N atom, a sulfamoyl group, an alkylsulfonyl group, an arylsulfonyl group, an acyl group, a phosphoryl group, a trifluoromethyl group, or a phenyl group substituted with one or more arbitrary electron-withdrawing groups, particularly preferably a cyano group, an alkoxycarbonyl group, a carbamoyl group, an imino group, an imino group substituted at N atom, an alkylsulfonyl group, an arylsulfonyl group or an acyl group. The electron-withdrawing group represented by X or Y in the formula (1) may further have a substituent.

In the formula (1), X and Y preferably bind to each other to form a 5- to 7-membered carbon ring or heterocyclic ring. The cyclic structure formed in this case is more preferably a 5- or 6-membered heterocyclic ring, particularly preferably a 5-membered heterocyclic ring, and it has preferably 1–50 carbon atoms, more preferably 3–40 carbon atoms, in total.

Specific examples of the 5- to 7-membered cyclic structure formed by X and Y are, for example, indane-1,3-dione ring, pyrrolidine-2,4-dione ring, pyrazolidine-3,5-dione ring, oxazolidine-2,4-dione ring, 5-pyrazolone ring, imidazolidine-2,4-dione ring, thiazolidine-2,4-dione ring, oxolane-2,4-dione ring, thiolane-2,4-dione ring, 1,3-dioxane-4,6-dione ring, cyclohexane-1,3-dione ring, 1,2,3,4-tetrahydroquinoline-2,4-dione ring, cyclopentane-1,3-dione ring, isoxazolidine-3,5-dione ring, barbituric acid ring, 2,3-dihydrobenzofuran-3-one ring, pyrazolotriazole ring (e.g., 7H-pyrazolo[1,5-b][1,2,4]triazole, 7H-pyrazolo[5,1-c][1,2,4]triazole, 7H-pyrazolo[1,5-a]benzimidazole etc.), pyrrolotriazole ring (e.g., 5H-pyrrolo[1,2-b][1,2,4]triazole, 5H-pyrrolo[2,1-c][1,2,4]triazole etc.), 2-cyclopentene-1,4-dione ring, 2,3-dihydrobenzothiophen-3-one-1,1-dioxide ring, chroman-2,4-dione ring, 2-oxazolin-5-one ring, 2-imidazolin-5-one ring, 2-thiazolin-5-one ring, 1-pyrrolin-4-one ring, 5-oxothiazolidin-2-one ring, 4-oxothiazolidin-2-one ring, 1,3-dithiolane ring, thiazolidine ring, 1,3-dithietane ring, 1,3-dioxolane ring and so forth. Among these, preferred are indane-1,3-dione ring, pyrrolidine-2,4-dione ring, pyrazolidine-3,5-dione ring, 5-pyrazolone ring, barbituric acid ring, 2-oxazolin-5-one ring, 2-imidazolin-5-one ring and so forth, and particularly preferred is 2-imidazolin-5-one ring.

In the formula (1), M represents a counter cation. Examples thereof include, for example, a hydrogen ion, a metal ion (e.g., Na, K, Ca, Mg, Zn, Ag ions etc.), an ammonium ion (e.g., $NH_4$, tetramethylammonium, tetrabutylammonium, benzyltrimethylammonium ions etc.) and so forth. Preferably, it is a metal ion or an ammonium ion.

The conjugate acid of the enolate anion in the formula (1) has a pKa value of 3.0–6.0. If the pKa value is less than 3.0, ultrahigh contrast images cannot be obtained. On the other hand, if it exceeds 6.0, stability before light exposure and development is degraded. The pKa value defined herein is a value obtained by the acid/base titration method or the UV absorption method in a mixed solvent of THF/water=3/2.

The aforementioned pKa value is preferably 3.0–5.0, particularly preferably 3.2–3.7.

The compound represented by the formula (1) used in the present invention may be further incorporated with the groups described below. These groups may be incorporated at a substitutable position of the compound represented by the formula (1) or introduced as a part of W or Z.

The compound represented by the formula (1) used in the present invention may be incorporated with an adsorptive group capable of adsorbing to silver halide. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamido group, a mercaptoheterocyclic group and a triazole group. The adsorptive group to silver halide may be formed into a precursor. Examples of the precursor include the groups described in JP-A-2-285344.

The compound represented by the formula (1) used in the present invention may be incorporated with a ballast group or polymer commonly used in immobile photographic additives such as a coupler. Those incorporated with a ballast group are particularly preferred for the present invention. The ballast group is a group having 8 or more carbon atoms and being relatively inactive to the photographic properties. Examples of the ballast group include an alkyl group, an aralkyl group, an alkoxy group, a phenyl group, an alkylphenyl group, a phenoxy group, an alkylphenoxy group and so forth. Examples of the polymer include those described in JP-A-1-100530.

The compound represented by the formula (1) used in the present invention may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclyl)thio group, or a dissociable group capable of dissociation with a base (e.g., carboxy group, sulfo group, acylsulfamoyl group, carbamoylsulfamoyl group etc.). In particular, those containing a group containing an ethyleneoxy group or a propyleneoxy group as a repeating unit or an (alkyl, aryl or heterocyclyl)thio group are preferred. Specific examples of these groups include those described in JP-A-7-234471, JP-A-5-333466, JP-A-6-19032, JP-A-6-19031, JP-A-5-45761, U.S. Pat. Nos. 4,994,365 and 4,988,604, JP-A-7-5610, JP-A-7-244348, German Patent No. 4,006,032 and so forth.

The compound represented by the formula (1) used in the present invention has a molecular weight of preferably 50–10000, more preferably 100–2000, particularly preferably 300–1000.

Specific examples of the compound represented by the formula (1) used in the present invention are shown below. However, the compounds that can be used for the present invention are not limited to the following compounds.

(A-1)

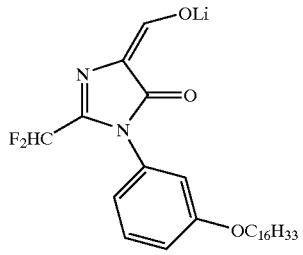

(A-2)

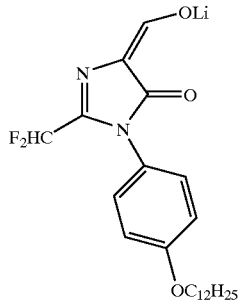

(A-3)

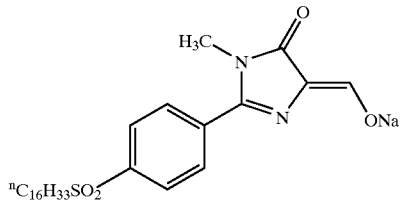

(A-4)

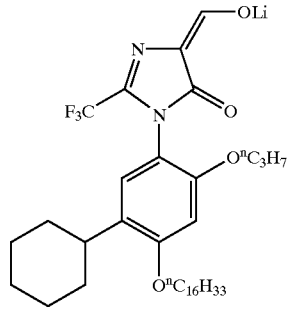

(A-5)

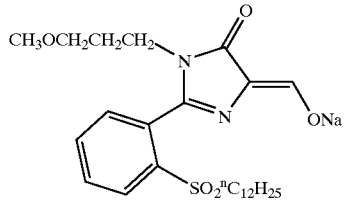

(A-6)

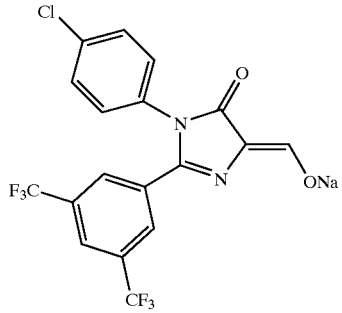

-continued
(A-7)
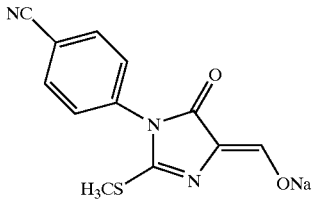
(A-8)
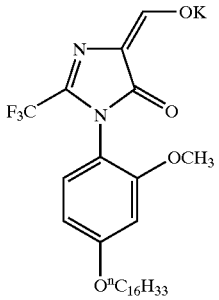
(A-9)
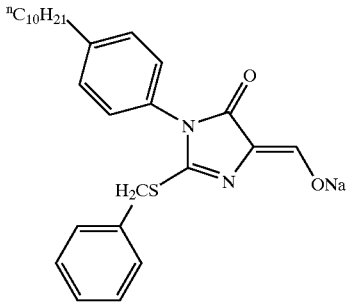
(A-10)
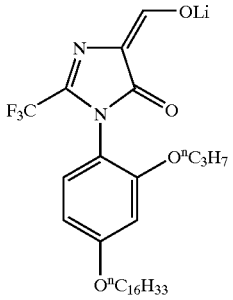
(A-11)
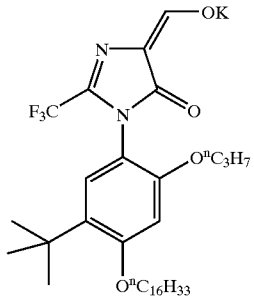
-continued
(A-12)
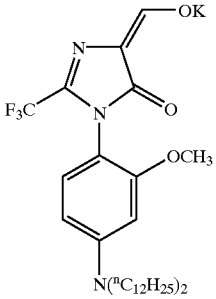
(A-13)
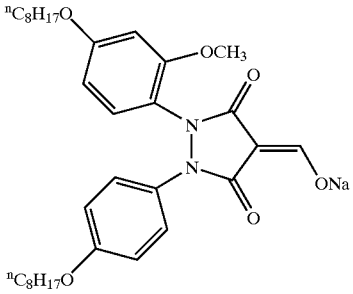
(A-14)
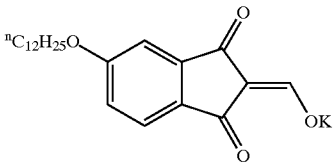
(A-15)
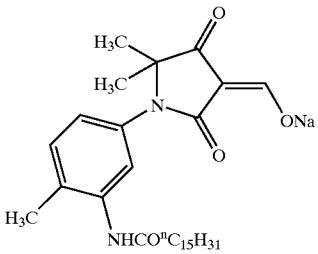
(A-16)
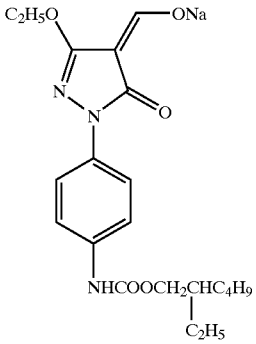

-continued (A-17)

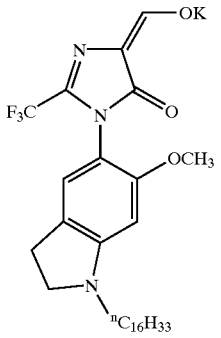

(A-18)

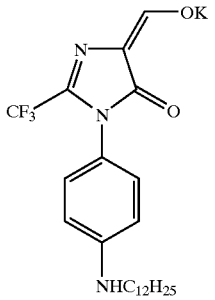

The compound of the formula (1) can be synthesized by a suitable combination of known synthesis methods. As for specific synthesis procedure, one can refer to the synthesis method of Exemplary Compound A-3 described later.

The compound of the formula (1) used in the present invention may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Alternatively, it may also be used as an emulsified dispersion mechanically prepared according to a known emulsification dispersion method by using an oil such as dibutyl phthalate, tricresyl phosphate, glyceryl triacetate or diethyl phthalate, ethyl acetate or cyclohexanone as an auxiliary solvent for dissolution. Or, it may be used after dispersion of powder of the compound in water by using a ball mill, colloid mill, sand grinder mill, MANTON GAULIN or microfluidizer, or by means of ultrasonic wave according to a known method for solid dispersion.

The compound of the formula (1) used for the present invention may be added to any layers on the same side of a support as the image-forming layer. However, it is preferably added to a layer containing the silver salt or a layer adjacent thereto.

The amount of the compound of the formula (1) used for the present invention is preferably from $1\times10^{-5}$ to 1 mole, more preferably from $1\times10^{-4}$ to $5\times10^{-1}$ mole, most preferably from $2\times10^{-4}$ to $2\times10^{-1}$ mole, per mole of silver.

The compound of the formula (1) used in the present invention may be used as a single kind of the compound or a combination of two or more kinds of the compounds.

The compound represented by the aforementioned formula (A) will be explained in detail hereafter.

In the above formula (A), $X^1$ represents an oxygen atom, a sulfur atom or a nitrogen atom. When $X^1$ is a nitrogen atom, the bond between $X^1$ and $Z^1$ may be a single bond or a double bond, and when it is a single bond, the nitrogen atom may have a hydrogen atom or an arbitrary substituent. Examples of the substituent include, for example, an alkyl group (including an aralkyl group, a cycloalkyl group, an active methine group etc.), an alkenyl group, an alkynyl group, an aryl group, a heterocyclic group, an acyl group, an alkoxycarbonyl group, an aryloxycarbonyl group, a carbamoyl group, an (alkyl, aryl or heterocyclyl)sulfonyl group and so forth.

In the aforementioned formula (A), $Y^1$ represents —C(=O)—, —C(=S)—, —SO—, —$SO_2$—, —C(=$NR^3$)— or —($R^4$)C=N—.

In the aforementioned formula (A), Z' represents a non-metallic atomic group that can form a 5- to 7-membered ring together with $X^1$ and $Y^1$. The atomic group that forms the ring is an atomic group consisting of 2–4 atoms other than metal atoms, and these atoms may be bound by a single bond or double bond. These atoms may have a hydrogen atom or an arbitrary substituent (e.g., an alkyl group, an aryl group, a heterocyclic group, an alkoxy group, an alkylthio group, an acyl group, an amino group, an alkenyl group). The 5- to 7-membered ring formed by $Z^1$ together with $X^1$ and $Y^1$ is a saturated or unsaturated heterocyclic ring, and this heterocyclic ring may be monocyclic ring or have a condensed ring. When $Y^1$ represents —C(=$NR^3$)— or —($R^4$)C=N—, the aforementioned condensed ring may be a ring that is formed by $R^3$ or $R^4$ bonded to a substituent of $Z^1$.

In the aforementioned formula (A), $R^1$, $R^2$, $R^3$ and $R^4$ each independently represent a hydrogen atom or a substituent. However, $R^1$ and $R^2$ do not bind to each other to form a ring structure.

For the cases where $R^1$ and $R^2$ represent a monovalent substituent, examples of the monovalent substituent include the following groups.

For example, they represent a hydroxy group or a salt thereof, an alkoxy group (e.g., methoxy group, ethoxy group, propoxy group, isopropoxy group, octyloxy group, dodecyloxy group, cetyloxy group, tert-butoxy group etc.), an aryloxy groups (e.g., phenoxy group, p-tert-pentylphenoxy group, p-tert-octylphenoxy group etc.), a heterocyclyloxy group (e.g., benzotriazolyl-5-oxy group, pyridinyl-3-oxy group etc.), a mercapto group or a salt thereof, an alkylthio group (e.g., methylthio group, ethylthio group, butylthio group, dodecylthio group etc.), an arylthio group (e.g., phenylthio group, p-dodecylphenylthio group etc.), a heterocyclylthio group (e.g., 1-phenyltetrazolyl-5-thio group, 2-methyl-1-phenyltriazolyl-5-thio group, mercaptothiadiazolylthio group etc.), an amino group, an alkylamino group (e.g., methylamino group, propylamino group, octylamino group, dimethylamino group etc.), an arylamino group (e.g., anilino group, naphthylamino group, o-methoxyanilino group etc.), a heterocyclylamino group (e.g., pyridylamino group, benzotriazol-5-ylamino group), an acylamino group (e.g., acetamido group, octanoylamino group, benzoylamino group etc.), a sulfonamido group (e.g., methanesulfonamido group, benzenesulfonamido group, dodecylsulfonamido group etc.), or a heterocyclic group.

The heterocyclic group referred to herein is an aromatic or non-aromatic, saturated or unsaturated, substituted or unsubstituted heterocyclic group having a single ring or condensed ring. Examples thereof include, for example, N-methylhydantoyl group, N-phenylhydantoyl group, succinimido group, phthalimido group, N,N'-dimethylurazolyl group, imidazolyl group, benzotriazolyl group, indazolyl group, morpholino group, 4,4-dimethyl-2,5-dioxo-oxazolyl group and so forth.

The salt herein referred to means a compound in which one or more dissociable hydrogen ions contained in an acid moiety are replaced with cations such as metal ions and ammonium ions.

For the cases where $R^3$ and $R^4$ represent a substituent, examples of the substituent include the following groups. $R^3$ and $R^4$ may further bind to $Z^1$ to form a condensed ring.

Examples thereof include, for example, an alkyl group (including an aralkyl group, a cycloalkyl group, an active methine group etc.), an alkenyl group, an alkynyl group, an aryl group, a heterocyclic group, a quaternized nitrogen-containing heterocyclic group (e.g., pyridinic group), an acyl group, an alkoxycarbonyl group, an aryloxycarbonyl group, a carbamoyl group, a carboxy group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group or a salt thereof, an alkoxy group (including a group containing an ethyleneoxy group or propyleneoxy group as a repeating unit), an aryloxy group, a heterocyclyloxy group, an acyloxy group, an (alkoxy or aryloxy) carbonyloxy group, a carbamoyloxy group, a sulfonyloxy group, an amino group, an (alkyl, aryl or heterocyclyl) amino group, an N-substituted nitrogein-containing heterocyclic group, an acylamino group, a sulfonamido group, a ureido group, a thioureido group, an imido group, an (alkoxy or aryloxy) carbonylamino group, a sulfamoylamino group, a semicarbazido group, a thiosemicarbazido group, a hydrazino group, a quaternary ammonio group, an oxamoylamino group, an (alkyl or aryl)sulfonylureido group, an acylureido group, an acylsulfamoylamino group, a nitro group, a mercapto group or a salt thereof, an (alkyl, aryl or heterocyclyl)thio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, a phosphoryl group, a group containing phosphoric acid amide or phosphoric acid ester structure, a silyl group, a stannyl group and so forth. These substituents may be further substituted with any of these monovalent substituents.

The compound represented by the aforementioned formula (A) may have a structure that contains two or more of partial structures represented by the aforementioned formula (A). For example, the substituent formed by $Z^1$, $X^1$ and $Y^1$ on the heterocyclic ring may have a partial structure represented by the aforementioned formula (A).

Hereafter, preferred compounds among the compounds represented by the formula (A) will be explained.

In the formula (A), the nonmetallic atomic group represented by $Z^1$ is preferably an atomic group consisting of 2–4 atoms selected from a carbon atom, a nitrogen atom, a sulfur atom and an oxygen atom, and more preferably it is an atomic group containing at least one carbon atom. The heterocyclic ring formed by $Z^1$ together with $X^1$ and $Y^1$ preferably contains 3–100 carbon atoms, more preferably 3–80 carbon atoms, most preferably 3–50 carbon atoms, in total (including those in substituents binding to the atoms constituting the heterocyclic ring).

In the aforementioned formula (A), $Y^1$ is preferably —C(=O)—, —C(=S)—, —$SO_2$— or —($R^4$)C=N—, more preferably —C(=O)—, —C(=S)— or —$SO_2$—, most preferably —C(=O)—.

When $R^1$ and $R^2$ represent a monovalent substituent in the aforementioned formula (A), the monovalent substituent represented by $R^1$ or $R^2$ is preferably a hydroxy group or a salt thereof, an alkoxy group, a mercapto group or a salt thereof, an alkylthio group, an arylthio group, a heterocyclylthio group, an amino group, a sulfonamido group or a heterocyclic group, more preferably a hydroxy group or a salt thereof, an alkoxy group, a mercapto group or a salt thereof, an alkylthio group, an amino group or a heterocyclic group, most preferably a hydroxy group or a salt thereof, an alkoxy group or a heterocyclic group. The substituent represented by $R^1$ or $R^2$ has preferably 0–50 carbon atoms, more preferably 0–30 carbon atoms, most preferably 0–20 carbon atoms, in total.

The salt referred to herein means a salt with an alkali metal (sodium, potassium, lithium) or an alkaline earth metal (magnesium, calcium), silver salt, zinc salt, quaternary ammonium salt (tetraethylammonium salt, tetra-N-heptylammonium salt, dimethylcetylbenzylammonium salt etc.), quaternary phosphonium salt or the like.

In the aforementioned formula (A), when $R^3$ represents a substituent, it is preferably a substituent having 1–50 carbon atoms in total such as an alkyl group (including an aralkyl group, a cycloalkyl group, an active methine group etc.), an alkenyl group, an aryl group, a heterocyclic group, a quaternized nitrogen-containing heterocyclic group (e.g., pyridinio group), an acyl group, an alkoxycarbonyl group, an aryloxycarbonyl group, a carbamoyl group, an (alkyl or aryl)sulfonyl group, an (alkyl or aryl) sulfinyl group, a sulfosulfamoyl group, an alkoxy group, an aryloxy group, a heterocyclyloxy group, an alkylthio group, an arylthio group, a heterocyclylthio group, an amino group or the like. Particularly preferred are an alkyl group and an aryl group.

In the aforementioned formula (A), when $R^4$ represents a substituent, it is preferably a substituent having 1–50 carbon atoms in total such as an alkyl group (including an aralkyl group, a cycloalkyl group, an active methane group etc.), an aryl group, a heterocyclic group, a quaternized nitrogen-containing heterocyclic group (e.g., pyridinio group), an acyl group, an alkoxycarbonyl group, an aryloxycarbonyl group, a carbamoyl group, an (alkyl or aryl)sulfonyl group, an (alkyl or aryl)sulfinyl group, a sulfosulfamoyl group, an alkoxy group, an aryloxy group, a heterocyclyloxy group, an alkylthio group, an arylthio group, a heterocyclylthio group or the like. Particularly preferred are an alkyl group, an aryl group, an alkoxy group, an aryloxy group, a heterocyclyloxy group, an alkylthio group, an arylthio group, a heterocyclylthio group and so forth.

When $Y^1$ represents —C($R^4$)=N—, the atom binding to the carbon atom substituted with $X^1$ and $Y^1$ is an atom in $Y^1$.

Among the compounds represented by the aforementioned formula (A), those compounds represented by the following formula (B) are preferred.

Formula (B)

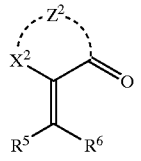

In the aforementioned formula (B), $X^2$ represents an oxygen atom, a nitrogen atom or a sulfur atom, and this is a group having the same meaning as $X^1$ in the formula (A). In the aforementioned formula (B), $R^5$ and $R^6$ are groups having the same meanings as $R^1$ and $R^2$ in the aforemen tioned formula (A), respectively. It is preferred that one of $R^5$ and $R^6$ represents a hydrogen atom, and the other represents a hydroxy group or a salt thereof, an alkoxy group or a heterocyclic group.

In the aforementioned formula (B), $Z^2$ represents a nonmetallic atomic group that can form a 5- to 7-membered ring together with $X^2$. The nonmetallic atomic group is an atomic group consisting of atoms selected from a carbon atom, an oxygen atom, a nitrogen atom and a sulfur atom and these atoms may bind to each other via a single bond or a double bond and may have a hydrogen atom or an arbitrary substituent. The 5- to 7-membered ring formed by $Z^2$ together with $X^2$ and the carbon atom of the carbonyl group is a saturated or unsaturated heterocyclic ring, and this heterocyclic ring may be monocyclic ring or have a condensed ring. The heterocyclic ring is preferably, in particular, a 5-membered ring. The heterocyclic ring preferably contains 3–100 carbon atoms, more preferably 3–80 carbon atoms, most preferably 3–50 carbon atoms, in total (including those in substituents binding to the atoms constituting the heterocyclic ring).

Specific examples of the compound represented by the formula (A) (Exemplary Compounds D-1 to D-49) are shown below. However, the present invention is not limited by the following specific examples.

(D-1)

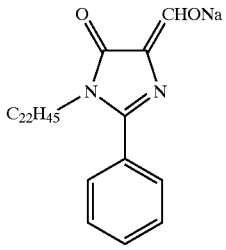

(D-2)

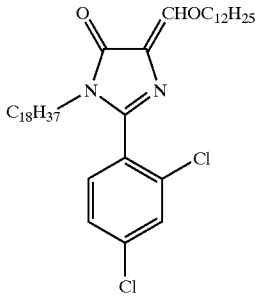

(D-3)

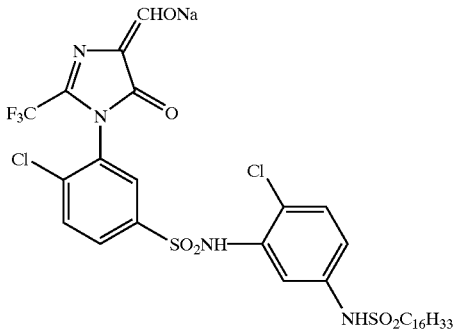

-continued (D-4)

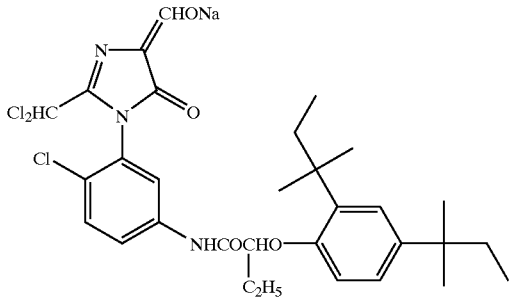

(D-5)

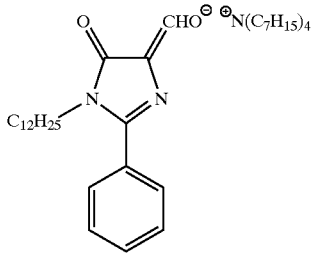

(D-6)

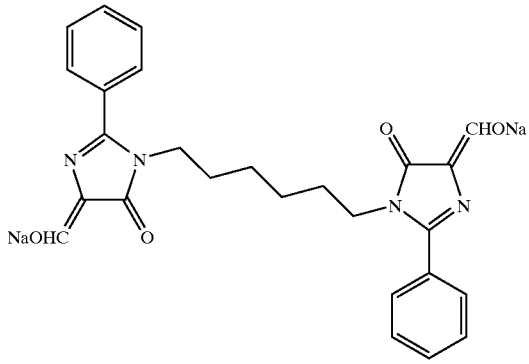

(D-7)

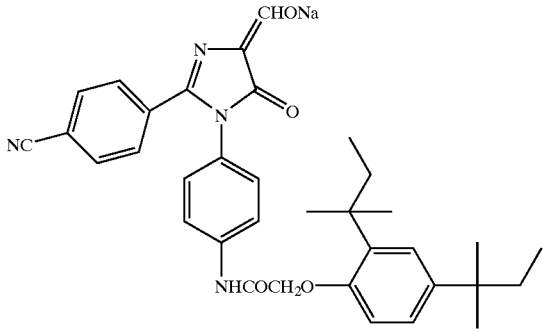

(D-8)

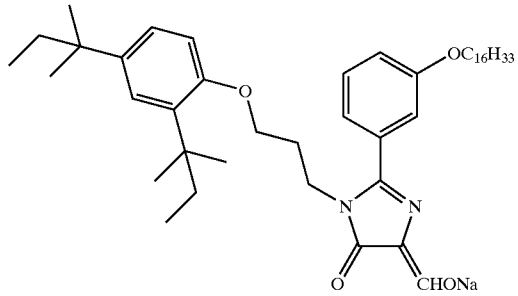

-continued
(D-9)
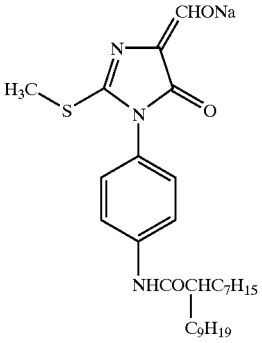
(D-10)
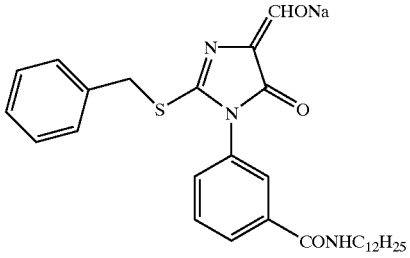
(D-11)
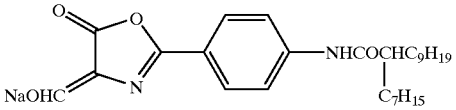
(D-12)
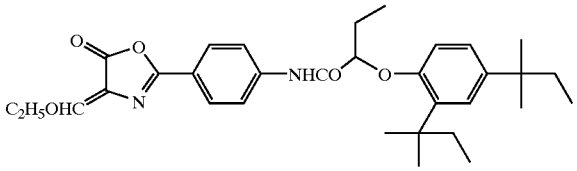
(D-13)
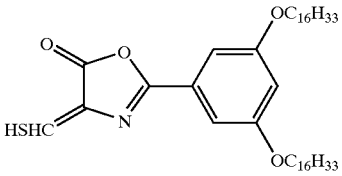
(D-14)
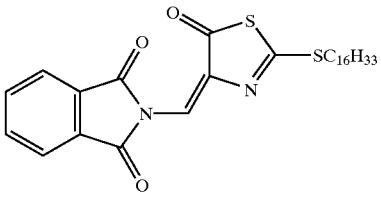
(D-15)
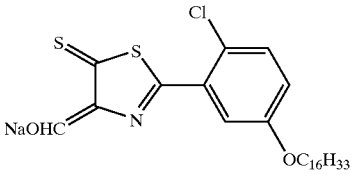
-continued
(D-16)
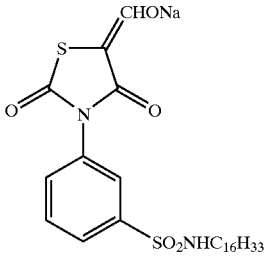
(D-17)
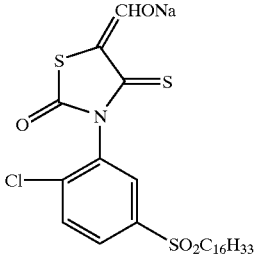
(D-18)
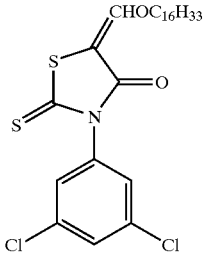
(D-19)
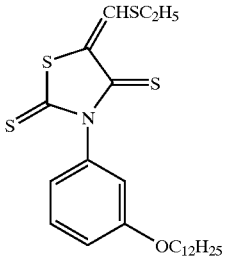
(D-20)
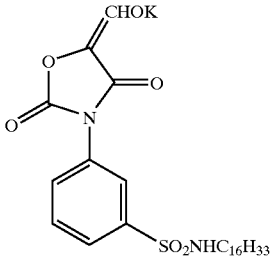
(D-21)
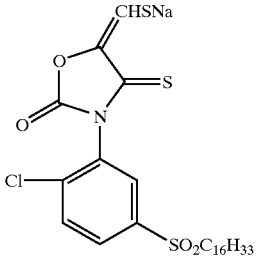

-continued
(D-22)
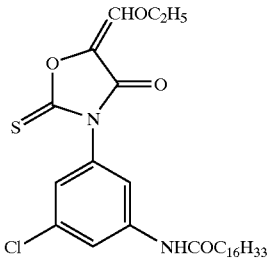
(D-23)
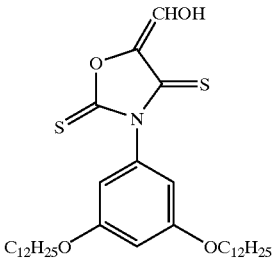
D-24
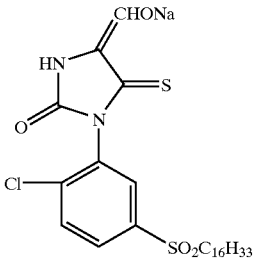
(D-25)
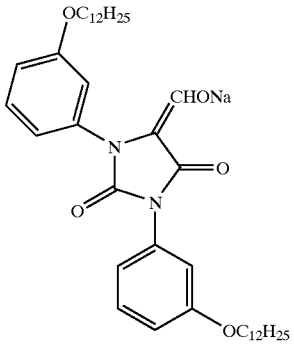
(D-26)
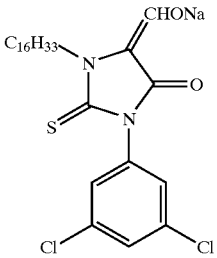
-continued
(D-27)
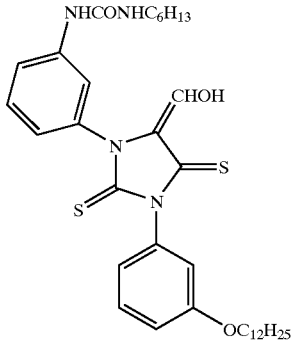
(D-28)
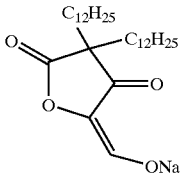
(D-29)
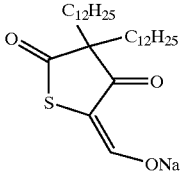
(D-30)
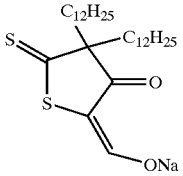
(D-31)
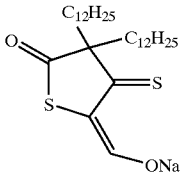
(D-32)
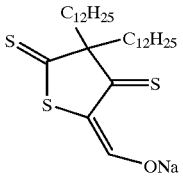
(D-33)
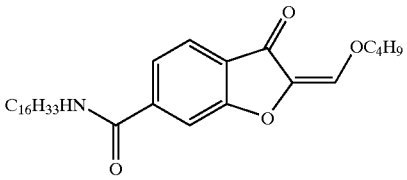
(D-34)
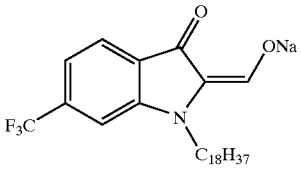

-continued
(D-35)
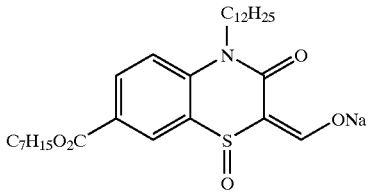
(D-36)
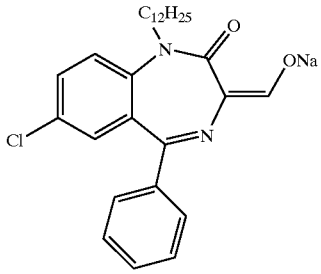
(D-37)
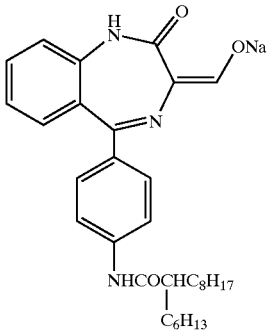
(D-38)
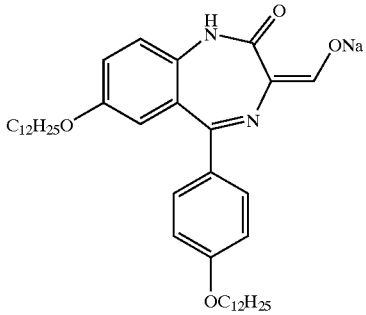
(D-39)
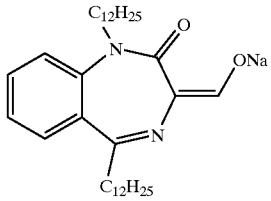
-continued
(D-40)
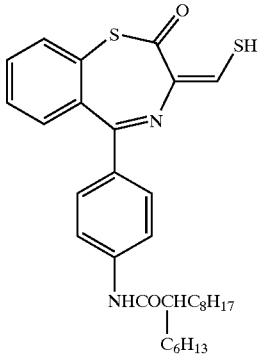
(D-41)
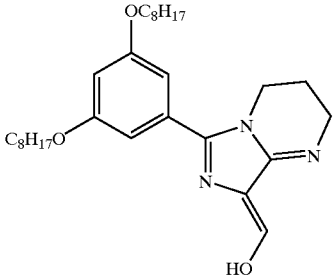
(D-42)
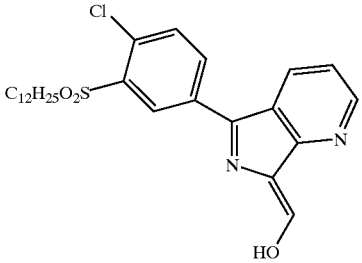
(D-43)
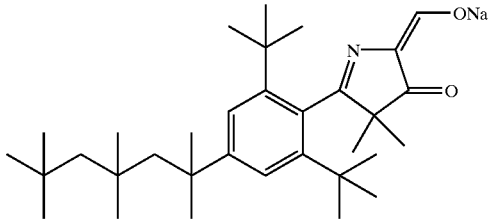
(D-44)
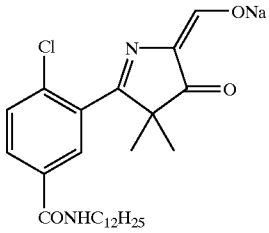

-continued (D-45)

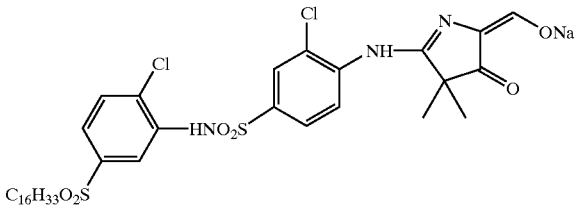

The compound represented by the aforementioned formula (A) can readily be synthesized according to known methods. For example, an active methylene intermediate can be synthesized, subsequently converted into a dimethylaminomethylene compound by the known Vilsmeier reaction or an action of N,N-dimethylformamide dimethylacetal, and then hydrolyzed with an alkaline to synthesize a compound of the formula (A). The active methylene intermediate can be readily synthesized by the method described in Tetrahedron, 45 (20), 6375–86 (1989).

In the present invention, the compound represented by the aforementioned formula (A) having a molecular weight of 480 or more is used. If the molecular weight is less than 480, humidity dependency during development tends to become significant, and sensitivity and Dmax tend to be degraded. While the upper limit of the molecular weight may not be particularly defined, in general, it is preferably 3000 or less, more preferably 2000 or less.

In the present invention, the compound represented by the formula (A) is contained on the side of the support having the image-forming layer. The compound represented by the formula (A) is preferably added to the image-forming layer or a layer adjacent thereto. The compound represented by the formula (A) may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve. Alternatively, it may also be used as an emulsified dispersion mechanically prepared according to a well-known emulsification dispersion method by using an oil such as dibutyl phthalate, tricresyl phosphate, glyceryl triacetate or diethyl phthalate, ethyl acetate or cyclohexanone as an auxiliary solvent for dissolution. Or, it may be used after dispersion of powder of the nucleating agent in a suitable solvent such as water by using a ball mill or colloid mill, or by means of ultrasonic wave according to a known method for solid dispersion.

The compound of the aforementioned formula (A) is contained in an amount of preferably from $1\times10^{-6}$ to 1 mole, more preferably from $1\times10^{-5}$ to $5\times10^{-1}$ mole, most preferably from $2\times10^{-5}$ to $2\times10^{-1}$ mole, per mole of silver contained in the image-forming layer.

The thermally processed image recording material of the present invention preferably contains at least one kind of the compound represented by the aforementioned formula (α) as an ultrahigh contrast agent. Hereafter, the compound of the formula (α) used in the present invention will be explained in detail.

In the formula (α), Z represents an alkyl group [a linear, branched or cyclic substituted or unsubstituted alkyl group including an alkyl group (preferably an alkyl group having 1–30 carbon atoms, e.g., methyl group, ethyl group, n-propyl group, isopropyl group, tert-butyl group, n-octyl group, eicosyl group, 2-chloroethyl group, 2-cyanoethyl group, 2-ethylhexyl group, trichloromethyl group and trifluoromethyl group), a cycloalkyl group (preferably a substituted or unsubstituted cycloalkyl group having 3–30 carbon atoms, e.g., cyclohexyl group, cyclopentyl group and 4-n-dodecylcyclohexyl group), a bicycloalkyl group (preferably a substituted or unsubstituted bicycloalkyl group having 5–30 carbon atoms, i.e., a monovalent group obtained by removing one hydrogen atom from a bicycloalkane having 5–30 carbon atoms, e.g., bicyclo[1,2,2]heptan-2-yl group and bicyclo[2,2,2]octan-3-yl group), and those having more rings such as those having a tricyclo structure]; an aryl group (preferably a substituted or unsubstituted aryl group having 6–30 carbon atoms, e.g., phenyl group, p-tolyl group, naphthyl group, m-chlorophenyl group, o-, m- or p-methanesulfonylphenyl group, 3,5-bistrifluoromethylphenyl group, o-hexadecanoylaminophenyl); or a heterocyclic group (preferably a 5- or 6-membered substituted or unsubstituted monovalent group obtained by removing one hydrogen atom from an aromatic or non-aromatic heterocyclic compound, more preferably a 5- or 6-membered aromatic heterocyclic group having 3–30 carbon atoms, e.g., 2-furyl group, 2-thienyl group, 2-pyrimidinyl group and 2-benzothiazolyl group).

Z is preferably an alkyl group or an aryl group, particularly preferably an aryl group.

Z may be further substituted with one or more other substituents. Examples of the substituents include a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxyl group, a nitro group, a carboxyl group, an alkoxy group, an aryloxy group, a silyloxy group, a heterocyclyloxy group, an acyloxy group, a carbamoyloxy group, an alkoxycarbonyloxy group, an aryloxycarbonyloxy, an amino group (including an anilino group), an acylamino group, an aminocarbonylamino group, an alkoxycarbonylamino group, an aryloxycarbonylamino group, a sulfamoylamino group, an alkyl- or arylsulfonylamino group, a mercapto group, an alkylthio group, an arylthio group, a heterocyclylthio group, a sulfamoyl group, a sulfo group, an alkyl- or arylsulfinyl group, an alkyl- or arylsulfonyl group, an acyl group, an aryloxycarbonyl group, an alkoxycarbonyl group, a carbamoyl group, an aryl- or heterocyclylazo group, an imido group, a phosphino group, a phosphinyl group, a phosphinyloxy group, a phosphinylamino group, a silyl group and so forth. Particularly preferred substituents are an alkyl group, an alkoxy group and an alkylamino group. Further, when two or more substituents exist, the substituents may bind to each other or one another to form a cyclic structure.

In the formula (α), W represents an aryl group or an alkyl group substituted with an electron-withdrawing group.

The aryl group represented by W has the same meaning as the aryl group explained for Z mentioned above. This aryl group may be further substituted with one or more other substituents, and examples of the substituents include those exemplified above as the substituents of Z.

The aryl group represented by W preferably has at least one electron-withdrawing group as a substituent. The electron-withdrawing group is a substituent that can have a Hammett's substituent constant σp of a positive value, and specific examples thereof include a cyano group, an alkoxycarbonyl group, an aryloxycarbonyl group, a carbamoyl group, an imino group, an imino group substituted at N atom, a thiocarbonyl group, a sulfamoyl group, an alkylsulfonyl group, an arylsulfonyl group, a nitro group, a halogen atom, a perfluoroalkyl group, a perfluoroalkanamido group, a sulfonamido group, an acyl group, a formyl group, a phosphoryl group, a carboxyl group, a sulfo group (or a salt thereof), a heterocyclic group, an alkenyl group, an alkynyl group, an acyloxy group, an acylthio group, a sulfonyloxy group and an aryl group substituted with any one of the above-described electron-withdrawing groups.

Although the alkyl group represented by W has the same meaning as the alkyl group explained for Z mentioned above, it must have at least one electron-withdrawing group as a substituent. The definition of the electron-withdrawing group is the same as described above.

W is preferably an alkyl group substituted with an electron-withdrawing group, more preferably an alkyl group substituted with one or more fluorine atoms, particularly preferably trifluoromethyl group. W may bind to Z to form a cyclic structure.

In the formula (α), M represents a counter cation. It is, for example, a hydrogen ion, a metal cation (e.g., Na, K, Ca, Mg, Zn, Ag ions etc.), an ammonium cation (e.g., $NH_4$, tetramethylammonium, tetrabutylammonium, benzyltrimethylammonium ions etc.) or the like. Preferably, it is a metal cation or an ammonium cation.

The compound represented by the formula (α) used in the present invention may be further incorporated with the groups described below. These groups may be incorporated at a substitutable position of the compound represented by the formula (α) or introduced as a part of W or Z.

The compound represented by the formula (α) used in the present invention may be incorporated with an adsorptive group capable of adsorbing to silver halide. Examples of the adsorptive group include the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246, such as an alkylthio group, an arylthio group, a thiourea group, a thioamido group, a mercaptoheterocyclic group and a triazole group. The adsorptive group to silver halide may be formed into a precursor. Examples of the precursor include the groups described in JP-A-2-285344.

The compound represented by the formula (α) used in the present invention may be incorporated with a ballast group or polymer commonly used in immobile photographic additives such as a coupler. Those incorporated with a ballast group are particularly preferred for the present invention. The ballast group is a group having 8 or more carbon atoms and being relatively inactive to the photographic properties. Examples of the ballast group include an alkyl group, an aralkyl group, an alkoxy group, a phenyl group, an alkylphenyl group, a phenoxy group, an alkylphenoxy group and so forth. Examples of the polymer include those described in JP-A-1-100530.

The compound represented by the formula (α) used in the present invention may contain a cationic group (specifically, a group containing a quaternary ammonio group or a nitrogen-containing heterocyclic group containing a quaternized nitrogen atom), a group containing an ethyleneoxy group or a propyleneoxy group as a repeating unit, an (alkyl, aryl or heterocyclyl)thio group, or a dissociable group capable of dissociation with a base (e.g., carboxy group, sulfo group, acylsulfamoyl group, carbamoylsulfamoyl group etc.). In particular, those containing a group containing an ethyleneoxy group or a propyleneoxy group as a repeating unit or an (alkyl, aryl or heterocyclyl)thio group are preferred. Specific examples of these groups include those described in JP-A-7-234471, JP-A-5-333466, JP-A-6-19032, JP-A-6-19031, JP-A-5-45761, U.S. Pat. Nos. 4,994,365 and 4,988,604, JP-A-7-5610, JP-A-7-244348, German Patent No. 4,006,032 and so forth.

The compound represented by the formula (α) used in the present invention has a molecular weight of preferably 50–10000, more preferably 100–2000, particularly preferably 300–1000.

Specific examples of the compound represented by the formula (α) used in the present invention are shown below. However, the compounds that can be used for the present invention are not limited to the following compounds.

(α-1)

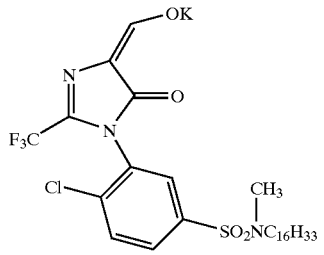

(α-2)

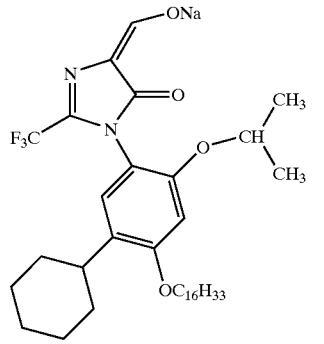

(α-3)

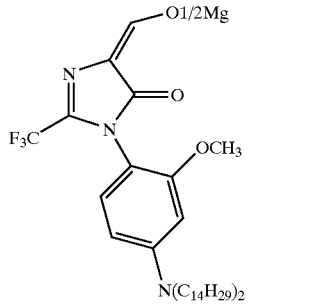

(α-4)

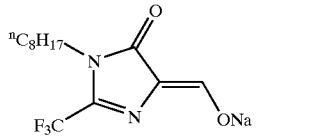

-continued
(α-5)
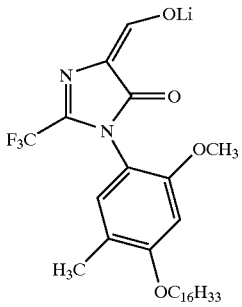
(α-6)
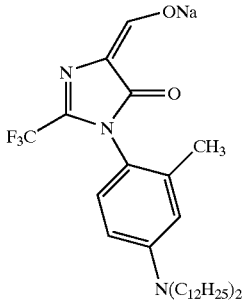
(α-7)
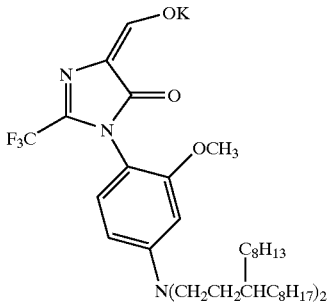
(α-8)
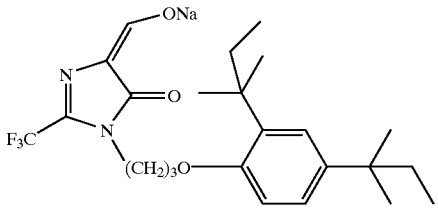
(α-9)
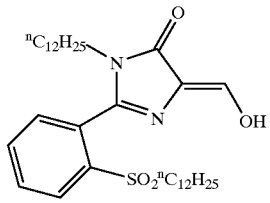
-continued
(α-10)
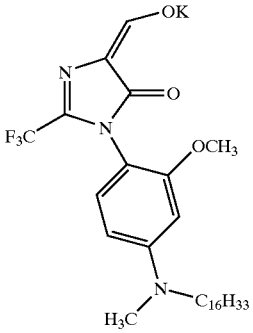
(α-11)
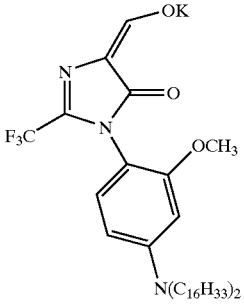
(α-12)
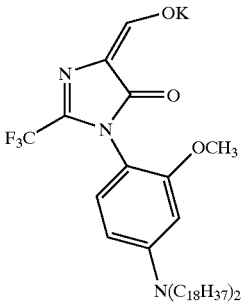
(α-13)
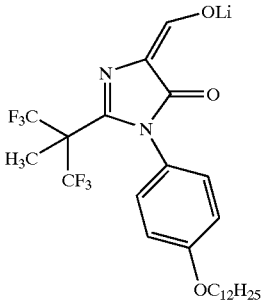
(α-14)
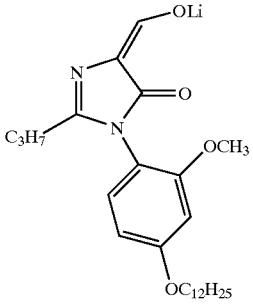

-continued
(α-15)
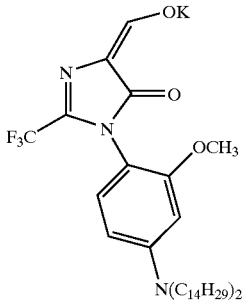
(α-16)
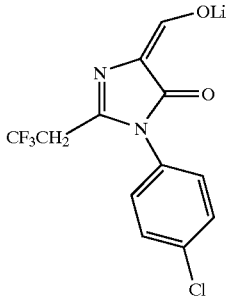
(α-17)
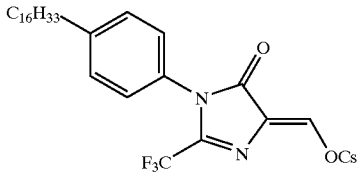
(α-18)
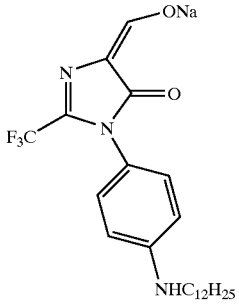
(α-19)
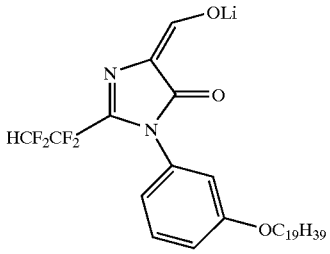
-continued
(α-20)
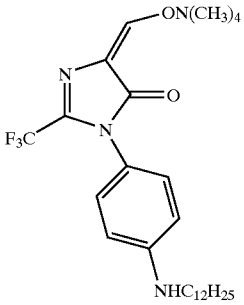
(α-21)
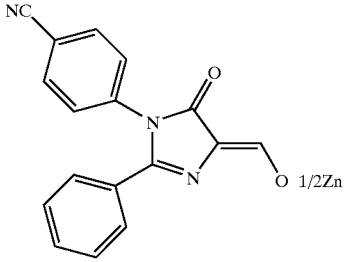
(α-22)
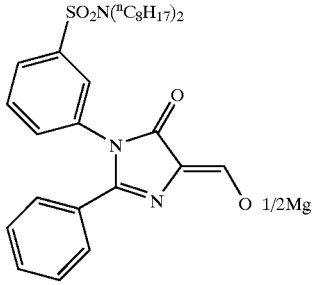
(α-23)
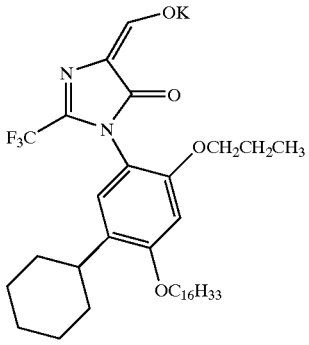
(α-24)
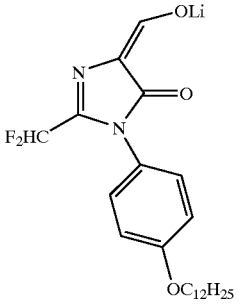

-continued
(α-25)
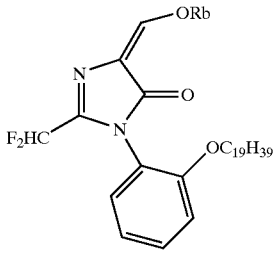
(α-26)
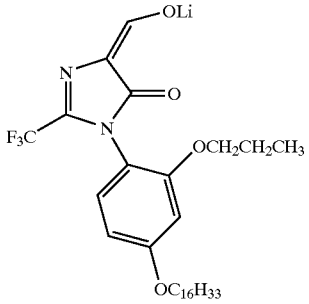
(α-27)
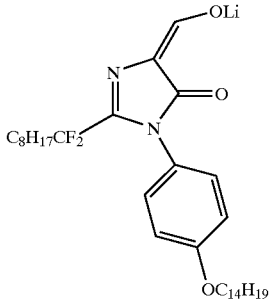
(a-28)
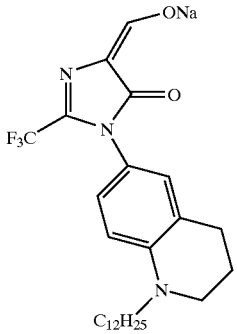
(a-29)
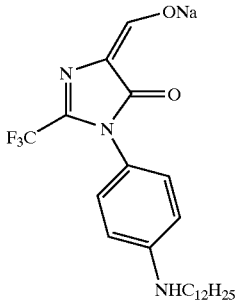
-continued
(a-30)
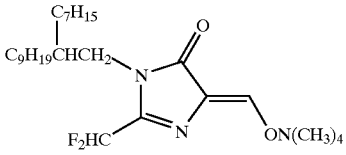
(a-31)
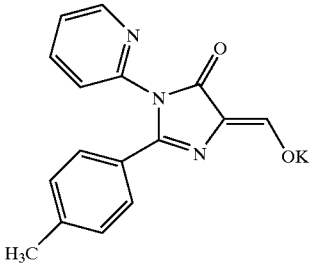
(a-32)
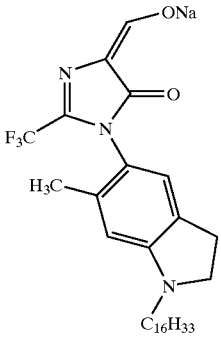
(a-33)
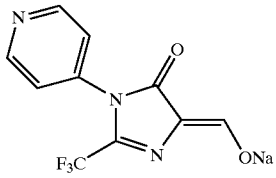
(α-34)
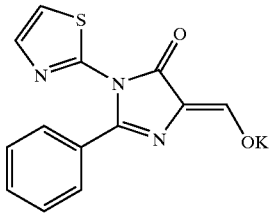
(α-35)
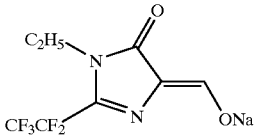
(α-36)
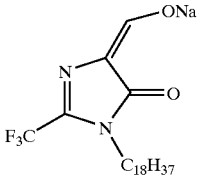

-continued
(α-37)
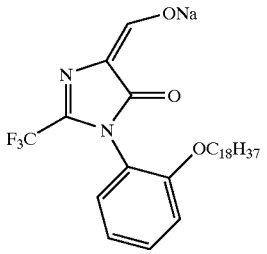
(α-38)
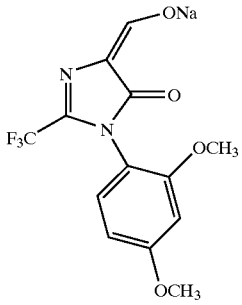
(α-39)
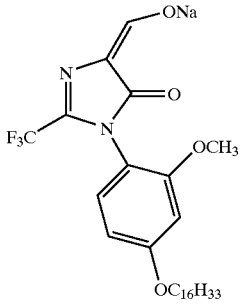
(a-40)
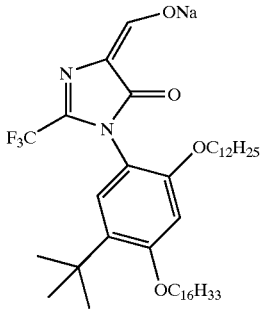
(a-41)
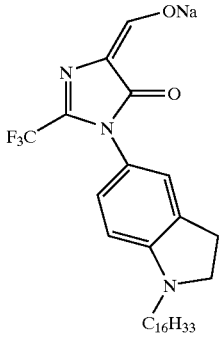
-continued
(a-42)
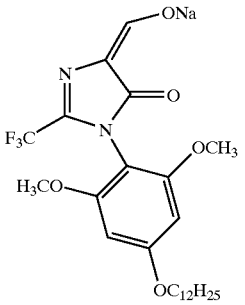
(a-43)
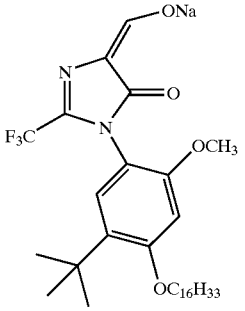
(a-44)
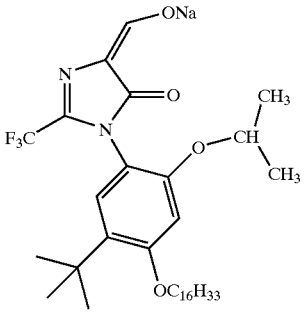
(α-45)
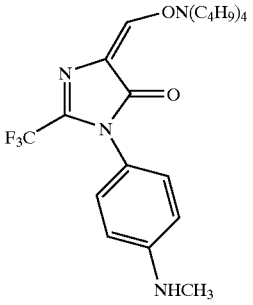
(α-46)
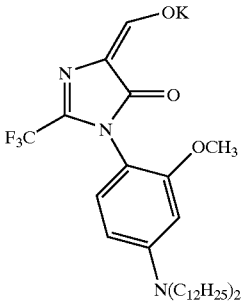

-continued (α-47)

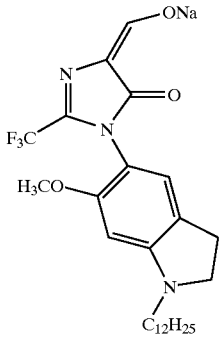

(α-48)

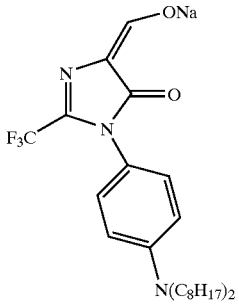

(α-49)

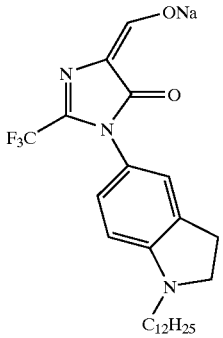

(α-50)

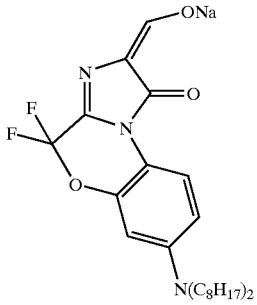

(α-51)

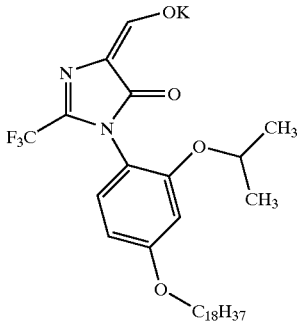

The compound of the formula (α) can be synthesized by a known method via a corresponding aniline derivative. As for specific synthesis procedure for synthesizing a compound of the formula (α) from a corresponding aniline derivative, one can refer to the synthesis example of Compound α-49 described later.

The compound of the formula (α) used in the present invention may be used after being dissolved in water or an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Alternatively, it may also be used as an emulsified dispersion mechanically prepared according to a known emulsification dispersion method by using an oil such as dibutyl phthalate, tricresyl phosphate, glyceryl triacetate or diethyl phthalate, ethyl acetate or cyclohexanone as an auxiliary solvent for dissolution. Or, it may be used after dispersion of powder of the compound in water by using a ball mill, colloid mill, sand grinder mill, MANTON GAULIN, or microfluidizer, or by means of ultrasonic wave according to a known method for solid dispersion.

The compound of the formula (α) used for the present invention may be added to any layers on the same side of a support as the image-forming layer. However, it is preferably added to a layer containing the silver salt or a layer adjacent thereto.

The amount of the compound of the formula (α) used for the present invention is preferably from $1\times10^{-5}$ to 1 mole, more preferably from $1\times10^{-4}$ to $5\times10^{-1}$ mole, most preferably from $2\times10^{-4}$ to $2\times10^{-1}$ mole, per mole of silver on the image-forming layer side.

The compound of the formula (α) used in the present invention may be used as a single kind of the compound or a combination of two or more kinds of the compounds.

Hereafter, there will be explained the other essential constituents (support, silver salt of an organic acid, reducing agent), arbitrary additives and so forth of the thermally processed image recording material of the present invention.

For the thermally processed image recording material of the present invention, various kinds of supports can be used. Typical supports are those of polyester such as polyethylene terephthalate and polyethylene naphthalate, cellulose nitrate, cellulose ester, polyvinylacetal, syndiotactic polystyrene, polycarbonate, paper support of which both surfaces are coated with polyethylene and so forth. Among these, biaxially stretched polyester, especially polyethylene terephthalate (PET), is preferred in view of strength, dimensional stability, chemical resistance and so forth. The support preferably has a thickness of 90–180 μm as a base thickness except for the undercoat layers.

Preferably used as the support of the thermally processed image recording material of the present invention is a polyester film, in particular, polyethylene terephthalate film, subjected to a heat treatment within a temperature range of 130–185° C. in order to relax the internal distortion formed in the film during the biaxial stretching so that thermal shrinkage distortion occurring during the heat development should be eliminated. Such films are described in JP-A-10-48772, JP-A-10-10676, JP-A-10-10677, JP-A-11-65025 and JP-A-11-138648.

After such a heat treatment, the support preferably shows dimensional changes caused by heating at 120° C. for 30 seconds of −0.03% to +0.01% for the machine direction (MD) and 0 to 0.04% for the transverse direction (TD).

The thermally processed image recording material of the present invention preferably contains a photosensitive silver halide. The photosensitive silver halide used for the present invention is not particularly limited as for the halogen composition, and silver chloride, silver chlorobromide, silver bromide, silver iodobromide, silver chloroiodobromide and so forth may be used. As for the preparation of grains of the photosensitive silver halide emulsion, the grains can be prepared by the method described in JP-A-11-119374, paragraphs 0127-0224. However, the method is not particularly limited to this method.

Examples of the form of silver halide grains include a cubic form, octahedral form, tetradecahedral form, tabular form, spherical form, rod-like form, potato-like form and so forth. In particular, cubic grains and tabular grains are preferred for the present invention. As for the characteristics of the grain form such as aspect ratio and surface index of the grains, they may be similar to those described in JP-A-11-119374, paragraph 0225. Further, the halide composition may have a uniform distribution in the grains including an internal portion and surface portion, or the composition may change stepwise or continuously in the grains. Silver halide grains having a core/shell structure may also be preferably used. Core/shell grains having preferably a double to quintuple structure, more preferably a double to quadruple structure may be used. A technique for localizing silver bromide on surfaces of silver chloride or silver chlorobromide grains may also be preferably used.

As for the grain size distribution of the silver halide grains used in the present invention, the grains show monodispersion degree of 30% or less, preferably 1–20%, more preferably 5–15%. The monodispersion degree used herein is defined as a percentage (%) of a value obtained by dividing standard deviation of grain size with mean grain size (variation coefficient). The grain size of the silver halide grains is represented as a ridge length for cubic grains, or a diameter as circle of projected area for the other grains (octahedral grains, tetradecahedral grains, tabular grains and so forth) for convenience.

The photosensitive silver halide grains preferably contain a metal of Group VII or Group VIII in the periodic table of elements or a complex of such a metal. The metal or the center metal of the complex of a metal of Group VII or Group VIII of the periodic table is preferably rhodium, rhenium, ruthenium, osmium or iridium Particularly preferred metal complexes are $(NH_4)_3Rh(H_2O)Cl_5$, $K_2Ru(NO)Cl_5$, $K_3IrCl_6$ and $K_4Fe(CN)_6$. The metal complexes may be used each alone, or two or more complexes of the same or different metals may also be used in combination. The metal complex content is preferably from $1\times10^{-9}$ to $1\times10^{-3}$ mole, more preferably $1\times10^{-8}$ to $1\times10^{-4}$ mole, per mole of silver on the image-forming layer side. As for specific structures of metal complexes, metal complexes of the structures described in JP-A-7-225449 and so forth can be used. Types and addition methods of these heavy metals and complexes thereof are described in JP-A-11-119374, paragraphs 0227–0240.

The photosensitive silver halide grains may be desalted by washing methods with water known in the art, such as the noodle washing and flocculation. However, the grain may not be desalted in the present invention.

The photosensitive silver halide emulsions used for the present invention are preferably subjected to chemical sensitization. For the chemical sensitization, the method described in JP-A-11-119374, paragraphs 0242–0250 can preferably be used.

Silver halide emulsions used in the present invention may be added with thiosulfonic acid compounds by the method described in EP-A-293917.

As gelatin mixed with the photosensitive silver halide used in the present invention, low molecular weight gelatin is preferably used in order to maintain good dispersion state of the silver halide emulsion in a coating solution containing a silver salt of an organic acid. The low molecular weight gelatin has a molecular weight of 500–60,000, preferably 1,000–40,000. While such low molecular weight gelatin may be added during the formation of grains or dispersion operation after the desalting treatment, it is preferably added during dispersion operation after the desalting treatment. It is also possible to use ordinary gelatin (molecular weight of about 100,000) during the grain formation and use low molecular weight gelatin during dispersion operation after the desalting treatment.

While the concentration of dispersion medium may be 0.05–20 weight %, it is preferably in the range of 5–15 weight % in view of handling. As for type of gelatin, alkali-treated gelatin is usually used. Besides that, however, modified gelatin such as acid-treated gelatin and phthalated gelatin can also be used.

As the photosensitive silver halide emulsion used in the present invention, one kind of photosensitive silver halide emulsion may be used or two or more different emulsions (for example, those having different mean grain sizes, different halogen compositions, different crystal habits or those subjected to chemical sensitization under different conditions) may be used in combination.

The amount of the photosensitive silver halide per mole of the silver salt of an organic acid is preferably from 0.01–0.5 mole, more preferably from 0.02–0.3 mole, still more preferably from 0.03–0.25 mole. Methods and conditions for mixing photosensitive silver halide and silver salt of an organic acid, which are prepared separately, are not particularly limited so long as the effect of the present invention can be attained satisfactorily. Examples thereof include, for example, a method of mixing silver halide grains and silver salt of an organic acid after completion of respective preparations by using a high-speed stirring machine, ball mill, sand mill, colloid mill, vibrating mill, homogenizer or the like, or a method of preparing a silver salt of an organic acid with mixing a photosensitive silver halide after preparation at any time during the preparation of the silver salt of an organic acid. For the mixing of them, mixing two or more kinds of aqueous dispersions of the silver salt of an organic acid and two or more kinds of aqueous dispersions of the photosensitive silver salt is preferably used for controlling photographic properties.

In the present invention, a contrast accelerator may be used in combination for the formation of ultrahigh contrast images. For example, the amine compounds described in U.S. Pat. No. 5,545,505, specifically, AM-1 to AM-5; the hydroxamic acids described in U.S. Pat. No. 5,545,507, specifically, HA-1 to HA-11; the acrylonitriles described in U.S. Pat. No. 5,545,507, specifically, CN-1 to CN-13; the hydrazine compounds described in U.S. Pat. No. 5,558,983, specifically, CA-1 to CA-6; and the onium salts described in JP-A-9-297368, specifically, A-1 to A-42, B-1 to B-27 and C-1 to C-14, and so forth may be used.

Formic acid and formic acid salts serve as a strongly fogging substance in a thermally processed image recording material containing a non-photosensitive silver salt, a photosensitive silver halide and a binder. In the present invention, the thermally processed image recording material preferably contains formic acid or a formic acid salt on the side having an image-forming layer containing a photosensitive silver halide in an amount of 5 mmol or less, more preferably 1 mmol or less, per 1 mole of silver.

In the thermally processed image recording material the present invention, an acid formed by hydration of diphosphorus pentoxide or a salt thereof is preferably used together with the ultrahigh contrast agent that is a compound of the formula (1) Examples of the acid formed by hydration of diphosphorus pentoxide or a salt thereof include metaphosphoric acid (salt) pyrophosphoric acid (salt), orthophosphoric acid (salt), triphosphoric acid (salt), tetraphosphoric acid (salt), hexametaphosphoric acid (salt) and so forth. Particularly preferably used acids formed by hydration of diphosphorus pentoxide or salts thereof are orthophosphoric acid (salt) and hexametaphosphoric acid (salt). Specific examples of the salt are sodium orthophosphate, sodium dihydrogenorthophosphate, sodium hexametaphosphate, ammonium hexametaphosphate and so forth.

The acid formed by hydration of diphosphorus pentoxide or a salt thereof that can be preferably used in the present invention is added to the image-forming layer or a binder layer adjacent thereto in order to obtain the desired effect with a small amount of the acid or a salt thereof.

The acid formed by hydration of diphosphorus pentoxide or a salt thereof may be used in a desired amount (coated amount per $m^2$ of the image recording material) depending on the desired performance including sensitivity and fog. However, it can preferably be used in an amount of 0.1–500 $mg/m^2$, more preferably 0.5–100 $mg/m^2$.

A thermally processed image recording material usually contains a silver salt of an organic acid as a reducible silver salt. The silver salt of an organic acid that can be used in the present invention is a silver salt relatively stable against light, but forms a silver image when it is heated at 80° C. or higher in the presence of an exposed photocatalyst (e.g., a latent image of photosensitive silver halide) and a reducing agent. The silver salt of an organic acid may be any organic substance containing a source of reducible silver ions. Silver salts of an organic acid, in particular, silver salts of a long chained aliphatic carboxylic acid having 10–30, preferably 15–28 carbon atoms, are preferred. Complexes of organic or inorganic acid silver salts having a complex stability constant in the range of 4.0–10.0 are also preferred. The silver supplying substance can preferably constitute about 5–70 weight % of the image-forming layer. Preferred examples of the silver salt of an organic acid include silver salts of organic compounds having carboxyl group. Specifically, the silver salts of an organic acid may be silver salts of an aliphatic carboxylic acid and silver salts of an aromatic carboxylic acid, but not limited to these. Preferred examples of the silver salt of an aliphatic carboxylic acid include silver behenate, silver arachidinate, silver stearate, silver oleate, silver laurate, silver caproate, silver myristate, silver palmitate, silver maleate, silver fumarate, silver tartrate, silver linoleate, silver butyrate, silver camphorate, mixtures thereof and so forth.

In the present invention, there is preferably used silver salt of an organic acid having a silver behenate content of 75 mole % or more, more preferably silver salt of an organic acid having a silver behenate content of 85 mole % or more, among the aforementioned silver salts of an organic acid and mixtures of silver salts of an organic acid. The silver behenate content used herein means a molar percent of silver behenate with respect to silver salt of an organic acid to be used. As silver salts of an organic acid other than silver behenate contained in the silver salts of organic acid used for the present invention, the silver salts of an organic acid exemplified above can preferably be used.

Silver salts of an organic acid that can be preferably used in the present invention can be prepared by allowing a solution or suspension of an alkali metal salt (e.g., Na salts, K salts, Li salts) of the aforementioned organic acids to react with silver nitrate. As the preparation method, the method described in JP-A-2000-292882, paragraphs 0019–0021 can be used.

In the present invention, a method of preparing a silver salt of an organic acid by adding an aqueous solution of silver nitrate and a solution of alkali metal salt of an organic acid to a sealable means for mixing liquids can preferably be used. Specifically, the method described in Japanese Patent Application No. 11-203413 can be used.

In the present invention, a dispersing agent soluble in water can be added to the aqueous solution of silver nitrate and the solution of alkali metal salt of an organic acid or reaction mixture during the preparation of the silver salt of an organic acid. Type and amount of the dispersing agent used in this case are specifically mentioned in JP-A-2000-305214, paragraph 0052.

The silver salt of an organic acid for use in the present invention is preferably prepared in the presence of a tertiary alcohol. The tertiary alcohol preferably has a total carbon number of 15 or less, more preferably 10 or less. Examples of preferred tertiary alcohols include tert-butanol. However, tertiary alcohol that can be used for the present invention is not limited to it.

The tertiary alcohol for use in the present invention may be added in any timing during the preparation of the organic acid silver salt, but the tertiary alcohol is preferably used by adding at the time of preparation of the organic acid alkali metal salt to dissolve the organic alkali metal salt. The tertiary alcohol for use in the present invention may be added in any amount of from 0.01–10 in terms of the weight ratio to water used as a solvent at the preparation of the silver salt of an organic acid, but preferably added in an amount of from 0.03–1 in terms of weight ratio to water.

Although shape and size of the silver salt of an organic acid used for the present invention are not particularly limited, those mentioned in JP-A-2000-292882, paragraph 0024 can be preferably used. The shape of the organic acid silver salt can be determined from a transmission electron microscope image of organic silver salt dispersion. An example of the method for determining monodispesibility is a method comprising obtaining the standard deviation of a volume weight average diameter of the organic acid silver salt. The percentage of a value obtained by dividing the standard deviation by the volume weight average diameter (variation coefficient) is preferably 80% or less, more preferably 50% or less, particularly preferably 30% or less. As a measurement method, for example, the grain size can be determined by irradiating organic acid silver salt dispersed in a solution with a laser ray and determining an autocorrelation function for change of the fluctuation of the scattered light with time (volume weight average diameter). The mean grain size determined by this method is preferably from 0.05–10.0 $\mu$m, more preferably from 0.1–5.0 $\mu$m, further preferably from 0.1–2.0 $\mu$m, in solid microparticle dispersion.

The silver salt of an organic acid that is used in the present invention is preferably desalted. The desalting method is not particularly limited and any known methods may be used. Known filtration methods such as centrifugal filtration, suction filtration, ultrafiltration and flocculation washing with water by coagulation may be preferably used. As the method of ultrafiltration, the method described in JP-A-2000-305214 can be used.

For obtaining an organic acid silver salt solid dispersion having a high S/N ratio and a small grain size and being free from coagulation, there is preferably used a dispersion method comprising steps of converting an aqueous dispersion that contains a silver salt of an organic acid as an image-forming medium and contains substantially no photosensitive silver salt into a high-speed flow, and then releasing the pressure. As such a dispersion method, the method mentioned in JP-A-2000-292882, paragraphs 0027–0038 can be used.

The grain size distribution of the silver salt of an organic acid in a solid microparticle dispersion preferably corresponds to monodispersion. Specifically, the percentage of the value obtained by dividing the standard deviation of the volume weight average diameter by the volume weight average diameter (variation coefficient) is preferably 80% or less, more preferably 50% or less, particularly preferably 30% or less.

The organic acid silver salt grain solid dispersion used for the present invention consists at least of a silver salt of an organic acid and water. While the ratio of the silver salt of an organic acid and water is not particularly limited, the ratio of the silver salt of an organic acid is preferably in the range of 5–50 weight %, particularly preferably 10–30 weight %, with respect to the total weight. While it is preferred that the aforementioned dispersing agent should be used, it is preferably used in a minimum amount within a range suitable for minimizing the grain size, and it is preferably used in an amount of 0.5–30 weight %, particularly preferably 1–15 weight %, with respect to the silver salt of an organic acid.

The silver salt of an organic acid for use in the present invention may be used in any desired amount. However, it is preferably used in an amount of from 0.1–5 $g/m^2$, more preferably from 1–3 $g/m^2$, in terms of silver.

In the present invention, metal ions selected from Ca, Mg, Zn and Ag are preferably added to the non-photosensitive silver salt of an organic acid. The metal ions selected from Ca, Mg, Zn and Ag are preferably added to the non-photosensitive silver salt of an organic acid in the form of a water-soluble metal salt that is not a halide compound. Specifically, they are preferably added in the form of nitrate or sulfate. Addition of halide is not preferred, since it degrades image storability, i.e., so-called printing-out property, of the photosensitive material against light (indoor light, sun light etc.) after the development. Therefore, in the present invention, it is preferable to add the ions in the form of water-soluble metal salts, which are not the aforementioned halide compound.

The metal ions selected from Ca, Mg, Zn and Ag, which are preferably used in the present invention, may be added any time after the formation of non-photosensitive organic acid silver salt grains and immediately before the coating operation, for example, immediately after the formation of grains, before dispersion, after dispersion, before and after the formation of coating solution and so forth. They are preferably added after dispersion, and before or after the formation of coating solution.

In the present invention, the metal ions selected from Ca, Mg, Zn and Ag are preferably added in an amount of $10^{-3}$ to $10^{-1}$ mole, particularly $5\times10^{-3}$ to $5\times10^{-2}$ mole, per one mole of non-photosensitive silver salt of an organic acid.

The thermally processed image recording material of the present invention contains a reducing agent. The reducing agent used in the present invention may be any substance that reduces silver ion to metal silver, preferably such an organic substance. Conventional photographic developers such as phenidone, hydroquinone and catechol are useful, but a hindered phenol reducing agent is preferred. The reducing agent is preferably contained in an amount of from 5–50 mole %, more preferably from 10–40 mole %, per mole of silver on the side having the image-forming layer. The reducing agent may be added to any layer on the side having an image-forming layer. In the case of adding the reducing agent to a layer other than the image-forming layer, the reducing agent is preferably used in a slightly large amount of from 10–50 mole % per mole of silver. The reducing agent may also be a so-called precursor that is derived to effectively function only at the time of development.

For thermally processed image recording materials using silver salt of an organic acid, reducing agents of a wide range can be used. There can be used, for example, the reducing agents disclosed in JP-A-46-6074, JP-A-47-1238, JP-A-47-33621, JP-A-49-46427, JP-A-49-115540, JP-A-50-14334, JP-A-50-36110, JP-A-50-147711, JP-A-51-32632, JP-A-51-32324, JP-A-51-51933, JP-A-52-84727, JP-A-55-108654, JP-A-56-146133, JP-A-57-82828, JP-A-57-82829, JP-A-6-3793, U.S. Pat. Nos. 3,679,426, 3,751,252, 3,751,255, 3,761,270, 3,782,949, 3,839,048, 3,928,686 and 5,464,738, German Patent No. 2,321,328, EP-A-692732 and so forth. Examples thereof include amidoximes such as phenylamidoxime, 2-thienylamidoxime and p-phenoxyphenylamidoxime; azines such as 4-hydroxy-3,5-dimethoxybenzaldehyde azine; combinations of an aliphatic carboxylic acid arylhydrazide with ascorbic acid such as a combination of 2,2'-bis(hydroxymethyl)propionyl-β-phenylhydrazine with ascorbic acid; combinations of polyhydroxybenzene with hydroxylamine, reductone and/or hydrazine such as a combination of hydroquinone with bis(ethoxyethyl)hydroxylamine, piperidinohexose reductone or formyl-4-methylphenylhydrazine; hydroxamic acids such as phenylhydroxamic acid, p-hydroxyphenylhydroxamic acid and β-anilinehydroxamic acid; combinations of an azine with a sulfonamidophenol such as a combination of phenothiazine with 2,6-dichloro-4-benzenesulfonamidophenol; α-cyanophenylacetic acid derivatives such as ethyl-α-cyano-2-methylphenylacetate and ethyl-α-cyanophenylacetate; bis-β-naphthols such as 2,2'-dihydroxy-1,1'-binaphthyl, 6,6'-dibromo-2,2'-dihydroxy-1,1'-binaphthyl and bis(2-hydroxy-1-naphthyl) methane; combinations of a bis-β-naphthol with a 1,3-dihydroxybenzene derivative (e.g., 2,4-dihydroxybenzophenone, 2',4'-dihydroxyacetophenone); 5-pyrazolones such as 3-methyl-1-phenyl-5-pyrazolone; reductones such as dimethylaminohexose reductone, anhydrodihydroaminohexose reductone and anhydrodihydropiperidonehexose reductone; sulfonamidophenol reducing agents such as 2,6-dichloro-4-benzenesulfonamidophenol and p-benzenesulfonamidophenol; 2-phenylindane-1,3-diones etc.; chromans such as 2,2-dimethyl-7-tert-butyl-6-hydroxychroman; 1,4-dihydropyridines such as 2,6-dimethoxy-3,5-dicarboethoxy-1,4-dihydropyridine; bisphenols such as bis(2-hydroxy-3-t-butyl-5-methylphenyl)methane, 2,2-bis(4-hydroxy-3-methylphenyl) propane, 4,4-ethylidene-bis(2-tert-butyl-6-methylphenol), 1,1-bis(2-hydroxy-3,5-dimethylphenyl)-3,5,5-trimethylhexane and 2,2-bis(3,5-dimethyl-4-hydroxyphenyl)propane; ascorbic acid derivatives such as 1-ascorbyl palmitate and ascorbyl stearate; aldehydes and ketones such as benzyl and biacetyl; 3-pyrazolidone and a certain kind of indane-1,3-diones; and chromanols such as tocopherol. Particularly preferred reducing agents are bisphenols and chromanols.

The reducing agent used in the present invention may be added in any form of an aqueous solution, solution in an organic solvent, powder, solid microparticle dispersion, emulsion dispersion or the like. The solid microparticle dispersion is performed by using a known pulverizing means (e.g., ball mill, vibrating ball mill, sand mill, colloid mill, jet mill, roller mill). At the time of solid microparticle dispersion, a dispersion aid may also be used.

The thermally processed image recording material of the present invention has an image-forming layer containing a silver salt of an organic acid, a reducing agent and a photosensitive silver halide on a support, and at least one protective layer is preferably provided on the image-forming layer. Further, the thermally processed image recording material of the present invention preferably has at least one back layer on the side of the support opposite to the side of the image-forming layer (back surface), and polymer latex is used as binder of the image-forming layer, protective layer and back layer. The use of polymer latex for these layers enables coating with an aqueous system utilizing a solvent (dispersion medium) containing water as a main component. Not only this is advantageous for environment and cost, but also it makes it possible to provide thermally processed image recording materials that generate no wrinkle upon heat development. Further, by using a support subjected to a predetermined heat treatment, there are provided thermally processed image recording materials exhibiting little dimensional change in sizes before and after the heat development.

As the binder used for the present invention, the polymer latex explained below is preferably used.

Among image-forming layers containing a photosensitive silver halide in the thermally processed image recording material of the present invention, at least one layer is preferably an image-forming layer utilizing polymer latex to be explained below in an amount of 50 weight % or more with respect to the total amount of binder. The polymer latex may be used not only in the image-forming layer, but also in the protective layer, back layer or the like. When the thermally processed image recording material of the present invention is used for, in particular, printing use in which dimensional change causes problems, the polymer latex is preferably used also in a protective layer and a back layer. The term "polymer latex" used herein means a dispersion comprising hydrophobic water-insoluble polymer dispersed in a water-soluble dispersion medium as fine particles. The dispersed state may be one in which polymer is emulsified in a dispersion medium, one in which polymer underwent emulsion polymerization, emulsion dispersion, micelle dispersion, one in which polymer molecules having a hydrophilic portion are dispersed in molecular state or the like. Polymer latex used in the present invention is described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki and Keishi Kasahara, issued by Kobunshi Kanko Kai (1993); Soichi Muroi, "Gosei Latex no Kagaku (Chemistry of Synthetic Latex)", Kobunshi Kanko Kai (1970) and so forth. The dispersed particles preferably have a mean particle size of about 1–50000 nm, more preferably about 5–1000 nm. The particle size distribution of the dispersed particles is not particularly limited, and the particles may have either wide particle size distribution or monodispersed particle size distribution.

The polymer latex used in the present invention may be latex of the so-called core/shell type, which is different from ordinary polymer latex of a uniform structure. In this case, use of different glass transition temperatures of the core and shell may be preferred.

Preferred range of the glass transition temperature (Tg) of the polymer latex preferably used as the binder in the present invention varies for the protective layer, back layer and image-forming layer. As for the image-forming layer, the glass transition temperature is preferably −30–40° C. for accelerating diffusion of photographic elements during the heat development. Polymer latex used for the protective layer or back layer preferably has a glass transition temperature of 25–70° C., because these layers are brought into contact with various apparatuses.

The polymer latex used in the present invention preferably shows a minimum film forming temperature (MFT) of about −30–90° C., more preferably about 0–70° C. A film-forming aid may be added in order to control the minimum film forming temperature. The film-forming aid is also referred to as a plasticizer, and consists of an organic compound (usually an organic solvent) that lowers the minimum film forming temperature of the polymer latex. It is explained in, for example, the aforementioned Soichi Muroi, "Gosei Latex no Kagaku (Chemistry of Synthetic Latex)", Kobunshi Kanko Kai (1970).

Examples of polymer species used for the polymer latex used in the present invention include acrylic resins, polyvinyl acetate resins, polyester resins, polyurethane resins, rubber resins, polyvinyl chloride resins, polyvinylidene chloride resins and polyolefin resins, copolymers of monomers constituting these resins and so forth. The polymers may be linear, branched or crosslinked. They may be so-called homopolymers in which a single kind of monomer is polymerized, or copolymers in which two or more different kinds of monomers are polymerized. The copolymers may be random copolymers or block copolymers. The polymers may have a number average molecular weight of about 5,000–1,000,000, preferably from 10,000–100,000. Polymers having a too small molecular weight may unfavorably suffer from insufficient mechanical strength of the image-forming layer, and those having a too large molecular weight may unfavorably suffer from bad film forming property.

Examples of the polymer latex used as the binder of the image-forming layer of the thermally processed image recording material of the present invention include latex of methyl methacrylate/ethyl acrylate/methacrylic acid copolymer, latex of methyl methacrylate/butadiene/itaconic acid copolymer, latex of ethyl acrylate/methacrylic acid copolymer, latex of methyl methacrylate/2-ethylhexyl acrylate/styrene/acrylic acid copolymer, latex of styrene/butadiene/acrylic acid copolymer, latex of styrene/butadiene/divinylbenzene/methacrylic acid copolymer, latex of methyl methacrylate/vinyl chloride/acrylic acid copolymer, latex of vinylidene chloride/ethyl acrylate/acrylonitrile/methacrylic acid copolymer and so forth. More specifically, there can be mentioned latex of methyl methacrylate (33.5 weight %)/ethyl acrylate (50 weight %)/methacrylic acid (16.5 weight %) copolymer, latex of methyl methacrylate (47.5 weight %)/butadiene (47.5 weight %)/itaconic acid (5 weight %) copolymer, latex of ethyl acrylate (95 weight %)/methacrylic acid (5 weight %) copolymer and so forth. Such polymers are also commercially available and examples thereof include acrylic resins such as CEBIAN A-4635, 46583, 4601 (all produced by Dicel Kagaku Kogyo Co., Ltd), Nipol Lx811, 814, 821, 820, 857 (all produced by Nippon Zeon Co., Ltd.), VONCORT R3340, R3360, R3370 and 4280 (all produced by Dai-Nippon Ink & Chemicals, Inc.); polyester resins such as FINETEX ES650, 611, 675, 850 (all produced by Dai-Nippon Ink & Chemicals, Inc.), WD-size and WMS (both produced by Eastman Chemical); polyurethane resins such as HYDRAN AP10, 20, 30 and 40 (all produced by Dai-Nippon Ink & Chemicals, Inc.); rubber resins such as LACSTAR 7310K, 3307B, 4700H, 7132C (all produced by Dai-Nippon Ink & Chemicals, Inc.), Nipol LX410, 430, 435 and 438C (all produced by Nippon Zeon Co., Ltd.); polyvinyl chloride resins such as G351 and G576 (both produced by Nippon Zeon Co., Ltd.); polyvinylidene chloride resins such as L502, L513 (both produced by Asahi Chemical Industry Co., Ltd.), ARON D7020, D504 and D5071 (all produced by Mitsui Toatsu Co., Ltd.); and olefin resins such as CHEMIPEARL S120 and SA100 (both produced by Mitsui Petrochemical Industries, Ltd.) and so forth. These polymers may be used individually or if desired, as a blend of two or more of them.

The image-forming layer preferably contains 50 weight % or more, more preferably 70 weight % or more of the aforementioned polymer latex based on the total binder.

If desired, the image-forming layer may contain a hydrophilic polymer in an amount of 50 weight % or less of the total binder, such as gelatin, polyvinyl alcohol, methylcellulose, hydroxypropylcellulose, carboxymethylcellulose and hydroxypropylmethylcellulose. The amount of the hydrophilic polymer is preferably 30 weight % or less, more preferably 15 weight % or less, of the total binder in the image-forming layer.

The image-forming layer is preferably formed by coating an aqueous coating solution and then drying the coating solution. The term "aqueous" as used herein means that water content of the solvent (dispersion medium) in the coating solution is 60 weight % or more. In the coating solution, the component other than water may be a water-miscible organic solvent such as methyl alcohol, ethyl alcohol, isopropyl alcohol, methyl cellosolve, ethyl cellosolve, dimethylformamide and ethyl acetate. Specific examples of the solvent composition include water/methanol=90/10, water/methanol=70/30, water/ethanol=90/10, water/isopropanol=90/10, water/dimethylformamide=95/5, water/methanol/dimethylformamide=80/15/5 and water/methanol/dimethylformamide=90/5/5 (the numerals indicate weight %).

The total amount of the binder in the image-forming layer is preferably from 0.2–30 g/m$^2$, more preferably from 1–15 g/m$^2$. The image-forming layer may contain a crosslinking agent for crosslinking, surfactant for improving coatability and so forth.

The total amount of the binders for the protective layer is preferably in the range of 0.2–10.0 g/m$^2$, more preferably 0.5–6.0 g/m$^2$.

The total amount of the binders for the back layer is preferably in the range of 0.01–10.0 g/m$^2$, more preferably 0.05–5.0 g/m$^2$.

Further, a combination of polymer latexes having different I/O values is also preferably used as the binder of the protective layer. The I/O values are obtained by dividing an inorganicity value with an organicity values, both of which values are based on the organic conceptual diagram described in Japanese Patent Application No. 11-6872, paragraphs 0025–0029.

In the present invention, a plasticizer (e.g., benzyl alcohol, 2,2,4-trimethylpentanediol-1,3-monoisobutyrate etc.) described in JP-A-2000-267226, paragraphs 0021–0025 can be added as required to control the film-forming temperature. Further, a hydrophilic polymer may be added to a polymer binder, and a water-miscible organic solvent may be added to a coating solution as described in Japanese Patent Application No. 11-6872, paragraphs 0027–0028.

First polymer latex introduced with functional groups, and a crosslinking agent and/or second polymer latex having a functional group that can react with the first polymer latex, which are described in JP-A-2000-19678, paragraphs 0023–0041, can also be added to each layer.

The aforementioned functional groups may be selected from carboxyl group, hydroxyl group, isocyanate group, epoxy group, N-methylol group, oxazolinyl group or the like. The crosslinking agent is selected from epoxy compounds, isocyanate compounds, blocked isocyanate compounds, methylol compounds, hydroxy compounds, carboxyl compounds, amino compounds, ethylene-imine compounds, aldehyde compounds, halogen compounds and so forth. Specific examples of the crosslinking agent include, as isocyanate compounds, hexamethylene isocyanate, Duranate WB40-80D, WX-1741 (Asahi Chemical Industry Co., Ltd.), Bayhydur 3100 (Sumitomo Bayer Urethane Co., Ltd.), Takenate WD725 (Takeda Chemical Industries, Ltd.), Aquanate 100, 200 (Nippon Polyurethane Industry Co., Ltd.), water dispersion type polyisocyanates mentioned in JP-A-9-160172; as an amino compound, Sumitex Resin M-3 (Sumitomo Chemical Co., Ltd.); as an epoxy compound, Denacol EX-614B (Nagase Chemicals Ltd.); as a halogen compound, 2,4-dichloro-6-hydroxy-1,3,5-triazine sodium salt and so forth.

Each of the image-forming layer, protective layer and back layer may be provided as two or more layers. When the image-forming layer consists of two or more layers, it is preferred that polymer latex should be used as a binder for all of the layers. The protective layer is a layer provided on the image-forming layer, and it may consist of two or more layers. In such a case, it is preferred that polymer latex should be used for at least one layer, especially the outermost protective layer. Further, the back layer is a layer provided on an undercoat layer for the back side of the support, and it may consist of two or more layers. In such a case, it is preferred that polymer latex should be used for at least one layer, especially the outermost back layer.

A lubricant referred to in the present specification means a compound which, when present at the surface of an object, reduces the friction coefficient of the surface compared with that observed when the compound is absent. The type of the lubricant is not particularly limited.

Examples of the lubricant that can be used in the present invention include the compounds described in JP-A-11-84573, paragraphs 0061–0064 and Japanese Patent Application No. 11-106881, paragraphs 0049–0062.

Preferred examples of the lubricant include Cellosol 524 (main component: carnauba wax), Polyron A, 393, H-481 (main component: polyethylene wax), Himicron G-110 (main component: ethylene bisstearic acid amide), Himicron G-270 (main component: stearic acid amide) (all produced by Chukyo Yushi Co., Ltd.), W-1: $C_{16}H_{33}$—O—$SO_3Na$ W-2: $C_{18}H_{37}$—O—$SO_3Na$ and so forth.

The amount of the lubricant used is 0.1–50 weight %, preferably 0.5–30 weight %, of the amount of binder in a layer to which the lubricant is added.

When such a development apparatus as disclosed in JP-A-2000-171935 or Japanese Patent Application No. 11-106881 is used for the heat development of the thermally processed image recording material of the present invention, in which a thermally processed image recording material is transported in a pre-heating section by facing rollers, and the material is transported in a heat development section by driving force of rollers facing the side of the material having the image-forming layer, while the opposite back surface slides on a smooth surface, ratio of friction coefficients of the outermost surface layer of the side of the thermally processed image recording material having the image-forming layer and the outermost surface layer of the back side is 1.5 or more at the heat development temperature. Although the ratio is not particularly limited as for its upper limit, it is preferably about 30 or less. The value of $\mu b$ is preferably 1.0 or less, more preferably 0.05–0.8. This value can be obtained in accordance with the following equation. Ratio of friction coefficients=coefficient of dynamic friction between roller material of heat development apparatus and surface of image-forming layer side ($\mu e$)/coefficient of dynamic friction between material of smooth surface member of heat development apparatus and back surface ($\mu b$)

In the present invention, the lubricity between the materials of the heat development apparatus and the outermost layers of the surface of image-forming layer side and/or the opposite back surface at the heat development temperature can be controlled by adding a lubricant to the outermost layers and adjusting its addition amount.

It is preferred that undercoat layers on the both sides of the support. The undercoat layers preferably contain a vinylidene chloride copolymer comprising 70 weight % or more of repetition units of vinylidene chloride monomers. Such vinylidene chloride copolymers are disclosed in JP-A-64-20544, JP-A-1-180537, JP-A-1-209443, JP-A-1-285939, JP-A-1-296243, JP-A-2-24649, JP-A-2-24648, JP-A-2-184844, JP-A-3-109545, JP-A-3-137637, JP-A-3-141346, JP-A-3-141347, JP-A-4-96055, U.S. Pat. No. 4,645,731, JP-A-4-68344, Japanese Patent No. 2,557,641, page 2, right column, line 20 to page 3, right column, line 30, JP-A-2000-39684, paragraphs 0020–0037, and Japanese Patent Application No. 11-106881, paragraphs 0063–0080.

If the vinylidene chloride monomer content is less than 70 weight %, sufficient moisture resistance cannot be obtained, and dimensional change with time after the heat development will become significant. The vinylidene chloride copolymer preferably contains repetition units of carboxyl group-containing vinyl monomers, besides the repetition units of vinylidene chloride monomer. A polymer consists solely of vinylidene chloride monomers crystallizes, and therefore it becomes difficult to form a uniform film when a moisture resistant layer is coated. Further, carboxyl group-containing vinyl monomers are indispensable for stabilizing the polymer. For these reasons, the repetition units of carboxyl group-containing vinyl monomers are added to the polymer.

The vinylidene chloride copolymer used in the present invention preferably has a molecular weight of 45,000 or less, more preferably 10,000–45,000, as a weight average molecular weight. When the molecular weight becomes large, adhesion between the vinylidene chloride copolymer layer and the support layer composed of polyester or the like tends to be degraded.

The content of the vinylidene chloride copolymer used in the present invention is such an amount that the undercoat layers should have a thickness of 0.3 $\mu$m or more, preferably 0.3 $\mu$m to 4 $\mu$m, as a total thickness of the undercoat layers containing the vinylidene chloride copolymer for one side.

The vinylidene chloride copolymer layer as an undercoat layer is preferably provided as a first undercoat layer, which is directly coated on the support, and usually one vinylidene chloride copolymer layer is provided for each side. However, two or more of layers may be provided as the case may be. When multiple layers consisting of two or more layers are provided, the total amount of the vinylidene chloride copolymer may be within the range of the present invention defined above.

Such an undercoat layer may contain a crosslinking agent, matting agent or the like, in addition to the vinylidene chloride copolymer.

The support may be coated with an undercoat layer comprising SBR, polyester, gelatin or the like as a binder, in addition to the vinylidene chloride copolymer layer, as required. These undercoat layers may have a multilayer structure, and may be provided on one side or both sides of the support. The undercoat layers generally have a thickness (per layer) of 0.01–5 $\mu$m, more preferably 0.05–1 $\mu$m.

When an additive known as a "toning agent" capable of improving images is added to the thermally processed image recording material of the present invention, the optical density increases in some cases. The toning agent may also be advantageous in forming a black silver image depending on the case. The toning agent is preferably contained in a layer on the side having the image-forming layer in an amount of from 0.1–50 mole %, more preferably from 0.5–20 mole %, per mole of silver. The toning agent may be a so-called precursor that is derived to effectively function only at the time of development.

For the thermally processed image recording material using a silver salt of an organic acid, toning agents of a wide range can be used. For example, there can be used toning agents disclosed in JP-A-46-6077, JP-A-47-10282, JP-A-49-5019, JP-A-49-5020, JP-A-49-91215, JP-A-50-2524, JP-A-50-32927, JP-A-50-67132, JP-A-50-67641, JP-A-50-114217, JP-A-51-3223, JP-A-51-27923, JP-A-52-14788, JP-A-52-99813, JP-A-53-1020, JP-A-53-76020, JP-A-54-156524, JP-A-54-156525, JP-A-61-183642, JP-A-4-56848, Japanese Patent Publication (Kokoku, hereinafter referred to as JP-B) 49-10727, JP-B-54-20333, U.S. Pat. Nos. 3,080,254, 3,446,648, 3,782,941, 4,123,282 and 4,510,236, British Patent No. 1,380,795, Belgian Patent No. 841,910 and so forth. Specific examples of the toning agent include phthalimide and N-hydroxyphthalimide; succinimide, pyrazolin-5-ones and cyclic imides such as quinazolinone, 3-phenyl-2-pyrazolin-5-one, 1-phenylurazole, quinazoline and 2,4-thiazolidinedione; naphthalimides such as N-hydroxy-1,8-naphthalimide; cobalt complexes such as cobalt hexaminetrifluoroacetate; mercaptanes such as 3-mercapto-1,2,4-triazole, 2,4-dimercaptopyrimidine, 3-mercapto-4,5-diphenyl-1,2,4-triazole and 2,5-dimercapto-1,3,4-thiadiazole; N-(aminomethyl)aryldicarboxyimides such as N,N-(dimethylaminomethyl)phthalimide and N,N-(dimethylaminomethyl)naphthalene-2,3-dicarboxyimide; blocked pyrazoles, isothiuronium derivatives and a certain kind of photobleaching agents such as N,N'-hexamethylenebis(1-carbamoyl-3,5-dimethylpyrazole), 1,8-(3,6-diazaoctane)bis(isothiuroniumtrifluoroacetate) and 2-(tribromomethylsulfonyl)benzothiazole; 3-ethyl-5-[(3-ethyl-2-benzothiazolinylidene)-1-methylethylidene]-2-thio-2,4-oxazolidinedione; phthalazinone, phthalazinone derivatives and metal salts thereof, such as 4-(1-naphthyl) phthalazinone, 6-chlorophthalazinone, 5,7-dimethyloxyphthalazinone and 2,3-dihydro-1,4-phthalazinedione; combinations of phthalazinone with a phthalic acid derivative (e.g., phthalic acid, 4-methylphthalic acid, 4-nitrophthalic acid, tetrachlorophthalic acid anhydride); phthalazine, phthalazine derivatives (e.g., 4-(1-naphthyl)phthalazine, 6-chlorophthalazine, 5,7-dimethoxyphthalazine, 6-isobutylphthalazine, 6-tertbutylphthalazine, 5,7-dimethylphthalazine, 2,3-dihydrophthalazine) and metal salts thereof; combinations of a phthalazine or derivative thereof and a phthalic acid derivative (e.g., phthalic acid, 4-methylphthalic acid, 4-nitrophthalic acid, tetrachlorophthalic acid anhydride); quinazolinedione, benzoxazine and naphthoxazine derivatives; rhodium complexes which function not only as a toning agent but also as a halide ion source for the formation of silver halide at the site, such as ammonium hexachlororhodate(III), rhodium bromide, rhodium nitrate and potassium hexachlororhodate(III); inorganic peroxides and persulfates such as ammonium disulfide peroxide and hydrogen peroxide; benzoxazine-2,4-diones such as 1,3-benzoxazin-2,4-dione, 8-methyl-1,3-benzoxazin-2,4-dione and 6-nitro-1,3-benzoxazin-2,4-dione; pyrimidines and asymmetric triazines such as 2,4-dihydroxpyrimidine and 2-hydroxy-4-aminopyrimidine; azauracil and tetraazapentalene derivatives such as 3,6-dimercapto-1,4-diphenyl-1H, 4H-2,3a,5,6a-tetraazapentalene and 1,4-di(o-chlorophenyl)-3,6-dimercapto-1H,4H-2,3a,5,6a-tetraazapentalene and so forth.

In the present invention, the phthalazine derivatives represented by the formula (F) mentioned in JP-A-2000-35631 are preferably used as the toning agent. Specifically, A-1 to A-10 mentioned in the same are preferably used.

The toning agent may be added in any form of a solution, powder, solid microparticle dispersion or the like. The solid microparticle dispersion is performed by using a known pulverization means (e.g., ball mill, vibrating ball mill, sand mill, colloid mill, jet mill, roller mill etc.). At the time of solid microparticle dispersion, a dispersion aid may also be used.

The thermally processed image recording material of the present invention preferably has a film surface pH of 6.0 or less, more preferably 5.5 or less, before heat development. While it is not particularly limited as for the lower limit, it is normally around 3 or higher.

For controlling the film surface pH, an organic acid such as phthalic acid derivatives or a nonvolatile acid such as sulfuric acid, and a volatile base such as ammonia are preferably used to lower the film surface pH. In particular, ammonia is preferred to achieve a low film surface pH, because it is highly volatile and therefore it can be removed before coating or heat development. A method for measuring the film surface pH is described in JP-A-2000-284399, paragraph 0123.

The silver halide emulsion and/or the silver salt of an organic acid for use in the thermally processed image recording material of the present invention can be further prevented from the production of additional fog or stabilized against the reduction in sensitivity during the stock storage, by an antifoggant, a stabilizer or a stabilizer precursor. Examples of suitable antifoggant, stabilizer and stabilizer precursor that can be used individually or in combination include thiazonium salts described in U.S. Pat. Nos. 2,131,038 and 2,694,716, azaindenes described in U.S. Pat. Nos. 2,886,437 and 2,444,605, mercury salts described in U.S. Pat. No. 2,728,663, urazoles described in U.S. Pat. No. 3,287,135, sulfocatechols described in U.S. Pat. No. 3,235,652, oximes, nitrons and nitroindazoles described in British Patent No. 623,448, polyvalent metal salts described in U.S. Pat. No. 2,839,405, thiuronium salts described in U.S. Pat. No. 3,220,839, palladium, platinum and gold salts described in U.S. Pat. Nos. 2,566,263 and 2,597,915, halogen-substituted organic compounds described in U.S. Pat. Nos. 4,108,665 and 4,442,202, triazines described in U.S. Pat. Nos. 4,128,557, 4,137,079, 4,138,365 and 4,459,350, phosphorus compounds described in U.S. Pat. No. 4,411,985 and so forth.

The thermally processed image recording material of the present invention may contain a benzoic acid compound for the purpose of achieving high sensitivity or preventing fog. The benzoic acid compound for use in the present invention may be any benzoic acid derivative, but preferred examples thereof include the compounds described in U.S. Pat. Nos. 4,784,939, 4,152,160, JP-A-9-329863, JP-A-9-329864, JP-A-9-281637 and so forth. The benzoic acid compound may be added to any layer of the thermally processed image recording material, but the layer to which the benzoic acid is added is preferably a layer on the side of the support having the image-forming layer, more preferably a layer containing a silver salt of an organic acid. The benzoic acid compound for may be added at any step during the preparation of the coating solution. In the case of adding the benzoic acid compound to a layer containing a silver salt of an organic acid, it may be added at any step from the preparation of the silver salt of an organic acid to the preparation of the coating solution, but it is preferably added in the period after the preparation of the silver salt of an organic acid and immediately before the coating. The benzoic acid compound may be added in any form such as powder, solution, and microparticle dispersion, or may be added as a solution containing a mixture of the benzoic acid compound with other additives such as a sensitizing dye, reducing agent and toning agent. The benzoic acid compound may be added in any amount. However, the addition amount thereof is preferably from $1\times10^{-6}$ to 2 mole, more preferably from $1\times10^{-3}$ to 0.5 mole, per mole of silver.

Although not essential for practicing the present invention, it is advantageous in some cases to add a mercury (II) salt as an antifoggant to the image-forming layer. Preferred mercury(II) salts for this purpose are mercury acetate and mercury bromide. The addition amount of mercury for use in the present invention is preferably from $1\times10^{-9}$ to $1\times10^{-3}$ mole, more preferably from $1\times10^{-8}$ to $1\times10^{-4}$ mole, per mole of coated silver.

The antifoggant that is particularly preferably used in the present invention is an organic halide, and examples thereof include the compounds described in JP-A-50-119624, JP-A-50-120328, JP-A-51-121332, JP-A-54-58022, JP-A-56-70543, JP-A-56-99335, JP-A-59-90842, JP-A-61-129642, JP-A-62-129845, JP-A-6-208191, JP-A-7-5621, JP-A-7-2781, JP-A-8-15809, JP-A-2000-112070, JP-A-2000-284410, Japanese Patent Application No. 11-205330 and U.S. Pat. Nos. 5,340,712, 5,369,000 and 5,464,737.

The hydrophilic organic halides represented by the formula (P) mentioned in JP-A-2000-284399 can be preferably used as the antifoggant. Specifically, the compounds (P-1) to (P-118) mentioned in the same are preferably used.

The amount of the organic halides is preferably $1\times10^{-5}$ to 2 moles, more preferably $5\times10^{-5}$ to 1 mole, further preferably $1\times10^{-4}$ to $5\times10^{-1}$ mole, in terms of molar amount per mole of silver. The organic halides may be used each alone, or two or more of them may be used in combination.

Further, the salicylic acid derivatives represented by the formula (Z) mentioned in JP-A-2000-284399 can be preferably used as the antifoggant. Specifically, the compounds (A-1) to (A-60) mentioned in the same are preferably used. The amount of the salicylic acid represented by the formula (Z) is preferably $1\times10^{-5}$ to $5\times10^{-1}$ mole, more preferably $5\times10^{-5}$ to $1\times10^{-1}$ mole, further preferably $1\times10^{-4}$ to $5\times10^{-2}$ mole, in terms of molar amount per mole of silver. The salicylic acid derivatives may be used each alone, or two or more of them may be used in combination.

As antifoggants used in the present invention, formalin scavengers are effective and preferred. Examples thereof include the compounds represented by the formula (S) and the exemplary compounds thereof (S-1) to (S-24) mentioned in JP-A-2000-221634.

The antifoggants used for the present invention may be used after being dissolved in an appropriate organic solvent such as alcohols (e.g., methanol, ethanol, propanol, fluorinated alcohol), ketones (e.g., acetone, methyl ethyl ketone), dimethylformamide, dimethyl sulfoxide or methyl cellosolve.

Further, they may also be used as an emulsion dispersion mechanically prepared according to an already well known emulsion dispersion method by using an oil such as dibutyl phthalate, tricresyl phosphate, glyceryl triacetate or diethyl phthalate, ethyl acetate or cyclohexanone as an auxiliary solvent for dissolution. Alternatively, they may be used by dispersing powder of them in a suitable solvent such as water using a ball mill, colloid mill, sand grinder mill, MANTON GAULIN, microfluidizer, or by means of ultrasonic wave according to a known method for solid dispersion.

While the antifoggants used in the present invention may be added to any layer on the image-forming layer side of the support, that is, the image-forming layer or another layer on that side, they are preferably added to the image-forming layer or a layer adjacent thereto. In case of a thermally processed image recording material, the image-forming layer is a layer containing a reducible silver salt (silver salt of an organic acid), preferably such an image-forming layer further containing a photosensitive silver halide.

The thermally processed image recording material of the present invention may contain a mercapto compound, disulfide compound or thione compound so as to control the development by inhibiting or accelerating the development or improve the storage stability before or after the development.

The mercapto compound used in the present invention may have any structure, but those represented by Ar—SM or Ar—S—S—Ar are preferred, wherein M is a hydrogen atom or an alkali metal atom, and Ar is an aromatic ring or condensed aromatic ring containing one or more nitrogen, sulfur, oxygen, selenium or tellurium atoms. The heteroaromatic ring is preferably selected from benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazolinone. The heteroaromatic ring may have a substituent selected from, for example, the group consisting of a halogen (e.g., Br, Cl), hydroxy, amino, carboxy, alkyl (e.g., alkyl having one or more carbon atoms, preferably from 1–4 carbon atoms), alkoxy (e.g., alkoxy having one or more carbon atoms, preferably from 1–4 carbon atoms) and aryl (which may have a substituent). Examples of the mercapto substituted heteroaromatic compound include 2-mercaptobenzimidazole, 2-mercaptobenzoxazole, 2-mercaptobenzothiazole, 2-mercapto-5-methylbenzimidazole, 6-ethoxy-2-mercaptobenzothiazole, 2,2'-dithiobis(benzothiazole), 3-mercapto-1,2,4-triazole, 4,5-diphenyl-2-imidazolethiol, 2-mercaptoimidazole, 1-ethyl-2-mercaptobenzimidazole, 2-mercaptoquinoline, 8-mercaptopurine, 2-mercapto-4(3H)-quinazolinone, 7-trifluoromethyl-4-quinolinethiol, 2,3,5,6-tetrachloro-4-pyridinethiol, 4-amino-6-hydroxy-2-mercaptopyrimidine monohydrate, 2-amino-5-mercapto-1,3,4-thiadiazole, 3-amino-5-mercapto-1,2,4-triazole, 4-hydroxy-2-mercaptopyrimidine, 2-mercaptopyrimidine, 4,6-diamino-2-mercaptopyrimidine, 2-mercapto-4-methyl-pyrimidine hydrochloride, 3-mercapto-5-phenyl-1,2,4-triazole, 1-phenyl-5-mercaptotetrazole, sodium 3-(5-mercaptotetrazole)benzenesulfonate, N-methyl-N'-{3-(5-mercaptotetrazolyl)phenyl}urea, 2-mercapto-4-phenyloxazole and so forth. However, the present invention is not limited to these.

The amount of the mercapto compound is preferably from 0.0001–1.0 mole, more preferably from 0.001–0.3 mole, per mole of silver in the image-forming layer.

The thermally processed image recording material of the present invention can be made antistatic using the conductive metal oxides and/or fluorinated surfactants disclosed in JP-A-11-84573, paragraphs 0040-0051 for the purposes of reducing adhesion of dusts, preventing generation of static marks, preventing transportation failure during the automatic transportation and so forth. As the conductive metal oxides, the conductive acicular tin oxide doped with antimony disclosed in U.S. Pat. No. 5,575,957 and JP-A-11-223901, paragraphs 0012–0020 and the fibrous tin oxide doped with antimony disclosed in JP-A-4-29134 can be preferably used.

The layer containing a metal oxide should show a surface specific resistance (surface resistivity) of $10^{12}$ Ω or less, preferably $10^{11}$ Ω or less, in an atmosphere at 25° C. and 20% of relative humidity. Such a resistivity provides good antistatic property. Although the surface resistivity is not particularly limited as for the lower limit, it is usually about $10^{7}$ Ω or higher.

The thermally processed image recording material of the present invention preferably has a Beck's smoothness of 2000 seconds or less, more preferably 10 seconds to 2000 seconds, as for at least one of the outermost surfaces of the image-forming layer side and the opposite side, preferably as for the both sides.

Beck's smoothness can be easily determined according to Japanese Industrial Standard (JIS) P8119, "Test Method for Smoothness of Paper and Paperboard by Beck Test Device" and TAPPI Standard Method T479.

Beck's smoothness of the outermost surfaces of the image-forming layer side and the opposite side of the thermally processed image recording material can be controlled by suitably selecting particle size and amount of matting agent to be contained in the layers constituting the surfaces as described in JP-A-11-84573, paragraphs 0052–0059.

In the present invention, water-soluble polymers are preferably used as a thickener for imparting coating property. The polymers may be either naturally occurring polymers or synthetic polymers, and types thereof are not particularly limited. Specifically, there are mentioned naturally occurring polymers such as starches (corn starch, starch etc.), seaweeds (agar, sodium arginate etc.), vegetable adhesive substances (gum arabic etc.), animal proteins (glue, casein, gelatin, egg white etc.) and adhesive fermentation products (pullulan, dextrin etc.), semi-synthetic polymers such as semi-synthetic starches (soluble starch, carboxyl starch, dextran etc.) and semi-synthetic celluloses (viscose, methylcellulose, ethylcellulose, carboxymethylcellulose, hydroxyethylcellulose, hydroxypropylcellulose, hydroxypropylmethylcellulose etc.), synthetic polymers (polyvinyl alcohol, polyacrylamide, polyvinylpyrrolidone, polyethylene glycol, polypropylene glycol, polyvinyl ether, polyethylene-imine, polystyrenesulfonic acid or styrenesulfonic acid copolymer, polyvinylslfinic acid or vinylslfinic acid copolymer, polyacrylic acid or acrylic acid copolymer, acrylic acid or acrylic acid copolymer, maleic acid copolymer, maleic acid monoester copolymer, polyacryloyl methylpropanesulfonate or acryloyl methylpropanesulfonate copolymer) and so forth.

Among these, water-soluble polymers preferably used are sodium arginate, gelatin, dextran, dextrin, methylcellulose, carboxymethylcellulose, hydroxyethylcellulose, hydroxypropylcellulose, polyvinyl alcohol, polyacrylamide, polyvinylpyrrolidone, polyethylene glycol, polypropylene glycol, polystyrenesulfonic acid or styrenesulfonic acid copolymer, polyacrylic acid or acrylic acid copolymer, maleic acid monoester copolymer, polyacryloylmethyl propanesulfonate or acryloylmethyl propanesulfonate copolymer, and they are particularly preferably used as a thickener.

Among these, particularly preferred thickeners are gelatin, dextran, methylcellulose, carboxymethylcellulose, hydroxyethylcellulose, polyvinyl alcohol, polyacrylamide, polyvinylpyrrolidone, polystyrenesulfonate or styrenesulfonate copolymer, polyacrylic acid or acrylic acid copolymer, maleic acid monoester copolymer and so forth. These compounds are described in detail in "Shin Suiyosei Polymer no Oyo to Shijo (Applications and Market of Water-soluble Polymers, New Edition)", CMC Shuppan, Inc., Ed. by Shinji Nagatomo, Nov. 4, 1988.

The amount of the water-soluble polymers used as a thickener is not particularly limited so long as viscosity is increased when they are added to a coating solution. Their concentration in the solution is generally 0.01–30 weight %, preferably 0.05–20 weight %, particularly preferably 0.1–10 weight %. Viscosity to be increased by the polymers is preferably 1–200 mPa.s, more preferably 5–100 mPa.s, as increased degree of viscosity compared with the initial viscosity. The viscosity is represented by values measured at 25° C. by using B type rotational viscometer. Upon addition to a coating solution or the like, it is generally desirable that the thickener is added as a solution diluted as far as possible. It is also desirable to perform the addition with sufficient stirring.

Surfactants used in the present invention will be described below. The surfactants used in the present invention are classified into dispersing agents, coating agents, wetting agents, antistatic agents, photographic property controlling agents and so forth depending on the purposes of use thereof, and the purposes can be attained by suitably selecting the surfactants described below and using them. As the surfactants used in the present invention, any of nonionic or ionic (anionic, cationic, betaine) surfactants can be used. Further, fluorinated surfactants can also be preferably used.

Preferred examples of the nonionic surfactant include surfactants having polyoxyethylene, polyoxypropylene, polyoxybutylene, polyglycidyl, sorbitan or the like as the nonionic hydrophilic group. Specifically, there can be mentioned polyoxyethylene alkyl ethers, polyoxyethylene alkyl phenyl ethers, polyoxyethylene/polyoxypropylene glycols, polyhydric alcohol aliphatic acid partial esters, polyoxyethylene polyhydric alcohol aliphatic acid partial esters, polyoxyethylene aliphatic acid esters, polyglycerin aliphatic acid esters, aliphatic acid diethanolamides, triethanolamine aliphatic acid partial esters and so forth.

Examples of anionic surfactants include carboxylic acid salts, sulfuric acid salts, sulfonic acid salts and phosphoric acid salts. Typical examples thereof are aliphatic acid salts, alkylbenzenesulfonates, alkylnaphthalenesulfonates, alkylsulfonates, α-olefinsulfonates, dialkylsulfosuccinates, α-sulfonated aliphatic acid salts, N-methyl-N-oleyltaurine, petroleum sulfonates, alkylsulfates, sulfated fats and oils, polyoxyethylene alkyl ether sulfates, polyoxyethylene alkyl phenyl ether sulfates, polyoxyethylene styrenylphenyl ether sulfates, alkyl phosphates, polyoxyethylene alkyl ether phosphates, naphthalenesulfonate formaldehyde condensates and so forth.

Examples of the cationic surfactants include amine salts, quaternary ammonium salts, pyridinium salts and so forth, and primary to tertiary aliphatic amine salts and quaternary ammonium salts (tetraalkylammonium salts, trialkylbenzylammonium salts, alkylpyridinium salts, alkylimidazolium salts etc.) can be mentioned.

Examples of the betaine type surfactants include carboxybetaine, sulfobetaine and so forth, and N-trialkyl-N-carboxymethylammonium betaine, N-trialkyl-N-sulfoalkyleneammonium betaine and so forth can be mentioned.

These surfactants are described in Takao Kariyone, "Kaimen Kasseizai no Oyo (Applications of Surfactants", Saiwai Shobo, Sep. 1, 1980). In the present invention, amounts of the preferred surfactants are not particularly limited, and they can be used in an amount providing desired surface activating property. The coating amount of the fluorine-containing surfactants is preferably 0.01–250 mg per 1 $m^2$.

Specific examples of the surfactants are mentioned below. However, the surfactants are not limited to these (—$C_6H_4$— represents phenylene group in the following formulas).

WA-1: $C_{16}H_{33}$ $(OCH_2CH_2)_{10}OH$

WA-2: $C_9H_{19}$—$C_6H_4$—$(OCH_2CH_2)_{12}OH$

WA-3: Sodium dodecylbenzenesulfonate

WA-4: Sodium tri(isopropyl)naphthalenesulfonate

WA-5: Sodium tri(isobutyl)naphthalenesulfonate

WA-6: Sodium dodecylsulfate

WA-7: α-Sulfasuccinic acid di(2-ethylhexyl) ester sodium salt

WA-8: $C_8H_{17}$—$C_6H_4$—$(CH_2CH_2O)_3(CH_2)_2SO_3K$

WA-10: Cetyltrimethylammonium chloride

WA-11: $C_{11}H_{23}CONHCH_2CH_2N^{(+)}(CH_3)_2$—$CH_2COO^{(-)}$

WA-12: $C_8F_{17}SO_2N(C_3H_7)(CH_2CH_2O)_{16}H$

WA-13: $C_8F_{17}SO_2N(C_3H_7)CH_2COOK$

WA-14: $C_8F_{17}SO_3K$

WA-15: $C_8F_{17}SO_2N(C_3H_7)(CH_2CH_2O)_4(CH_2)_4SO_3Na$

WA-16: $C_8F_{17}SO_2N(C_3H_7)(CH_2)_3OCH_2CH_2N^{(+)}(CH_3)_3$—$CH_3C_6H_4$—$SO_3^{(-)}$

WA-17: $C_8F_{17}SO_2N(C_3H_7)CH_2CH_2CH_2N^{(+)}(CH_3)_2$—$CH_2COO^{(-)}$

In a preferred embodiment of the present invention, an intermediate layer may be provided as required in addition to the image-forming layer and the protective layer. To improve the productivity or the like, it is preferred that these multiple layers should be simultaneously coated as stacked layers by using aqueous systems. While extrusion coating, slide bead coating, curtain coating and so forth can be mentioned as the coating method, the slide bead coating method shown in JP-A-2000-2964, FIG. 1 is particularly preferred.

Silver halide photographic photosensitive materials utilizing gelatin as a main binder are rapidly cooled in a first drying zone, which is provided downstream from a coating dye. As a result, the gelatin gels and the coated film is solidified by cooling. The coated film that no longer flows as a result of the solidification by cooling is transferred to a second drying zone, and the solvent in the coating solution is evaporated in this drying zone and subsequent drying zones so that a film is formed. As drying method of the second drying zone and zones after that, there can be mentioned the air loop method where a support supported by rollers is blown by air jet from a U-shaped duct, the helix method (air floating method) where the support is helically wound around a cylindrical duct and dried during transportation and so forth.

When the layers are formed by using coating solutions comprising polymer latex as a main component of binder, the flow of the coating solution cannot be stopped by rapid cooling. Therefore, the predrying may be insufficient only with the first drying zone. In such a case, if such a drying method as utilized for silver halide photographic photosensitive materials is used, uneven flow or uneven drying may occur, and therefore serious defects are likely to occur on the coated surface.

Thus, a preferred drying method for the present invention is such a method as described in JP-A-2000-2964, where the drying is attained in a horizontal drying zone irrespective of the drying zone, i.e., the first or second drying zone, at least until the constant rate drying is finished. The transportation of the support during the period immediately after the coating and before the support is introduced into the horizontal drying zone may be performed either horizontally or not horizontally, and the rising angle of the material with respect to the horizontal direction of the coating machine may be within the range of 0–70°. Further, in the horizontal drying zone used in the present invention, the support may be transported at an angle within ±15° with respect to the horizontal direction of the coating machine, and it does not mean exactly horizontal transportation.

The constant rate drying used in the present invention means a drying process in which all entering calorie is consumed for evaporation of solvent at a constant liquid film temperature. Decreasing rate drying means a drying process where the drying rate is reduced by various factors (for example, diffusion of moisture in the material for transfer of moisture becomes a rate-limiting factor, evaporation surface is recessed etc.) in an end period of the drying, and imparted calorie is also used for increase of liquid film temperature. The critical moisture content for the transition from the constant rate drying to the decreasing rate drying is 200–300%. When the constant rate drying is finished, the drying has sufficiently progressed so that the flowing should be stopped, and therefore such a drying method as used for silver halide photographic photosensitive materials may also be employable. In the present invention, however, it is preferred that the drying should be performed in a horizontal drying zone until the final drying degree is attained even after the constant rate drying.

As for the drying condition for forming the image-forming layer and/or protective layer, it is preferred that the liquid film surface temperature during the constant rate drying should be higher than minimum film forming temperature (MTF) of polymer latex (MTF is usually higher than glass transition temperature Tg of polymer by 3–5° C.). In many cases, it is usually selected from the range of 25–40° C., because of limitations imposed by production facilities. Further, the dry bulb temperature during the decreasing rate drying is preferably lower than Tg of the support (in the case of PET, usually 80° C. or lower). The liquid film surface temperature referred to in this specification means a solvent liquid film surface temperature of coated liquid film coated on a support, and the dry bulb temperature means a temperature of drying air blow in the drying zone.

If the constant rate drying is performed under a condition that lowers the liquid film surface temperature, the drying is likely to become insufficient. Therefore, the film-forming property of the protective layer is markedly degraded, and it becomes likely that cracks will be generated on the film surface. Further, film strength also becomes weak and thus it becomes likely that there arise serious problems, for example, the film becomes liable to suffer from scratches during transportation in a light exposure apparatus or heat development apparatus.

On the other hand, if the drying is performed under a condition that elevates the liquid film surface temperature, the protective layer mainly consisting of polymer latex rapidly becomes a film, but the under layers including the image-forming layer do not lose flowability, and hence it is likely that unevenness is formed on the surface. Furthermore, if the support (base) is subjected to a temperature higher than its Tg, dimensional stability and resistance to curl tendency tends to be degraded.

The same is applied to the serial coating, in which an under layer is coated and then an upper layer is coated. As for properties of coating solutions, when an upper layer and a lower layer are coated as stacked layers by coating the upper layer before drying of the lower layer, in particular, a coating solution for the image-forming layer and a coating solution for protective layer preferably show a pH difference of 2.5 or less, and a smaller value of this pH difference is more preferred. If the pH difference becomes large, it becomes likely that microscopic aggregations are generated at the interface of the coating solutions and thus it becomes likely that serious defects of surface condition such as coating stripes occur during continuous coating for a long length.

The coating solution for the image-forming layer preferably has a viscosity of 15–100 mPa.S, more preferably 30–70 mPa.S, at 25° C. The coating solution for the protective layer preferably has a viscosity of 5–75 mPa.S, more preferably 20–50 mPa.S, at 25° C. These viscosities are measured by using a B-type viscometer.

The rolling up after the drying is preferably carried out under conditions of a temperature of 20–30° C. and a relative humidity of 45±20%. As for rolled shape, the material may be rolled so that the surface of the image-forming layer side may be toward the outside or inside of the roll according to a shape suitable for subsequent processing. Further, it is also preferred that, when the material is further processed in a rolled shape, the material should be rolled up into a shape of roll in which the sides are reversed during processing from those of the original rolled shape, in order to eliminate the curl generated while the material is in the original rolled shape. Relative humidity of the photosensitive material is preferably controlled to be in the range of 20–55% (measured at 25° C.).

In conventional coating solutions for photographic emulsions, which are viscous solutions containing silver halide and gelatin as a base, air bubbles are dissolved in the solutions and eliminated only by feeding the solution by pressurization, and air bubbles are scarcely formed even when the solutions are placed under atmospheric pressure again for coating. However, as for the coating solution for the image-forming layer containing dispersion of silver salt of organic acid, polymer latex and so forth preferably used in the present invention, only feeding of it by pressurization is likely to result in insufficient degassing. Therefore, it is preferably fed so that air/liquid interfaces should not be produced, while giving ultrasonic vibration to perform degassing.

In the present invention, the degassing of a coating solution is preferably performed by a method where the coating solution is degassed under reduced pressure before coating, and further the solution is preferably maintained in a pressurized state at a pressure of 1.5 kg/cm$^2$ or more and continuously fed so that air/liquid interfaces should not be formed, while giving ultrasonic vibration to the solution. Specifically, the method disclosed in JP-B-55-6405 (from page 4, line 20 to page 7, line 11) is preferred. As an apparatus for performing such degassing, the apparatus disclosed in JP-A-2000-98534, examples and FIG. 3, is preferably used.

The pressurization condition is preferably 1.5 kg/cm$^2$ or more, more preferably 1.8 kg/cm$^2$ or more. While the pressure is not particularly limited as for its upper limit, it is usually about 5 kg/cm$^2$ or less. Ultrasonic wave given to the solution should have a sound pressure of 0.2 V or more, preferably 0.5 V to 3.0 V. Although a higher sound pressure is generally preferred, an unduly high sound pressure provides high temperature portions due to cavitation, which may causes fogging. While frequency of the ultrasonic wave is not particularly limited, it is usually 10 kHz or higher, preferably 20 kHz to 200 kHz. The degassing under reduced pressure means a process where a coating solution is placed in a sealed tank (usually a tank in which the solution is prepared or stored) under reduced pressure to increase diameters of air bubbles in the coating solution so that degassing should be attained by buoyancy imparted to the air bubbles. The reduced pressure condition for the degassing under reduced pressure is −200 mmHg or a pressure condition lower than that, preferably −250 mmHg or a pressure condition lower than that. Although the lower limit of the pressure condition is not particularly limited, it is usually about −800 mmHg or higher. Time under the reduced pressure is 30 minutes or more, preferably 45 minutes or more, and its upper limit is not particularly defined.

In the present invention, the image-forming layer, protective layer for the image-forming layer, undercoat layer and back layer may contain a dye in order to prevent halation and so forth as disclosed in JP-A-11-84573, paragraphs 0204–0208 and Japanese Patent Application No. 11-106881, paragraphs 0240–0241.

Various dyes and pigments can be used for the image-forming layer for improvement of color tone and prevention of irradiation. While arbitrary dyes and pigments may be used for the image-forming layer, the compounds disclosed in JP-A-11-119374, paragraphs 0297, for example, can be used. These dyes may be added in any form such as solution, emulsion, solid microparticle dispersion and macromolecule mordant mordanted with the dyes. Although the amount of these compounds is determined by the desired absorption, they are preferably used in an amount of $1\times10^{-6}$ g to 1 g per 1 m$^2$, in general.

When an antihalation dye is used in the present invention, the dye may be any compound so long as it shows intended absorption in a desired range and sufficiently low absorption in the visible region after development, and provides a preferred absorption spectrum pattern of the back layer. For example, the compounds disclosed in JP-A-11-119374, paragraph 0300 can be used. There can also be used a method of reducing density obtained with a dye by thermal decoloration as disclosed in Belgian Patent No. 733,706, a method of reducing the density by decoloration utilizing light irradiation as disclosed in JP-A-54-17833 and so forth.

When the thermally processed image recording material of the present invention after heat development is used as a mask for the production of printing plate from a PS plate, the thermally processed image recording material after heat development carries information for setting up light exposure conditions of platemaking machine for PS plates or information for setting up platemaking conditions including transportation conditions of mask originals and PS plates as image information. Therefore, in order to read such information, densities (amounts) of the aforementioned irradiation dye, halation dye and filter dye are limited. Because the information is read by using LED or laser, Dmin (minimum density) in a wavelength region of the sensor must be low, i.e., the absorbance must be 0.3 or less. For example, a platemaking machine S-FNRIII produced by Fuji Photo Film Co., Ltd. uses a light source having a wavelength of 670 nm for a detector for detecting resister marks and a bar code reader. Further, platemaking machines of APML series produced by Shimizu Seisaku Co., Ltd. utilize a light source at 670 nm for a bar code reader. That is, if Dmin (minimum density) around 670 nm is high, the information on the film cannot be correctly detected, and thus operation errors such as transportation failure and light exposure failure are caused in platemaking machines. Therefore, in order to read information with a light source of 670 nm, Dmin around 670 nm must be low and the absorbance at 660–680 nm after the heat development must be 0.3 or less, more preferably 0.25 or less. Although the absorbance is not particularly limited as for its lower limit, it is usually about 0.10.

In the present invention, as the exposure apparatus used for the imagewise light exposure, any apparatus may be used so long as it is an exposure apparatus enabling light exposure with an exposure time of $10^{-7}$ second or shorter. However, a light exposure apparatus utilizing a laser diode (LD) or a light emitting diode (LED) as a light source is preferably used in general. In particular, LD is more preferred in view of high output and high resolution. Any of these light sources may be used so long as they can emit a light of electromagnetic wave spectrum of desired wavelength range. For example, as for LD, dye lasers, gas lasers, solid state lasers, semiconductor lasers and so forth can be used. Semiconductor lasers are particularly preferred, and specific examples thereof include those utilizing $In_{1-x}Ga_xP$ (about 700 nm), $GaAs_{1-x}P_x$ (610–900 nm), $Ga_{1-x}Al_xAs$ (690–900 nm), InGaAsP (1100–1670 nm), AlGaAsSb (1250–1400 nm) and so forth. Irradiation of light to the color photosensitive material of the present invention may also be performed by using, besides the aforementioned semiconductor lasers, a YAG laser in which Nb:YAG crystals are excited by $GaAs_xP_{1-x}$ light emitting diode. The use of light selected from the semiconductor laser light beams at wavelengths of 670, 680, 750, 780, 810, 830 and 880 nm is preferred.

In the present invention, the second harmonics generating element (SHG element) means an element that converts wavelength of a laser ray to ½ by utilizing non-linear optical effect. Examples thereof include, for example, those utilizing CD*A or KD*P as non-linear optical crystals (see Laser Handbook, edited by the Laser Society of Japan, published on Dec. 15, 1982, pp.122–139). Further, an $LiNbO_3$ photoconductive waveguide element comprising $LiNbO_3$ crystals in which $Li^+$ is ion-exchanged with $H^+$ to form waveguide may also be used (see Nikkei Electronics, published on Jul. 14, 1986, No. 399, pp.89–90). The output device described in JP-A-63-226552 can be used for the present invention.

The light exposure in the present invention is performed with overlapped light beams of light sources. The term "overlapped" means that a vertical scanning pitch width is smaller than the diameter of the beams. For example, the overlap can be quantitatively expressed as FWHM/vertical-scanning pitch width (overlap coefficient), where the beam diameter is represented as a half width of beam strength (FWHM). In the present invention, it is preferred that this overlap coefficient is 0.2 or more. Laser energy density for the light exposure is preferably several to several hundreds of microjoules ($\mu$J) per cm$^2$, more preferably several to several tens of microjoules per cm$^2$.

The scanning method of the light source of the light exposure apparatus used in the present invention is not particularly limited, and the cylinder external surface scanning method, cylinder internal surface scanning method, flat surface scanning method and so forth can be used. Although the channel of light source may be either single channel or multichannel, a multichannel is preferably used for the cylinder external surface scanning method.

The thermally processed image recording material of the present invention shows low haze upon the light exposure, and therefore it is likely to generate interference fringes. As techniques for preventing such interference fringes, there are known a technique of obliquely irradiating a photosensitive material with a laser light as disclosed in JP-A-5-113548, a technique of utilizing a multimode laser disclosed in International Patent Publication WO95/31754 and so forth, and these techniques are preferably used.

Although any method may be used for the heat development process of the image-forming method for the thermally processed image recording material of the present invention, the development is usually performed by heating a thermally processed image recording material exposed imagewise. As preferred embodiments of heat development apparatus to be used, there are heat development apparatuses in which a thermally processed image recording material is brought into contact with a heat source such as heat roller or heat drum as disclosed in JP-B-5-56499, JP-A-9-292695, JP-A-9-297385 and WO95/30934, and heat development apparatuses of non-contact type as disclosed in JP-A-7-13294, WO97/28489, WO97/28488 and WO97/28487. Particularly preferred embodiments are the heat development apparatuses of non-contact type. The temperature for the development is preferably 80° C. to 250° C., more preferably 100° C. to 140° C. The development time is preferably 1–180 seconds, more preferably 5–90 seconds. The line speed is preferably 140 cm/minute or less.

As a method for preventing uneven development due to dimensional change of the thermally processed image recording material during the heat development, it is effective to employ a method for forming images wherein the material is heated at a temperature of 80° C. or higher but lower than 115° C. for 5 seconds or more so as not to develop images, and then subjected to heat development at 110–140° C. to form images (so-called multi-step heating method).

Since the thermally processed image recording material of the present invention is subjected to a high temperature of 110° C. or higher during the heat development, a part of the components contained in the material or a part of decomposition products produced by the heat development are volatilized. It is known that these volatilized components exert various bad influences, for example, they may cause uneven development, erode structural members of development apparatuses, deposit at low temperature portions as dusts to cause deformation of image surface, adhere to image surface as stains and so forth. As a method for eliminating these influences, it is known to provide a filter on the heat development apparatus, or suitably control air flows in the heat development apparatus. These methods may be effectively used in combination.

WO95/30933, WO97/21150 and International Patent Publication in Japanese (Kohyo) No. 10-500496 disclose use of a filter cartridge containing binding absorption particles and having a first vent for introducing volatilized components and a second vent for discharging them in a heating apparatus for heating a thermally processed image recording material by contact. Further, WO96/12213 and International Patent Publication in Japanese (Kohyo) No. 10-507403 disclose use of a filter consisting of a combination of heat conductive condensation collector and a gas-absorptive microparticle filter. These can be preferably used in the present invention.

Further, U.S. Pat. No. 4,518,845 and JP-B-3-54331 disclose structures comprising means for eliminating vapor from a thermally processed image recording material, pressing means for pressing a thermally processed image recording material to a heat-conductive member and means for heating the heat-conductive member. Further, WO98/27458 discloses elimination of components volatilized from a thermally processed image recording material and increasing fog from a surface of the thermally processed image recording material. These techniques are also preferably used for the present invention.

An example of the structure of heat development apparatus used for the heat development of the thermally processed image recording material of the present invention is shown in FIG. 1. FIG. 1 depicts a side view of a heat development apparatus. The heat development apparatus shown in FIG. 1 comprises carrying-in roller pairs 11 (upper rollers are silicone rubber rollers, and lower rollers are aluminum heating rollers), which carry a thermally processed image recording material 10 into the heating section while making the material in a flat shape and preheating it, and carrying-out roller pairs 12, which carry out the thermally processed image recording material 10 after heat development from the heating section while maintaining the material to be in a flat shape. The thermally processed image recording material 10 is heat-developed while it is conveyed by the carrying-in roller pairs 11 and then by the carrying-out roller pairs 12. As conveying means for carrying the thermally processed image recording material 10 under the heat development, there are provided multiple rollers 13 so that they should be contacted with the surface of the image-forming layer side, and a flat surface 14 adhered with non-woven fabric (composed of, for example, aromatic polyamide, Teflon etc.) or the like is provided on the opposite side so that it should be contacted with the back surface. The thermally processed image recording material 10 is conveyed by driving of the multiple rollers 13 contacted with the surface of image-forming layer side, while the back surface slides on the flat surface 14. Heaters 15 are provided over the rollers 13 and under the flat surface 14 so that the thermally processed image recording material 10 should be heated from the both sides. Examples of the heating means include panel heaters and so forth. While clearance between the rollers 13 and the flat surface 14 may vary depending on the material of the flat surface member, it is suitably adjusted to a clearance that allows the conveyance of the thermally processed image recording material 10. The clearance is preferably 0–1 mm.

The materials of the surfaces of the rollers 13 and the member of the flat surface 14 may be composed of any materials so long as they have heat resistance and they should not cause any troubles in the conveyance of the thermally processed image recording material 10. However, the material of the roller surface is preferably composed of silicone rubber, and the member of the flat surface is preferably composed of non-woven fabric made of aromatic polyamide or Teflon (PTFE). The heating means preferably comprises multiple heaters so that temperature of each heater can be adjusted freely.

The heating section is constituted by a preheating section A comprising the carrying-in roller pairs 11 and a heat development section B comprising the heaters 15. Temperature of the preheating section A locating upstream from the heat development section B is preferably controlled to be lower than the heat development temperature (for example, lower by about 10–30° C.), and temperature and heat development time are desirably adjusted so that they should be sufficient for evaporating moisture contained in the thermally processed image recording material 10. The temperature is also adjusted to be higher than the glass transition temperature (Tg) of the support of the thermally processed image recording material 10 so that uneven development should be prevented. Temperature distribution of the preheating section and the heat development section is preferably ±1° C. or less, more preferably ±0.5° C. or less.

Moreover, guide panels 16 are provided downstream from the heat development section B, and they constitute a gradual cooling section C together with the carrying-out roller pairs 12.

The guide panels 16 are preferably composed of a material of low heat conductivity, and it is preferred that the cooling is performed gradually so as not to cause deformation of the thermally processed image recording material 10. The cooling rate is preferably 0.5–10° C./second.

The heat development apparatus was explained with reference to the example shown in the drawing. However, the apparatus is not limited to the example. For example, the heat development apparatus used for the present invention may have a variety of structures such as one disclosed in JP-A-7-13294. For the multi-stage heating method, which is preferably used for the present invention, the thermally processed image recording material may be successively heated at different temperatures in such an apparatus as mentioned above, which is provided with two or more heat sources at different temperatures.

The present invention will be specifically explained with reference to the following examples. The materials, amounts, ratios, types and procedures of processes and so forth shown in the following examples can be optionally changed so long as such change does not depart from the spirit of the present invention. Therefore, the scope of the present invention is not construed in a limitative way based on the following examples.

SYNTHESIS EXAMPLE 1

Synthesis of Compound A-3

According to a method described in literature (Tetrahedron, 45 (20), 6375–86 (1989)), the following Intermediate A was synthesized. Intermediate A in an amount of 25 g was dissolved in 250 mL of acetonitrile and added with 20 mL of dimethylformamide dimethylacetal at room temperature. After stirring for 60 minutes, the solvent was evaporated under reduced pressure. The obtained residue was purified by column chromatography to obtain 13 g of the following Intermediate B. Then, a solution comprising 13 g of Intermediate B, 50 mL of methanol and 10 mL of 5 mol/L NaOH was heated at 80° C. for 2 hours with stirring, and then the reaction mixture was cooled on ice. The precipitated crystals were taken by filtration to obtain 7 g of Compound A-3. The structures of Intermediates A and B are shown below.

Intermediate A

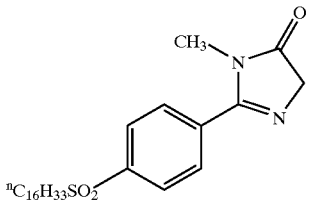

Intermediate B

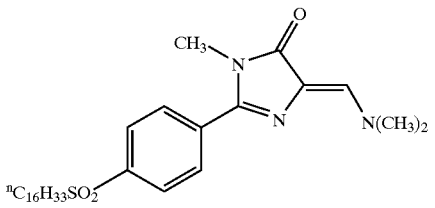

SYNTHESIS EXAMPLE 2

Synthesis of Compound (D-1)

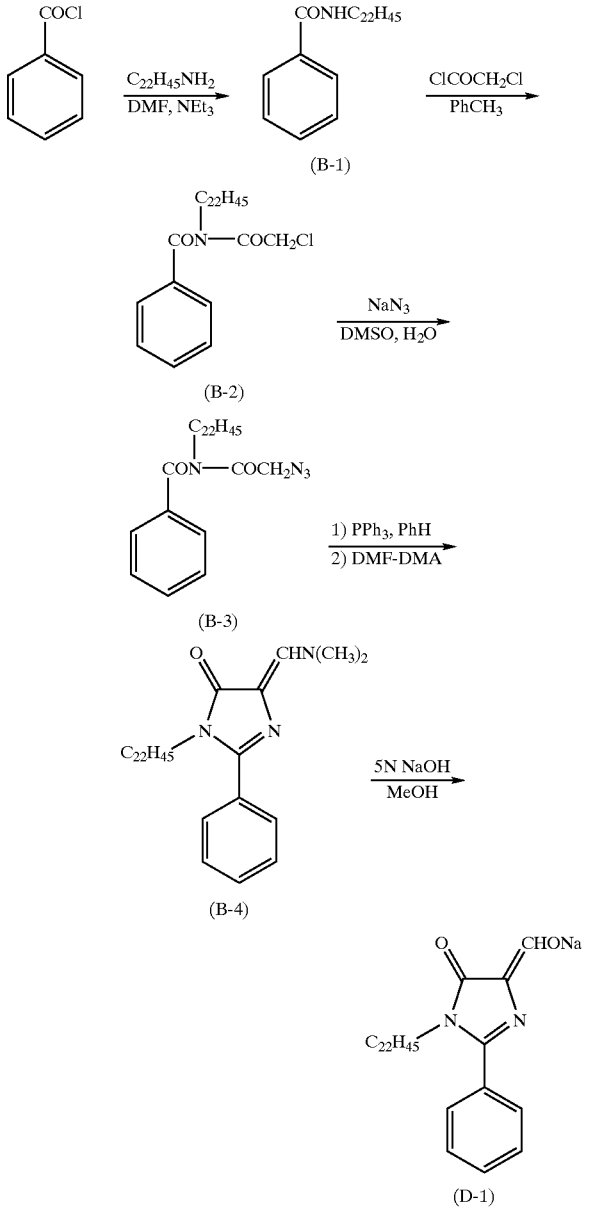

(1) Synthesis of Compound (B-1)

Behenylamine in an amount of 130.2 g (0.4 mol) was dissolved in 400 mL of dimethylformamide, added with 61.3 mL (0.44 mol) of triethylamine, stirred with ice cooling, and slowly added dropwise with 61.9 g (0.44 mol) of benzoyl chloride. After stirring at room temperature for 1 hour, 1400 mL of water was added to the reaction mixture to precipitate crystals. These crystals were taken by filtration, sufficiently washed with water and dried to obtain 164.9 g (yield: 96%) of Compound (B-1).

(2) Synthesis of Compound (B-2)

Compound (B-1) in an amount of 164.9 g was dissolved in 1000 mL of toluene, added with 47 mL of chloroacetyl chloride, stirred under a reflux condition with heating for 3 hours, and concentrated to obtain 194.1 g (yield: 100%) of oily Compound (B-2)

(3) Synthesis of Compound (B-3)

Compound (B-2) in an amount of 194.1 g was dissolved in 1200 mL of dimethyl sulfoxide, stirred with ice cooling and then added dropwise with an aqueous solution of 24 g of sodium azide in 100 mL of water. The solution was stirred at room temperature for 1 hour and then added with 1500 mL of water. This reaction mixture was extracted with ethyl acetate, and the extract was washed three times with 400 mL of water and twice with 200 mL of saturated brine and dried over magnesium sulfate. The filtrate was concentrated to obtain 196.0 g (yield: 99.6%) of oily Compound (B-3).

(4) Synthesis of Compound (B-4)

Compound (B-3) in an amount of 196.0 g was dissolved in 1250 mL of benzene, stirred with ice cooling and then added with 78 g of triphenylphosphine. After stirring at room temperature for 3.5 hours, the reaction mixture was cooled on ice and added dropwise with 50 mL of dimethylformamide dimethylacetal. After stirring at room temperature for 30 minutes, the reaction mixture was subjected to purification by column chromatography and recrystallization from acetonitrile as it was to obtain 125.5 g (yield: 62.7%) of Compound (B-4).

(5) Synthesis of Exemplary Compound (D-1)

Compound (B-4) in an amount of 125.5 g was dissolved in 450 mL of methanol, added with 90 mL of 5 mol/L sodium hydroxide, stirred under a reflux condition for 5 hours with heating, and cooled to precipitate crystals. These crystals were taken by filtration and recrystallized from a mixed solvent of methanol/water to obtain 117.6 g (yield: 94.6%) of Exemplary Compound (D-1).

SYNTHESIS EXAMPLE 3

Synthesis of Compound α-49

Intermediate A was synthesized by a known method.

Then, 90.6 g of triphenylphosphine, 108 mL of carbon tetrachloride, 31.5 mL of triethylamine and 8.4 mL of trifluoroacetic acid were mixed and stirred, and then added with 35.1 g of Intermediate A. The reaction mixture was refluxed for 3 hours with heating and added with hexane. Insoluble matters were removed, and the filtrate was concentrated under reduced pressure to obtain 37 g of oily Intermediate B.

Subsequently, 33.3 g of Intermediate B, 11.4 g of glycine ethyl ester hydrochloride and 24.3 mL of triethylamine were refluxed in acetonitrile for 2 hours with heating and added with ethyl acetate and water for separation extraction. The organic layer was dried over anhydrous sodium sulfate and concentrated under reduced pressure to obtain 37 g of oily Intermediate C.

Then, 31.8 g of Intermediate C and 25.8 mL of N,N-dimethylformamide dimethylacetal were dissolved in 120 mL of acetonitrile and refluxed for 3 hours with heating. The reaction mixture was cooled on ice, and the precipitated crystals were taken by filtration to obtain 26 g of Intermediate D as pale yellow crystals.

Intermediate D in an amount of 25 g, 75 mL of 2 mol/L NaOH and 150 mL of methanol were refluxed for 2 hours with heating, and the reaction mixture was cooled on ice. The precipitated crystals were taken by filtration and washed with acetonitrile to obtain 23 g of Exemplary Compound α-49 as white crystals. The structures of Intermediates A to D are shown below.

Intermediate A

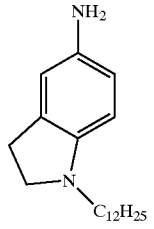

Intermediate B

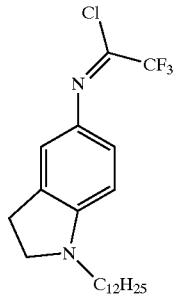

Intermediate C

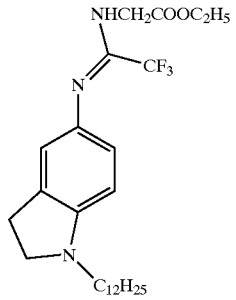

Intermediate D

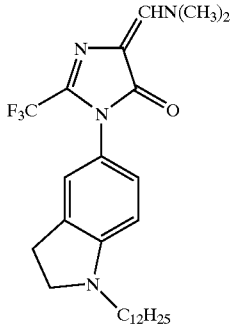

EXAMPLE 1

Preparation of Silver Halide Emulsion A

In 700 mL of water, 11 g of alkali-treated gelatin (calcium content: 2700 ppm or less), 30 mg of potassium bromide and 1.3 g of sodium 4-methylbenzenesulfonate were dissolved. After the solution was adjusted to pH 6.5 at a temperature of 45° C., 159 mL of an aqueous solution containing 18.6 g of silver nitrate and an aqueous solution containing 1 mol/L of potassium bromide, $5\times10^{-6}$ mol/L of $(NH_4)_2RhCl_5(H_2O)$ and $2\times10^{-5}$ mol/L of $K_3IrCl_6$ were added by the control double jet method over 6 minutes and 30 seconds while pAg was maintained at 7.7. Then, 476 mL of an aqueous solution containing 55.5 g of silver nitrate and an aqueous solution containing 1 mol/L of potassium bromide and $2\times10^{-5}$ mol/L of $K_3IrCl_6$ were added by the control double jet method over 28 minutes and 30 seconds while pAg was maintained at 7.7.

Then, the pH was lowered to cause coagulation precipitation to effect desalting, 51.1 g of low molecular weight gelatin having an average molecular weight of 15,000 (calcium content: 20 ppm or less) was added, and pH and pAg were adjusted to 5.9 and 8.0, respectively. The grains obtained were cubic grains having a mean grain size of 0.11 μm, variation coefficient of 9% for projected area and a [100] face ratio of 90%.

The temperature of the obtained silver halide grains was raised to 60° C., and the grains were added with 76 μmol per mole of silver of sodium benzenethiosulfonate. After 3 minutes, 71 μmol of triethylthiourea was further added, and the grains were ripened for 100 minutes, then added with $5\times10^{-4}$ mol/L of 4-hydroxy-6-methyl-1,3,3a,7-tetrazaindene and 0.17 g of Compound A, and cooled to 40° C.

Then, while the mixture was maintained at 40° C., it was added with potassium bromide (added as aqueous solution), the following Sensitizing Dye A (added as solution in ethanol) and Compound B (added as solution in methanol) were added in amounts of $4.7\times10^{-2}$ mole, $12.8\times10^{-4}$ mole and $6.4\times10^{-3}$ mole per mole of the silver halide with stirring. After 20 minutes, the emulsion was quenched to 30° C. to complete the preparation of Silver halide emulsion A.

solution of sodium behenate should be added for 9 minutes and 30 seconds after finishing the addition of the aqueous silver nitrate solution. During the addition, the outside temperature was controlled so that the temperature in the reaction vessel should be 30° C. and the liquid temperature should not be raised. The piping of the addition system for the sodium behenate solution was warmed by steam trace and the steam amount was controlled such that the liquid temperature at the outlet orifice of the addition nozzle should be 75° C. Further, the piping of the addition system for the aqueous silver nitrate solution was maintained by circulating cold water outside a double pipe. The addition position of the sodium behenate solution and the addition position of the aqueous silver nitrate solution were arranged symmetrically with respect to the stirring axis as the center, and the positions were controlled to be at heights for not contacting with the reaction mixture.

After finishing the addition of the sodium behenate solution, the mixture was left with stirring for 20 minutes at the same temperature and then the temperature was decreased to 25° C. Thereafter, the solid content was recovered by suction filtration and the solid content was washed with water until electric conductivity of the filtrate became 30 μS/cm. The solid content obtained as described above was stored as a wet cake without being dried.

Sensitizing dye A

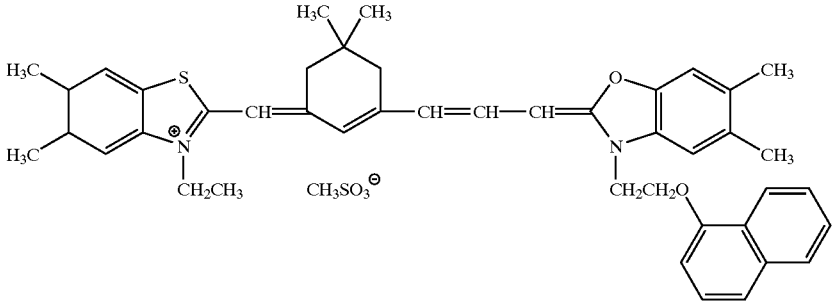

Compound A

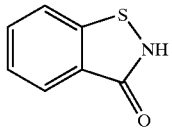

Compound B

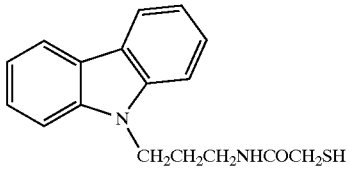

Preparation of Silver Behenate Dispersion A

In an amount of 87.6 kg of behenic acid (Edenor C22-85R, produced by Henkel Co.), 423 L of distilled water, 49.2 L of 5 mol/L aqueous solution of NaOH and 120 L of tert-butanol were mixed and allowed to react with stirring at 75° C. for one hour to obtain a solution of sodium behenate. Separately, 206.2 L of an aqueous solution containing 40.4 kg of silver nitrate was prepared and kept at 10° C. A mixture of 635 L of distilled water and 30 L of tert-butanol contained in a reaction vessel kept at 30° C. was added with the whole amount of the aforementioned sodium behenate solution and the whole amount of the aqueous silver nitrate solution with stirring at constant flow rates over the periods of 62 minutes and 10 seconds, and 60 minutes, respectively. In this operation, the aqueous silver nitrate solution was added in such a manner that only the aqueous silver nitrate solution should be added for 7 minutes and 20 seconds after starting the addition of the aqueous silver nitrate solution, and then the addition of the aqueous solution of sodium behenate was started and added in such a manner that only the aqueous When the shape of the obtained silver behenate grains was evaluated by an electron microscopic photography, the grains were scaly crystals having a mean diameter of projected areas of 0.52 μm, mean thickness of 0.14 μm and variation coefficient of 15% for mean diameter as spheres.

Then, dispersion of silver behenate was prepared as follows. To the wet cake corresponding to 100 g of the dry solid content was added with 7.4 g of polyvinyl alcohol (PVA-217, trade name, average polymerization degree: about 1700) and water to make the total amount 385 g, and the mixture was pre-dispersed by a homomixer. Then, the pre-dispersed stock dispersion was treated three times by using a dispersing machine (Microfluidizer-M-110S-EH, produced by Microfluidex International Corporation, using G10Z interaction chamber) with a pressure controlled to be 1750 kg/cm$^2$ to obtain Silver behenate dispersion A. During the cooling operation, a desired dispersion temperature was achieved by providing coiled heat exchangers fixed before and after the interaction chamber and controlling the temperature of the refrigerant.

The silver behenate grains contained in Silver behenate dispersion A obtained as described above were grains having a volume weight average diameter of 0.52 μm and variation coefficient of 15%. The measurement of the grain size was carried out by using Master Sizer X produced by Malvern Instruments Ltd. When the grains were evaluated by an electron microscopic photography, the ratio of the long side to the short side was 1.5, the grain thickness was 0.14 μm, and a mean aspect ratio (ratio of diameter as sphere of projected area of grain and grain thickness) was 5.1.

The obtained Silver behenate dispersion A was and used for the preparation of the coating solution described below.

Preparation of Solid Microparticle Dispersion of Reducing Agent

In an amount of 10 kg of reducing agent [1,1-bis(2-hydroxy-3,5-dimethylphenyl)-3,5,5-trimethylhexane] and 10 kg of 20 weight % aqueous solution of denatured polyvinyl alcohol (Poval MP203, produced by Kuraray Co. Ltd.) were added with 400 g of Safinol 104E (Nisshin Kagaku Co.), 640 g of methanol and 16 kg of water, and mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 3 hours and 30 minutes. Then, the slurry was added with 4 g of benzothiazolinone sodium salt and water so that the concentration of the reducing agent should become 25 weight % to obtain a solid microparticle dispersion of reducing agent. The reducing agent particles contained in the dispersion obtained as described above had a median diameter of 0.44 μm, maximum particle diameter of 2.0 μm or less and variation coefficient of 19% for mean particle diameter. The obtained dispersion was filtered through a polypropylene filter having a pore size of 3.0 μm to remove dusts and so forth, and used for the preparation of the coating solution described below.

Preparation of Solid Microparticle Dispersion of Organic Polyhalogenated Compound A In an amount of 10 kg of the following Organic polyhalogenated compound A [tribromomethyl(4-(2,4,6-trimethylphenylsulfonyl) phenyl)sulfone], 10 kg of 20 weight % aqueous solution of denatured polyvinyl alcohol (Poval MP203, produced by Kuraray Co. Ltd.), 639 g of 20 weight % aqueous solution of sodium triisopropylnaphthalenesulfonate, 400 g of Safinol 104E (Nisshin Kagaku Co.), 640 g of methanol and 16 kg of water were mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 5 hours. Then, the slurry was added with water so that the concentration of Organic polyhalogenated compound A should become 25 weight % to obtain solid microparticle dispersion of Organic polyhalogenated compound A. The particles of the organic polyhalogenated compound contained in the dispersion obtained as described above had a median diameter of 0.36 μm, maximum particle diameter of 2.0 μm or less and variation coefficient of 18% for mean particle diameter. The obtained dispersion was filtered through a polypropylene filter having a pore size of 3.0 μm to remove dusts and so forth, and used for the preparation of the coating solution described below.

Preparation of Solid Microparticle Dispersion of Organic Polyhalogenated Compound B In an amount of 5 kg of the following Organic polyhalogenated compound B [tribromomethylnaphthylsulfone], 2.5 kg of 20 weight % aqueous solution of denatured polyvinyl alcohol (Poval MP203, produced by Kuraray Co. Ltd.) 213 g of 20 weight % aqueous solution of sodium triisopropylnaphthalenesulfonate and 10 kg of water were mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 5 hours. Then, the slurry was added with 2.5 g of benzothiazolinone sodium salt and water so that the concentration of Organic polyhalogenated compound B should become 23.5 weight % to obtain solid microparticle dispersion of Organic polyhalogenated compound B. The particles of the organic polyhalogenated compound contained in the dispersion obtained as described above had a median diameter of 0.38 μm, maximum particle diameter of 2.0 μm or less and variation coefficient of 20% for mean particle diameter. The obtained dispersion was filtered through a polypropylene filter having a pore size of 3.0 μm to remove dusts and so forth, and used for the preparation of the coating solution described below.

Preparation of Aqueous Solution of Organic Polyhalogenated Compound C

In an amount of 75.0 mL of water, 8.6 mL of 20 weight % aqueous solution of sodium triisopropylnaphthalenesulfonate, 6.8 mL of 5 weight % aqueous solution of sodium dihydrogen-orthophosphate dihydrate and 9.5 mL of 1 mol/L aqueous solution of potassium hydroxide were successively added at room temperature with stirring, and the mixture was stirred for 5 minutes after the addition was completed. Further, the mixture was added with 4.0 g of the following Organic polyhalogenated compound C (3-tribromomethanesulfonylbenzoylaminoacetic acid) as powder and it was dissolved until the solution became transparent to obtain 100 mL of aqueous solution of Organic polyhalogenated compound C. The obtained aqueous solution was filtered through a polyester screen of 200 mesh to remove dusts and so forth, and used for the preparation of the coating solution described below.

Preparation of Emulsion Dispersion of Compound Z

In an amount of 10 kg of R-054 (Sanko Co., Ltd.) containing 85 weight % of the following Compound Z was mixed with 11.66 kg of MIBK and dissolved in the solvent at 80° C. for 1 hour in an atmosphere substituted with nitrogen. This solution was added with 25.52 kg of water, 12.76 kg of 20 weight % aqueous solution of MP polymer (MP-203, produced by Kuraray Co. Ltd.) and 0.44 kg of 20 weight % aqueous solution of sodium triisopropylnaphthalenesulfonate and subjected to emulsion dispersion at 20–40° C. and 3600 rpm for 60 minutes. The dispersion was added with 0.08 kg of Safinol 104E (Nisshin Kagaku Co.) and 47.94 kg of water and distilled under reduced pressure to remove MIBK. Then, the concentration of Compound Z was adjusted to 10 weight %. The particles of Compound Z contained in the dispersion obtained as described above had a median diameter of 0.19 μm, maximum particle diameter of 1.5 μm or shorter and variation coefficient of 17% for mean particle diameter. The obtained dispersion was filtered through a polypropylene filter having a pore size of 3.0 μm to remove dusts and so forth, and stored.

Polyhalogenated compound A

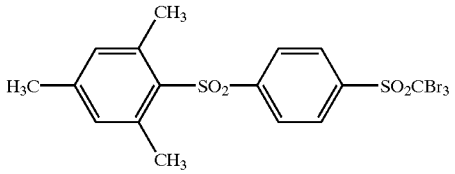

Polyhalogenated compound B

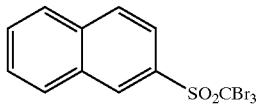

Compound Z

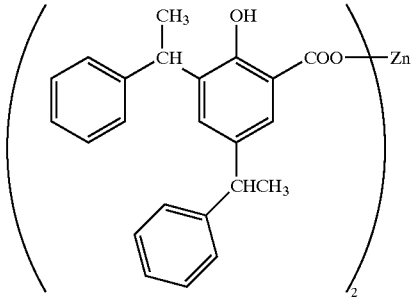

Polyhalogenated compound C

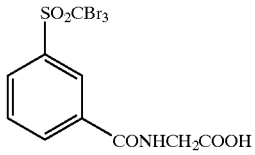

Preparation of Dispersion of 6-isopropylphthalazine Compound

In an amount of 62.35 g of water was added with 2.0 g of denatured polyvinyl alcohol (Poval MP203, produced by Kuraray Co., Ltd.) with stirring so that the denatured polyvinyl alcohol should not coagulate, and mixed by stirring for 10 minutes. Then, the mixture was heated until the internal temperature reached 50° C., and stirred for 90 minutes at an internal temperature in the range of 50–60° C. to attain uniform dissolution. The internal temperature was lowered to 40° C. or lower, and the mixture was added with 25.5 g of polyvinyl alcohol (PVA-217, produced by Kuraray Co., Ltd., 10 weight % aqueous solution), 3.0 g of sodium triisopropylnaphthalenesulfonate (20 weight %aqueous solution) and 7.15 g of 6-isopropylphthalazine (70 weight % aqueous solution) and stirred for 30 minutes to obtain 100 g of transparent dispersion. The obtained dispersion was filtered through a polypropylene filter having a pore size of 3.0 μm to remove dusts and so forth, and used for the preparation of the coating solution described below.

Preparation of Solid Microparticle Dispersion of Ultrahigh Contrast Agent Compound In an amount of 1 kg of each of the ultrahigh contrast agent compounds shown in Table 1 was added and mixed sufficiently with 0.25 kg of polyvinyl alcohol (Poval PVA-217, produced by Kuraray Co., Ltd.) and 9 kg of water to form slurry. The slurry was fed by a diaphragm pump to a bead mill of horizontal type (UVM-2, produced by Imex Co.) containing zirconia beads having a mean diameter of 0.5 mm, and dispersed for 12 hours. Then, the slurry was added with 1 g of benzothiazolinone sodium salt and water so that the concentration of the ultrahigh contrast agent compound should become 10 weight % to obtain solid microparticle dispersion of the ultrahigh contrast agent compound. The particles of the ultrahigh contrast agent compound contained in the obtained dispersion had a median diameter of 0.34 μm, maximum particle diameter of 3.0 μm or less and variation coefficient of 19% for the particle diameter. The obtained dispersion was filtered through a polypropylene filter having a pore size of 3.0 μm to remove dusts and so forth, and used for the preparation of the coating solution described below.

The structures of the comparative compounds mentioned in Table 1, R-1 and R-2, are shown below.

(R-1)

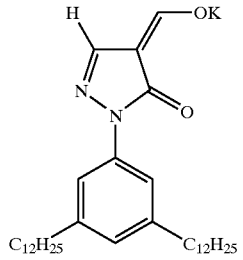

(R-2)

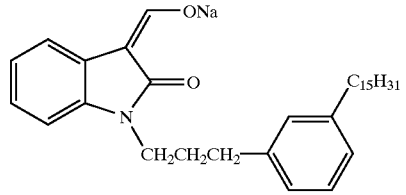

Preparation of Solid Microparticle Dispersion of Development Accelerator W

In an amount of 10 kg of the following Development accelerator W, 10 kg of 20 weight % aqueous solution of denatured polyvinyl alcohol (Poval MP203, produced by Kuraray Co., Ltd.) and 20 kg of water were mixed sufficiently to form slurry. The slurry was fed by a diaphragm pump to a bead mill of horizontal type (UVM-2, produced by Imex Co.) containing zirconia beads having a mean diameter of 0.5 mm, and dispersed for 5 hours. Then, the slurry was added with water so that the concentration of Development accelerator W should become 20 weight % to obtain a microparticle dispersion of Development accelerator W. The particles of the development accelerator contained in the dispersion obtained as described above had a median diameter of 0.5 μm, maximum particle diameter of 2.0 μm or less and variation coefficient of 18% for the mean particle diameter. The obtained dispersion was filtered through a polypropylene filter having a pore size of 3.0 μm to remove dusts and so forth, and used for the preparation of the coating solution described below.

Preparation of Coating Solution for Image-forming Layer

The organic acid silver salt dispersion prepared above was added with the following binder, materials and the silver halide emulsion in the indicated amounts per mole of silver in the organic acid silver salt dispersion prepared above, and added with water to prepare a coating solution for image-forming layer. After the preparation, the solution was degassed under reduced pressure of 0.54 atm for 45 minutes.

The coating solution showed pH of 7.7 and viscosity of 50 mPa.s at 25° C.

| | |
|---|---|
| Binder: SBR latex (St/Bu/AA = 68/29/3 (weight %), $Na_2S_2O_8$ was used as polymerization initiator) | 397.0 g as solid |
| 1,1-Bis(2-hydroxy-3,5-dimethylphenyl)-3,5,5-trimethylhexane | 149.5 g as solid |
| Organic polyhalogenated compound B | 36.3 g as solid |
| Organic polyhalogenated compound C | 2.34 g as solid |
| Sodium ethylthiosulfonate | 0.47 g |
| Benzotriazole | 1.02 g |
| Polyvinyl alcohol (PVA-235, produced by Kuraray Co., Ltd.) | 10.8 g |
| 6-Isopropylphthalazine | 5.0 g |
| Compound Z | 9.0 g as solid |
| Ultrahigh contrast agent compound | Added as shown in Table 1 |
| Dye A (added as a mixture with low molecular weight gelatin having mean molecular weight of 15000) | Amount giving optical density of 0.3 at 783 nm (about 0.40 g as solid) |
| Silver halide emulsion A | 0.06 mole as Ag |
| Compound A as preservative | 40 ppm in the coating solution (2.5 mg/m$^2$ as coated amount) |
| Methanol | 1 weight % as to total solvent amount in the coating solution |
| Ethanol | 2 weight % as to total solvent amount in the coating solution |

(The coated film showed a glass transition temperature of 17° C.)

Dye A

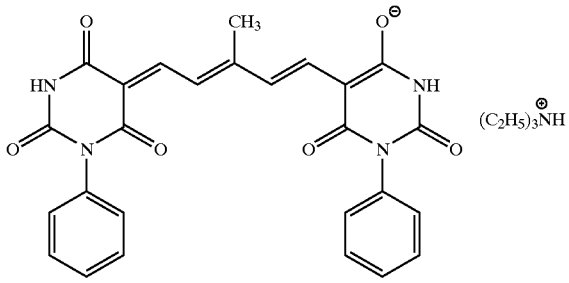

Development accelerator W

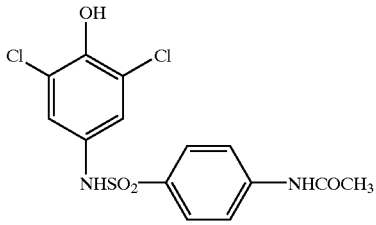

Preparation of Coating Solution for Protective Layer

In an amount of 943 g of a polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature as copolymer: 46° C. (calculated value), solid content: 21.5 weight %, containing 100 ppm of Compound A and further containing Compound D as a film-forming aid in an amount of 15 weight % relative to solid content of the latex in the solution so that the glass transition temperature of the coating solution should become 24° C., mean particle diameter: 116 nm) was added with water, 114.8 g of the aqueous solution of Organic polyhalogenated compound C, 17.0 g as solid content of Organic polyhalogenated compound A, 0.69 g as solid content of sodium dihydrogenorthophosphate dihydrate, 11.55 g as solid content of Development accelerator A, 1.58 g of matting agent (polystyrene particles, mean particle diameter: 7 μm, variation coefficient of 8% for mean particle diameter), 29.3 g of polyvinyl alcohol (PVA-235, Kuraray Co., Ltd.) and 1.62 g of Compound E mentioned below, and further added with water to form a coating solution (containing 0.8 weight % of methanol solvent). After the preparation, the solution was degassed under reduced pressure of 0.47 atm for 60 minutes. The coating solution showed pH of 5.5, and viscosity of 45 mPa.s at 25° C.

Preparation of Coating Solution for Lower Overcoat Layer

In an amount of 625 g of a polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature as copolymer: 46° C. (calculated value), solid content: 21.5 weight %, containing 100 ppm of Compound A and further containing Compound D as a film-forming aid in an amount of 15 weight % relative to solid content of the latex in the solution so that the glass transition temperature of the coating solution should become 24° C., mean particle diameter: 74 nm) was added with water, 0.23 g of Compound C, 0.13 g of Compound E, 11.7 g of Compound F, 2.7 g of Compound H and 11.5 g of polyvinyl alcohol (PVA-235, Kuraray Co., Ltd.), and further added with water to form a coating solution (containing 0.1 weight % of methanol solvent). After the preparation, the solution was degassed under reduced pressure of 0.47 atm for 60 minutes. The coating solution showed pH of 2.6, and viscosity of 30 mPa.s at 25° C.

Preparation of Coating Solution for Upper Overcoat Layer

In an amount of 649 g of polymer latex solution of copolymer of methyl methacrylate/styrene/2-ethylhexyl acrylate/2-hydroxyethyl methacrylate/acrylic acid=58.9/8.6/25.4/5.1/2 (weight %) (glass transition temperature of the copolymer: 46° C. (calculated value), solid content: 21.5 weight %, containing Compound A at a concentration of 100 ppm and further containing Compound D in the solution as a film-forming aid in an amount of 15 weight % relative to solid content of the latex so that the glass transition temperature of coating solution should become 24° C., mean particle diameter: 116 nm) was added with water, 18.4 g of 30 weight % solution of carnauba wax (Cellosol 524, Chukyo Yushi Co., Ltd., silicone content: less than 5 ppm), 0.23 g of Compound C, 1.85 g of Compound E, 1.0 g of Compound G, 3.45 g of matting agent (polystyrene particles, mean diameter: 7 μm, variation coefficient for mean particle diamter: 8%) and 26.5 g of polyvinyl alcohol (PVA-235, Kuraray Co., Ltd.) and further added with water to form a coating solution (containing 1.1 weight % of methanol solvent). After the preparation, the coating solution was degassed at a reduced pressure of 0.47 atm for 60 minutes. The coating solution showed pH of 5.3 and viscosity of 25 mPa.s at 25° C.

Compound C

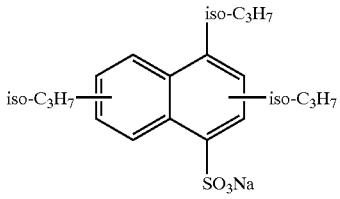

Compound D

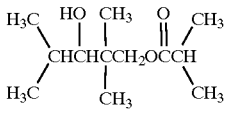

Compound E

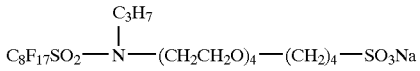

Compound F

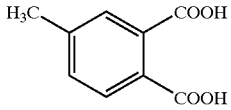

Compound G

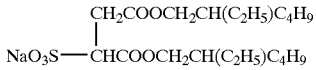

Compound H

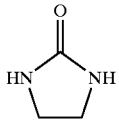

Preparation of Polyethylene Terephthalate (PET) Support with Back Layers and Undercoat Layers (1) Preparation of PET Support PET having IV (intrinsic viscosity) of 0.66 (measured in phenol/tetrachloroethane=6/4 (weight ratio) at 25° C.) was obtained in a conventional manner by using terephthalic acid and ethylene glycol. The product was pelletized, dried at 130° C. for 4 hours, melted at 300° C., then extruded from a T-die and rapidly cooled to form an unstretched film having such a thickness that the thickness should become 120 μm after thermal fixation.

The film was stretched at 110° C. along the longitudinal direction by 3.3 times using rollers of different peripheral speeds, and then stretched at 130° C. along the transverse direction by 4.5 times using a tenter. Then, the film was subjected to thermal fixation at 240° C. for 20 seconds, and relaxed by 4% along the transverse direction at the same temperature. Then, the chuck of the tenter was released, the both edges of the film were knurled, and the film was rolled up at 4.8 kg/cm$^2$. Thus, a roll of a PET support having a width of 2.4 m, length of 3500 m and thickness of 120 μm was obtained.

(2) Preparation of undercoat layers and back layers (i) First Undercoat Layer

The aforementioned PET support was subjected to a corona discharge treatment of 0.375 kV.A.minute/m$^2$, and then a coating solution having the following composition was coated in an amount of 6.2 mL/m$^2$, and dried at 125° C. for 30 seconds, 150° C. for 30 seconds, and 185° C. for 30 seconds.

| | |
|---|---|
| Latex A | 280 g |
| KOH | 0.5 g |
| Polystyrene microparticles (mean particle diameter: 2 μm, variation coefficient of 7% for mean particle diameter) | 0.03 g |
| 2,4-Dichloro-6-hydroxy-s-triazine | 1.8 g |
| Compound Bc—C | 0.097 g |
| Distilled water | Amount giving total weight of 1000 g |

Latex A

Core/shell type latex comprising 90 weight % of core and 10 weight % of shell, core: vinylidene chloride/methyl acrylate/methyl methacrylate/acrylonitrile/acrylic acid=93/3/3/0.9/0.1 (weight %), shell: vinylidene chloride/methyl acrylate/methyl methacrylate/acrylonitrile/acrylic acid=88/3/3/3/3 (weight %), weight average molecular weight; 38000

(ii) Second Undercoat Layer

A coating solution having the following composition was coated on the first undercoat layer in an amount of 5.5 mL/m$^2$ and dried at 125° C. for 30 seconds, 150° C. for 30 seconds, and 170° C. for 30 seconds.

| | |
|---|---|
| Deionized gelatin ($Ca^{2+}$ content: 0.6 ppm, jelly strength: 230 g) | 10.0 g |
| Acetic acid (20 weight % aqueous solution) | 10.0 g |
| Compound Bc—A | 0.04 g |
| Methyl cellulose (2 weight % aqueous solution) | 25.0 g |
| Polyethyleneoxy compound | 0.3 g |
| Distilled water | Amount giving total weight of 1000 g |

(iii) First Back Layer

The surface of the support opposite to the surface coated with the undercoat layers was subjected to a corona discharge treatment of 0.375 kV.A.minute/m$^2$, and a coating solution having the following composition was coated on the surface in an amount of 13.8 mL/m$^2$, and dried at 125° C. for 30 seconds, 150° C. for 30 seconds, and 185° C. for 30 seconds.

| | |
|---|---|
| Julimer ET-410 (30 weight % aqueous dispersion Nihon Junyaku Co., Ltd.) | 23.0 g |
| Alkali-treated gelatin (molecular weight: about 10000, $Ca^{2+}$ content: 30 ppm) | 4.44 g |
| Deionized gelatin ($Ca^{2+}$ content: 0.6 ppm) | 0.84 g |
| Compound Bc—A | 0.02 g |
| Dye Bc—A | Amount giving optical density of 1.3–1.4 at 783 nm, about 0.88 g |
| Polyoxyethylene phenyl ether | 1.7 g |
| Water-soluble melamine compound (Sumitex Resin M-3, Sumitomo Chemical Co., Ltd., 8 weight % aqueous solution) | 15.0 g |

-continued

| | |
|---|---|
| Aqueous dispersion of Sb-doped $SbO_2$ acicular grains (FS-10D, Ishihara Sangyo Kaisha, Ltd.) | 24.0 g |
| Polystyrene microparticles (mean diameter: 2.0 μm, variation coefficient of 7% for mean particle diameter) | 0.03 g |
| Distilled water | Amount giving total weight of 1000 g |

(iv) Second Back Layer

A coating solution having the following composition was coated on the first back layer in an amount of 5.5 mL/m$^2$ and dried at 125° C. for 30 seconds, 150° C. for 30 seconds, and 170° C. for 30 seconds.

| | |
|---|---|
| Julimer ET-410 (30 weight % aqueous dispersion Nihon Junyaku Co., Ltd.) | 57.5 g |
| Polyoxyethylene phenyl ether | 1.7 g |
| Water-soluble melamine compound (Sumitex Resin M-3, Sumitomo Chemical Co., Ltd., 8 weight % aqueous solution) | 15.0 g |
| Cellosol 524 (30 weight % aqueous solution, Chukyo Yushi Co., Ltd.) | 6.6 g |
| Distilled water | Amount giving total weight of 1000 g |

(v) Third Back Layer

The same coating solution as the first undercoat layer was coated on the second back layer in an amount of 6.2 mL/m$^2$ and dried at 125° C. for 30 seconds, 150° C. for 30 seconds, and 185° C. for 30 seconds.

(vi) Fourth Back Layer

A coating solution having the following composition was coated on the third back layer in an amount of 13.8 mL/m$^2$ and dried at 125° C. for 30 seconds, 150° C. for 30 seconds, and 170° C. for 30 seconds.

| | |
|---|---|
| Latex B | 286 g |
| Compound Bc—B | 2.7 g |
| Compound Bc—C | 0.6 g |
| Compound Bc—D | 0.5 g |
| 2,4-Dichloro-6-hydroxy-s-triazine | 2.5 g |
| Polymethyl methacrylate (10 weight % aqueous dispersion, mean particle diameter: 5.0 μm, variation coefficient of 7% for mean particle diameter) | 7.7 g |
| Distilled water | Amount giving total weight of 1000 g |

Latex B

Latex of copolymer of methyl methacrylate/styrene/2-ethylhexyl acrylate/2-hydroxyethyl methacrylate/acrylic acid=59/9/26/5/1 (weight %)

Dye Bc-A

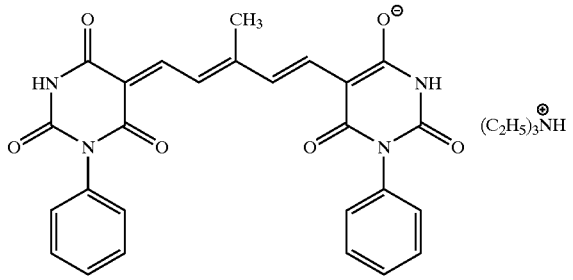

Compound Bc-A

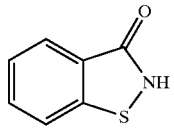

Compound Bc-B $C_{18}H_{37}OSO_3Na$

Compound Bc-C $C_8F_{17}SO_3Li$

Compound Bc-D

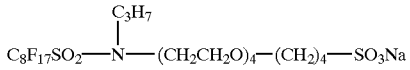

(3) Heat Treatment During Transportation (3-1) Heat Treatment

The PET support with back layers and undercoat layers prepared as described above was introduced into a heat treatment zone having a total length of 200 m set at 160° C., and transported at a tension of 2 kg/cm$^2$ and a transportation speed of 20 m/minute.

(3-2) Post-Heat Treatment

Following the aforementioned heat treatment, the support was subjected to a post-heat treatment by passing it through a zone at 40° C. for 15 seconds, and rolled up. The rolling up tension for this operation was 10 kg/cm$^2$.

Preparation of Thermally Processed Image Recording Material

On the second undercoat layer of the PET support, the aforementioned coating solution for image-forming layer was coated so that the coated silver amount should become 1.5 g/m$^2$ by the slide bead coating method disclosed in JP-A-2000-2964, FIG. 1. On the image-forming layer, the aforementioned coating solution for protective layer was coated simultaneously with the coating solution for image-forming layer as stacked layers so that the coated solid content of the polymer latex should become 1.29 g/m$^2$. Then, the aforementioned coating solution for lower overcoat layer and coating solution for upper overcoat layer were simultaneously coated on the protective layer as stacked layers, so that the coated solid contents of the polymer latex should become 1.97 g/m$^2$ and 1.07 g/m$^2$, respectively, to prepare a thermally processed image recording material.

After the coating, the layers were dried in a horizontal drying zone (the support was at an angle of 1.5–3° to the horizontal direction of the coating machine) under the following conditions: dry-bulb temperature of 70–75° C., dew point of 8–25° C. and liquid film surface temperature of 35–60° C. for both of the constant rate drying process and the decreasing rate drying process until it reached around a drying point where flow of coating solutions substantially ceased. After the drying, the material was rolled up under the conditions of a temperature of 25±5° C. and relative humidity of 45±5%. The material was rolled up in such a rolled shape that the image-forming layer side should be exposed to the outside so as to conform to the subsequent processing (image-forming layer outside roll). The relative humidity in the package of the thermally processed image recording material was 20–40% (measured at 25° C.). Each obtained thermally processed image recording material showed a film surface pH of 5.0 and Beck's smoothness of 750 seconds for the image-forming layer side. The opposite surface showed a film surface pH of 5.9 and Beck's smoothness of 600 seconds.

Evaluation of Photographic Performance (Light Exposure)

Each obtained thermally processed image recording material was light exposed for $1.2\times10^{-8}$ second at a mirror revolution number of 60000 rpm by using a laser light-exposure apparatus of single channel cylindrical internal surface scanning type provided with a semiconductor laser with a beam diameter (½ of FWHM of beam intensity) of 12.56 $\mu$m, laser output of 50 mW and output wavelength of 783 nm. The overlap coefficient of the light exposure was 0.449, and the laser energy density on the thermally processed image recording material surface was 75 $\mu J/cm^2$.

(Heat Development)

Each light-exposed thermally processed image recording material was heat-developed by using such a heat development apparatus as shown in FIG. 1. The roller surface material of the heat development section was composed of silicone rubber, and the flat surface consisted of Teflon non-woven fabric. The heat development was performed at a transportation line speed of 150 cm/minute for 12.2 seconds in the preheating section (driving units of the preheating section and the heat development section were independent from each other, and speed difference as to the heat development section was adjusted to −0.5% to −1%, temperatures of each of the metallic rollers and processing times in the preheating section were as follows: first roller, 67° C. for 2.0 seconds; second roller, 82° C. for 2.0 seconds; third roller, 98° C. for 2.0 seconds; fourth roller, 107° C. for 2.0 seconds; fifth roller, 115° C. for 2.0 seconds; and sixth roller, 120° C. for 2.0 seconds), for 17.2 seconds in the heat development section (surface temperature of thermally processed image recording material: 120° C.), and for 13.6 seconds in the gradual cooling section. The temperature precision as for the transverse direction was ±0.5° C. As for each roller temperature setting, the temperature precision was secured by using a length of rollers longer than the width of the thermally processed image recording material (for example, width of 61 cm) by 5 cm for the both sides and also heating the protruding portions. Since the rollers showed marked temperature decrease at the both end portions, the temperature of the portions protruding by 5 cm from the ends of the thermally processed image recording material was controlled to be higher than that of the roller center by 1–3° C., so that uniform image density of finished developed image should be obtained for the whole thermally processed image recording material (for example, within a width of 61 cm).

(Evaluation Method)

The obtained images were evaluated by using Macbeth TD904 densitometer (visible density). The measurement results were evaluated as Dmin (fog), Dmax (maximum density) and contrast. The contrast was expressed with a gradient of a straight line connecting the points at densities of 0.1 and 3.0, which were obtained after subtraction of 0.1 for a portion of Dmin, with the abscissa being a logarithm of the exposure. For evaluation of storability, moisture of each thermally processed image recording material was conditioned 40% RH at 25° C., and the material was cut into sheets to prepare a stack of three sheets, and introduced into a moisture-proof bag. Two sets of the sheets were prepared for each material and each set was stored at 50° C. for 3 days. Then, for the sets before and after the storage, the center sheet (second sheet) of three was subjected to light exposure and heat development as described above, and evaluated for Dmin, Dmax and contrast.

For practical use, Dmin is preferably 0.15 or less, Dmax is preferably 4.0 or more, and contrast is preferably 15 or more.

The results of the above evaluation for each thermally processed image recording material are shown in Table 1.

TABLE 1

| Sample | Ultrahigh contrast agent | | | Photographic performance | | | | | | |
|---|---|---|---|---|---|---|---|---|---|---|
| | | | | Dmin | | Dmax | | Contrast | | |
| | Addition amount | | | Before | After | Before | After | | | |
| No. | No. | (mmol/Agmol) | pKa | storage | storage | storage | storage | Before storage | After storage | Note |
| 1 | R-1 | 30 | Not higher than 2.9 | 0.14 | 0.15 | 2.8 | 2.7 | Measurement was immpossible | Measurement was immpossible | Comparative |
| 2 | R-2 | 5 | 6.3 | 0.13 | 1.1 | 3.9 | 3.3 | 16.5 | Measurement was immpossible | Comparative |
| 3 | A-3 | 5 | 5.5 | 0.13 | 0.20 | 4.5 | 4.3 | 21.0 | 19.0 | Invention |
| 4 | A-6 | 5 | 3.8 | 0.13 | 0.16 | 4.5 | 4.3 | 20.5 | 19.0 | Invention |
| 5 | A-10 | 5 | 3.4 | 0.12 | 0.13 | 4.4 | 4.3 | 21.0 | 20.5 | Invention |
| 6 | A-12 | 5 | 3.5 | 0.12 | 0.13 | 4.5 | 4.4 | 21.5 | 21.0 | Invention |
| 7 | A-18 | 7 | 3.1 | 0.12 | 0.13 | 4.2 | 4.1 | 20.0 | 19.5 | Invention |
| 8 | A-16 | 10 | 3.4 | 0.13 | 0.14 | 4.3 | 4.3 | 19.5 | 19.0 | Invention |

As clearly seen from the results shown in the table, degradation of photographic performances was not observed after the storage compared with those observed before the storage in the thermally processed image recording materials of the present invention utilizing the compounds represented by the formula (1).

The thermally processed image recording materials utilizing the compounds represented by the formula (1) specifically showed ultrahigh contrast, low Dmin, high Dmax and good storage stability.

EXAMPLE 2

Thermally processed image recording materials were prepared in the same manner as in Example 1 except that the compounds shown in Table 2 were used as ultrahigh contrast agents.

The obtained images were evaluated by using Macbeth TD904 densitometer (visible density) Based on the measured values, development humidity dependency, Dmin (fog), Dmax (maximum density), contrast and sensitivity were calculated according to the following methods and evaluated.

points at densities of 0.1 and 3.0, which were obtained after subtraction of 0.1 for a portion of Dmin, with the abscissa being a logarithm of the exposure. Sensitivity was calculated as a relative value of a reciprocal of a ratio of exposure giving a density higher than Dmin by 1.5.

For practical use, the development humidity dependency is preferably 10 or less, Dmin is preferably 0.15 or less, Dmax is preferably 4.0 or more, contrast is preferably 15 or more, and sensitivity is preferably 1.4 or more.

The results are shown in Table 2.

TABLE 2

| | Ultrahigh contrast agent | | | Photographic performance | | | | | |
|---|---|---|---|---|---|---|---|---|---|
| | | | | Variation of | | | | | |
| Sample No. | Type | Molecular weight | Addition amount (mmol/Agmol) | line width (μm) | Contrast | Sensitivity | Dmin | Dmax | Note |
| 11 | RF-1 | 244.1 | 5 | 14.2 | 13.4 | 1.33 | 0.13 | 4.20 | Comparative |
| 12 | RF-1 | 244.1 | 20 | 17.6 | 16.8 | 1.40 | 0.17 | 3.96 | Comparative |
| 13 | RF-2 | 217.2 | 5 | 12.4 | 12.2 | 1.25 | 0.15 | 3.22 | Comparative |
| 14 | RF-2 | 217.2 | 20 | 15.3 | 15.9 | 1.35 | 0.22 | 4.01 | Comparative |
| 15 | D-28 | 486.7 | 5 | 6.4 | 21.5 | 1.49 | 0.12 | 4.50 | Invention |
| 16 | D-37 | 539.7 | 5 | 7.2 | 19.5 | 1.52 | 0.112 | 4.30 | Invention |
| 17 | D-44 | 483.0 | 5 | 8.8 | 18.5 | 1.47 | 0.14 | 4.25 | Invention |

(RF-1)

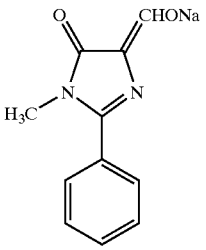

(RF-2)

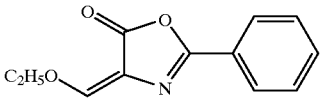

Development humidity dependency was evaluated as a difference of line widths obtained for a thermally processed image recording material that was left in an environment of 30° C. and relative humidity of 75% for 16 hours, exposed at a line width of 60 μm and subjected to heat development with the aforementioned conditions in the same environment, and a thermally processed image recording material that was left in an environment of 20° C. and relative humidity of 20% for 16 hours, similarly exposed at a line width of 60 μm and subjected to heat development with the aforementioned conditions in the same environment. Further, Dmin (fog) and Dmax (maximum density) of the images were also measured in an environment of 25° C. and relative humidity of 50%. Moreover, contrast was calculated as a gradient of a straight line connecting the Samples 15 to 17 utilizing the compounds represented by the formula (A) showed superior performances, that is, they showed markedly smaller development humidity dependency, higher contrast and higher sensitivity as well as lower Dmin and higher Dmax compared with Samples 11 to 14 utilizing the comparative compounds.

EXAMPLE 3

Thermally processed image recording materials were prepared in the same manner as in Example 1 except that the compounds shown in the following table were used as ultrahigh contrast agents and evaluated. The results are shown in the following table.

TABLE 3

| | Ultrahigh contrast agent | | Photographic performance | | | | | | |
|---|---|---|---|---|---|---|---|---|---|
| | | | Dmin | | Dmax | | Contrast | | |
| Sample No. | No. | Addition amount (mmol/Agmol) | Before storage | After storage | Before storage | After storage | Before storage | After storage | Note |
| 21 | R'-1 | 30 | 0.14 | 0.23 | 3.8 | 3.4 | 17.2 | 9.1 | Comparative |
| 22 | R'-5 | 25 | 0.13 | 0.19 | 3.9 | 3.2 | 16.0 | 11.0 | Comparative |
| 23 | α-6 | 5 | 0.12 | 0.13 | 4.5 | 4.4 | 21.5 | 21.0 | Invention |
| 24 | α-15 | 5 | 0.12 | 0.13 | 4.4 | 4.3 | 21.0 | 20.5 | Invention |
| 25 | α-26 | 5 | 0.12 | 0.13 | 4.5 | 4.4 | 21.5 | 21.0 | Invention |
| 26 | α-28 | 5 | 0.12 | 0.13 | 4.4 | 4.3 | 21.0 | 20.5 | Invention |
| 27 | α-49 | 5 | 0.12 | 0.13 | 4.5 | 4.4 | 21.5 | 21.0 | Invention |
| 28 | α-51 | 5 | 0.12 | 0.12 | 4.5 | 4.5 | 21.5 | 21.5 | Invention |

Compound described in U.S. Pat. No. 5,545,515

(R'-1)

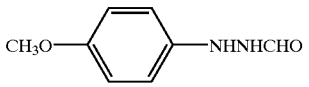

Compound described in JP-A-11-133546

(R'-5)

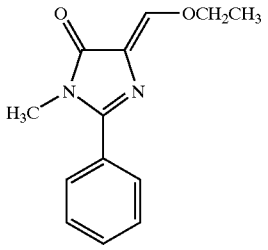

The thermally processed image recording materials utilizing the comparative compounds as the ultrahigh contrast agents showed practically useful photographic performances before the storage, but after the storage, photographic performances were markedly degraded in any of the materials. On the other hand, the thermally processed image recording materials of the present invention, which utilized the compounds represented by the formula (1), did not show significant degradation pf photographic performances even after the storage, and it can be seen that they maintained photographic performances at practically useful levels.

Further, it can also be seen that the compounds represented by the formula (1) can realize high contrast and provide ultrahigh contrast images with a small amount, i.e., 5 mmol/Ag mol.

From the results shown in Table 3, it is clear that the thermally processed image recording materials of the present invention utilizing the compounds represented by the formula (1) specifically show ultrahigh contrast, low Dmin, high Dmax and good storage stability.

EXAMPLE 4

Preparation of Coating Solution for Image-forming Layer

The organic acid silver salt dispersion prepared in Example 1 was added with the following binder, materials and the silver halide emulsion in the indicated amounts per mole of silver in the organic acid silver salt dispersion, and added with water to prepare a coating solution for image-forming layer. After the completion, the solution was degassed under reduced pressure of 0.54 atm for 45 minutes. The coating solution showed pH of 7.3–7.7 and viscosity of 40–50 mPa.s at 25° C.

| | |
|---|---|
| Binder: SBR latex (St/Bu/AA = 68/29/3 (weight %), $Na_2S_2O_8$ was used as polymerization initiator) | 397.0 g as solid |
| 1,1-Bis(2-hydroxy-3,5-dimethyl-phenyl)-3,5,5-trimethylhexane | 148.0 g as solid |
| Organic polyhalogenated compound A | 40.0 g as solid |
| Organic polyhalogenated compound B | 12.0 g as solid |
| Organic polyhalogenated compound C | 2.0 g as solid |
| Development accelerator W | 5.5 g as solid |
| Sodium ethylthiosulfonate | 0.3 g |
| Benzotriazole | 1.2 g |
| Polyvinyl alcohol (PVA-235, produced by Kuraray Co., Ltd.) | 10.8 g |
| 6-Isopropylphthalazine | 13.0 g |
| Compound Z | 9.6 g as solid |
| Compound C | 0.2 g |
| Ultrahigh contrast agent compound | Amount shown in Tables 1–3 |
| Dye A (added as a mixture with low molecular weight gelatin having mean molecular weight of 15000) | Amount giving optical density of 0.3 at 783 nm (about 0.40 g as solid) |
| Silver halide emulsion A | 0.06 mole as Ag |
| Compound A as preservative | 40 ppm in the coating solution (2.5 mg/m$^2$ as coated amount) |
| Methanol | 1 weight % as to total solvent amount in the coating solution |
| Ethanol | 2 weight % as to total solvent amount in the coating solution |

NaOH was used as a pH adjusting agent.

(The coated film showed a glass transition temperature of 17° C.)

Preparation of Coating Solution for Lower Protective Layer

In an amount of 900 g of a polymer latex solution containing copolymer of methyl acrylate/methyl methacrylate=70/30 (weight ratio, mean particle diameter: 110 nm, weight average molecular weight: 800,000, glass transition temperature of copolymer: 30° C., solid content: 28.0 weight %, containing 100 ppm of Compound A) was added with water, 0.2 g of Compound E and 35.0 g of polyvinyl alcohol (PVA-235, Kuraray Co., Ltd.) and further added with water to form a coating solution (containing 0.5 weight % of methanol solvent). After the preparation, the solution was degassed under reduced pressure of 0.47 atm for 60 minutes. The coating solution showed pH of 5.2, and viscosity of 35 mPa.s at 25° C.

Preparation of Coating Solution for Upper Protective Layer

In an amount of 900 g of a polymer latex solution containing copolymer of methyl acrylate/methyl methacrylate=70/30 (weight ratio, mean particle diameter: 110 nm, weight average molecular weight: 800,000, glass transition temperature of copolymer: 30° C., solid content: 28.0 weight %, containing 100 ppm of Compound A) was added with 10.0 g of 30 weight % solution of carnauba wax (Cellosol 524, silicone content: less than 5 ppm, Chukyo Yushi Co., Ltd.), 0.3 g of Compound C, 1.2 g of Compound E, 25.0 g of Compound F, 6.0 g of Compound H, 5.0 g of matting agent (polystyrene particles, mean particle diameter: 7 μm, variation coefficient of 8% for mean particle diameter) and 40.0 g of polyvinyl alcohol (PVA-235, Kuraray Co., Ltd.), and further added with water to form a coating solution (containing 1.5 weight % of methanol solvent). After the preparation, the solution was degassed under reduced pressure of 0.47 atm for 60 minutes. The coating solution showed pH of 2.4 and viscosity of 35 mPa.s at 25° C.

Preparation of Thermally Processed Image Recording Material

On undercoat layers of a PET support coated with the undercoat layers as described in Example 1, the aforementioned coating solution for image-forming layer, coating solution for lower protective layer and coating solution for upper protective layer were simultaneously coated as stacked layers in this order from the support by the slide bead coating method disclosed in JP-A-2000-2964, FIG. 1, so that the coated silver amount in the image-forming layer should become 1.5 g/m$^2$, the coated solid content of the polymer latex in the lower protective layer should become 1.0 g/m$^2$, and the coated solid content of the polymer latex in the upper protective layer should become 1.3 g/m$^2$.

As for drying conditions after the coating, the layers were dried in a first drying zone (low wind velocity drying region) at a dry-bulb temperature of 70–75° C., dew point of 9–23° C., wind velocity of 8–10 m/second at the support surface and liquid film surface temperature of 35–40° C., and in a second drying zone (high wind velocity drying region) at a dry-bulb temperature of 65–70° C., dew point of 20–23° C. and wind velocity of 20–25 m/second at the support surface. The drying was performed by transferring the material from the first drying zone to the second drying zone when residence time in the first drying zone corresponding to ⅔ of the period of the constant ratio drying in this zone was passed. The first drying zone was a horizontal drying zone (the support was at an angle of 1.5–3° to the horizontal direction of the coating machine). The coating speed was 60 m/minute. After the drying, the material was rolled up under the conditions of a temperature of 25±5° C. and relative humidity of 45±10%. The material was rolled up in such a rolled shape that the image-forming layer side should be exposed to the outside so as to conform to the subsequent processing (image-forming layer outside roll). The humidity in the package of the thermally processed image recording material was 20–40% of relative humidity (measured at 25° C.). The obtained thermally processed image recording material showed a film surface pH of 5.1 and Beck's smoothness of 5000 seconds for the image-forming layer side. The opposite surface showed a film surface pH of 5.9 and Beck's smoothness of 500 seconds.

Samples were prepared and evaluated in the same manner as in Examples 1 to 3 except that the coating method was changed. As a result, the samples having the characteristics of the present invention showed good performances as in Examples 1 to 3.

EXAMPLE 5

A coating solution for lower protective layer was prepared in the same manner as in Example 4. A coating solution for upper protective layer was prepared in the same manner as in Example 4 except that 5.0 g of polystyrene particles having a mean particle size of 11 μm (variation coefficient for mean particle size: 8%) were used as the matting agent.

Then, on undercoat layers of a PET support coated with the undercoat layers as described in Example 1, the aforementioned coating solution for image-forming layer, coating solution for lower protective layer and coating solution for upper protective layer were simultaneously coated as stacked layers in this order from the support by the slide bead coating method disclosed in JP-A-2000-2964, FIG. 1, so that the coated silver amount in the image-forming layer should become 1.5 g/m$^2$, the coated solid content of the polymer latex in the lower protective layer should become 1.2 g/m$^2$, and the coated solid content of the polymer latex in the upper protective layer should become 1.4 g/m$^2$.

The drying conditions after the coating and the rolled shape were the same as those of Example 4, that is, the material was rolled up in such a rolled shape that the image-forming layer side should be exposed to the outside so as to conform to the subsequent processing (image-forming layer outside roll). The relative humidity in the package of the thermally processed image recording material was 20–40% (measured at 25° C.). Each obtained thermally processed image recording material showed a film surface pH of 5.1 and Beck's smoothness of 1300 seconds for the image-forming layer side. The opposite surface showed a film surface pH of 5.9 and Beck's smoothness of 500 seconds.

When the samples obtained as described above were evaluated by the same methods as in Example 1, the samples having the characteristics of the present invention showed good performances as in Examples 1 to 3.

EXAMPLE 6

When the thermally processed image recording materials produced in Examples 1 to 5 were subjected to a heat development by using DRY SYSTEM PROCESSOR FDS-6100X produced by Fuji Photo Film Co., Ltd., the samples having the characteristics of the present invention showed good performance as in Examples 1 to 5.

What is claimed is:

1. A thermally processed image recording material having at least one image-forming layer on one side of a support, which contains, on the side of the support, a silver salt of an organic acid, a reducing agent and at least one compound represented by the following formula (1):

Formula (1)

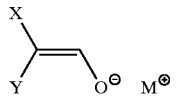

wherein, in the above formula, X and Y each independently represent an electron-withdrawing group and M represents a counter cation, and the conjugate acid of the enolate anion in the formula (1) has a pKa value of 3.0–6.0.

2. The thermally processed image recording material according to claim 1, wherein the X and Y in the formula (1) bind to each other to form a 5- or 6-membered heterocyclic ring.

3. The thermally processed image recording material according to claim 2, wherein the X and Y in the formula (1) bind to each other to form a 2-imidazolin-5-one ring.

4. The thermally processed image recording material according to claim 1, wherein the compound of the formula (1) has a molecular weight of 100–2000.

5. The thermally processed image recording material according to claim 1, wherein the conjugate acid of the enolate anion in the formula (1) has a pKa value of 3.2–3.7.

6. The thermally processed image recording material according to claim 1, wherein the compound of the formula (1) is added in an amount of from $2\times10^{-4}$ to $2\times10^{-1}$ mole per mole of silver.

7. The thermally processed image recording material according to claim 1, wherein the compound represented by formula (1) is a compound represented by the following formula (α) on the side of the support having the image-forming layer:

Formula (α)

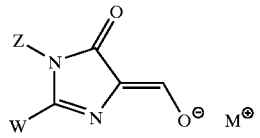

wherein, in the above formula, Z represents an alkyl group, an aryl group or a heterocyclic group, W represents an aryl group or an alkyl group substituted with an electron-withdrawing group, Z and W may bind to each other to form a ring structure, and M represents a counter cation.

8. The thermally processed image recording material according to claim 7, wherein W in the formula (α) is an alkyl group substituted with one or more fluorine atoms.

9. The thermally processed image recording material according to claim 8, wherein Z in the formula (α) is an aryl group substituted with an alkyl group, an alkoxy group or an alkylamino group.

10. The thermally processed image recording material according to claim 7, wherein Z in the formula (α) is an aryl group.

11. The thermally processed image recording material according to claim 7, wherein the compound of the formula (α) has a molecular weight of 300–1000.

12. The thermally processed image recording material according to claim 7, wherein the compound of the formula (α) is added in an amount of from $2\times10^{-4}$ to $2\times10^{-1}$ mole per mole of silver.

13. The thermally processed image recording material according to claim 1, which contains a photosensitive silver halide on the side of the support having the image-forming layer.

14. The thermally processed image recording material having at least one image-forming layer on one-side of a support, which comprises, on the one-side of the support, a silver salt of an organic acid, a reducing agent, and at least one compound represented by the following formula (A) having a molecular weight of 480 or more on the side of the support having the image-forming layer:

Formula (A)

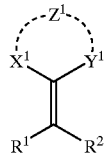

wherein, in the above formula, $R^1$ and $R^2$ each independently represent a hydrogen atom or a monovalent substituent, $X^1$ represents an oxygen atom, a sulfur atom or a nitrogen atom, $Y^1$ represents a group represented as —C(=O)—, —C(=S)—, —SO—, —$SO_2$—, —C(=$NR^3$)— or —($R^4$)C=N— where $R^3$ and $R^4$ each independently represent a hydrogen atom or a substituent, and $Z^1$ represents a nonmetallic atomic group that can form a 5- to 7-membered ring together with $X^1$ and $Y^1$, provided that $R^1$ and $R^2$ do not bind to each other to form a ring structure.

15. The thermally processed image recording material according to claim 14, wherein the compound of the formula (A) has a molecular weight of 2000 or less.

16. The thermally processed image recording material according to claim 14, wherein the compound of the formula (A) is added in an amount of from $2\times10^{-5}$ to $2\times10^{-1}$ mole per mole of silver.

17. The thermally processed image recording material according to claim 7, which contains at least one compound represented by the following formula (B) as the compound of the formula (A):

Formula (B)

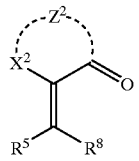

wherein, in the above formula, $R^5$ and $R^6$ each independently represent a hydrogen atom or a monovalent substituent, $X^2$ represents an oxygen atom, a sulfur atom or a nitrogen atom, and $Z^2$ represents a nonmetallic atomic group that can form a 5- to 7-membered ring together with $X^2$, provided that $R^5$ and $R^6$ do not bind to each other to form a ring structure.

18. The thermally processed image recording material according to claim 17, wherein one of $R^5$ and $R^6$ in the formula (B) represents a hydrogen atom, and the other represents a hydroxy group or a salt thereof, an alkoxy group or a heterocyclic group.

19. The thermally processed image recording material according to claim 17, wherein $Z^2$ in the formula (B) forms a 5-membered heterocyclic ring together with $X^2$.

20. The thermally processed image recording material according to claim 19, wherein the heterocyclic ring contains 3–50 carbon atoms in total.

* * * * *